US007175187B2

(12) United States Patent
Lyden

(10) Patent No.: US 7,175,187 B2
(45) Date of Patent: Feb. 13, 2007

(54) WHEELED SKATE WITH STEP-IN BINDING AND BRAKES

(76) Inventor: Robert M. Lyden, 18261 SW. Fallatin Loop, Aloha, OR (US) 97007

( * ) Notice: Subject to any disclaimer, the term of this patent is extended or adjusted under 35 U.S.C. 154(b) by 333 days.

(21) Appl. No.: 10/628,540

(22) Filed: Jul. 28, 2003

(65) Prior Publication Data

US 2004/0021278 A1 Feb. 5, 2004

Related U.S. Application Data

(63) Continuation-in-part of application No. 09/228,206, filed on Jan. 11, 1999, now abandoned.

(51) Int. Cl.
*A63C 1/02* (2006.01)

(52) U.S. Cl. ..... 280/11.3; 280/11.206; 280/11.216; 280/11.232

(58) Field of Classification Search ..... 280/11.3, 280/11.31, 11.16, 11.206, 11.216, 11.221, 280/11.26, 11.232, 11.223, 11.204, 11.205; 36/62

See application file for complete search history.

(56) References Cited

U.S. PATENT DOCUMENTS

| | | | |
|---|---|---|---|
| 25,295 | A | 8/1859 | Wheeler |
| 38,173 | A | 4/1863 | Marvin |
| 181,868 | A | 9/1876 | Saladee |
| 240,970 | A | 5/1881 | Cornelius |
| 253,784 | A | 2/1882 | Tapper |
| 259,708 | A | 6/1882 | Neely |
| 296,358 | A | 4/1884 | Rowlett |
| 298,721 | A | 5/1884 | Bailey |
| 304,949 | A | 9/1884 | Mitchell |
| 320,626 | A | 6/1885 | Castle |
| 566,694 | A | 8/1896 | Libbey |
| 604,179 | A | 8/1898 | Sulke |
| 829,900 | A | 8/1906 | Shelmire |
| 893,341 | A | 7/1908 | Martinsen |
| 920,848 | A | 5/1909 | Eubank |
| 1,405,951 | A | 2/1922 | St. Pierre |
| 1,609,612 | A | 12/1926 | Eskeland |
| 1,640,134 | A | 8/1927 | Salberg |

(Continued)

FOREIGN PATENT DOCUMENTS

| | | |
|---|---|---|
| CA | A12071806 | 7/1993 |

(Continued)

OTHER PUBLICATIONS

*Global Skate*, Oct.-Nov. 1996 HYPNO Skates Advertisement Letter Dated Feb. 1, 1999 From Darren Jones, Attorey at K2, Inc., to Robert M. Lyden Citing Prior Art.

*Primary Examiner*—J. Allen Shriver
(74) *Attorney, Agent, or Firm*—Nickolas E. Westman; Westman, Champlin & Kelly, P.A.

(57) ABSTRACT

The present invention teaches an apparatus and method for removably securing an article of footwear suitable for walking, running, or bicycling to a wheeled skate. Further, the present invention also teaches a brake device for use with a wheeled skate. In addition, the present invention teaches a wheeled skate that can be propelled with the use of linear or side stroke skating techniques. Moreover, the present invention teaches a quad wheeled skate having advantageous structure and function for recreational skating and aerobic exercise.

30 Claims, 32 Drawing Sheets

U.S. PATENT DOCUMENTS

| | | | | | |
|---|---|---|---|---|---|
| 1,700,058 | A | | 1/1929 | Katuby | |
| 1,771,855 | A | | 7/1930 | MacMillan | |
| 1,835,446 | A | | 12/1931 | Tracey | |
| 1,866,134 | A | | 7/1932 | Smith | |
| 2,118,892 | A | | 5/1938 | Mays | 280/11.3 |
| 2,168,820 | A | | 8/1939 | Edstrom | |
| 2,244,719 | A | | 6/1941 | Mansfield | 280/11.3 |
| 2,461,057 | A | | 2/1949 | Hirschman | 280/11.27 |
| 2,470,840 | A | | 5/1949 | Anz | |
| 2,552,987 | A | | 5/1951 | Loertz, Jr. | |
| 2,664,294 | A | | 12/1953 | Kleinman | |
| 2,696,989 | A | | 12/1954 | Kleinman | 280/11.27 |
| 2,998,260 | A | | 8/1961 | Meyer | 280/7.13 |
| 3,026,118 | A | | 10/1962 | Paré | 280/11.3 |
| 3,061,325 | A | | 10/1962 | Glass | 280/11.35 |
| 3,202,434 | A | * | 8/1965 | Goodman | 280/11.26 |
| 3,224,785 | A | * | 12/1965 | Stevenson | 280/11.206 |
| 3,228,707 | A | | 1/1966 | Davis | |
| 3,229,989 | A | | 1/1966 | Papangelis | 280/11.31 |
| 3,292,940 | A | | 12/1966 | Weitzner | 280/7.13 |
| 3,339,936 | A | | 9/1967 | Hamlin | 280/11.2 |
| 3,387,852 | A | | 6/1968 | Sarro | 280/11.2 |
| 3,526,976 | A | | 9/1970 | Jacobs | 36/2.3 |
| 3,653,678 | A | | 4/1972 | Collett | 280/11.23 |
| 3,689,091 | A | | 9/1972 | Nagin | 280/11.12 |
| 3,774,924 | A | | 11/1973 | Machatsch | 280/11.28 |
| 3,829,111 | A | | 8/1974 | Nicholls | 280/11.3 |
| 3,865,388 | A | | 2/1975 | Haldemann | 280/11.33 |
| 3,918,728 | A | | 11/1975 | Stugger et al. | 280/11.13 E |
| 3,918,729 | A | | 11/1975 | Peters | 280/11.3 |
| 3,963,251 | A | | 6/1976 | Miano | 280/11.18 R |
| 3,963,252 | A | | 6/1976 | Carlson | 280/11.22 |
| 3,993,318 | A | | 11/1976 | Rothmayer | 280/11.26 |
| 4,058,323 | A | | 11/1977 | Ware, Jr. | 280/11.1 R |
| 4,072,317 | A | | 2/1978 | Pommerening | 280/11.23 |
| 4,107,856 | A | | 8/1978 | Bourque | 36/115 |
| 4,114,295 | A | | 9/1978 | Schaefer | 36/10 |
| 4,185,851 | A | | 1/1980 | Salomon | 280/613 |
| 4,272,090 | A | | 6/1981 | Wheat | 280/11.22 |
| 4,272,091 | A | | 6/1981 | Reid, Jr. | 280/11.28 |
| 4,298,210 | A | * | 11/1981 | Lotteau et al. | 280/259 |
| 4,314,708 | A | | 2/1982 | Zuuring | 280/11.18 |
| 4,351,537 | A | | 9/1982 | Seidel | 280/11.12 |
| 4,373,736 | A | | 2/1983 | Stumbaugh | 280/11.23 |
| 4,392,659 | A | | 7/1983 | Yoshimoto | 280/11.23 |
| 4,418,929 | A | | 12/1983 | Gray | 280/11.23 |
| 4,618,158 | A | | 10/1986 | Liberkowski | 280/11.18 R |
| 4,622,863 | A | | 11/1986 | Denker | 74/594.6 |
| 4,686,867 | A | | 8/1987 | Bernard et al. | 74/594.6 |
| 4,708,352 | A | | 11/1987 | Vullierme | 280/11.26 |
| 4,840,086 | A | | 6/1989 | Bidal | 74/594.6 |
| 4,842,293 | A | | 6/1989 | Rochard | 280/615 |
| 4,844,491 | A | | 7/1989 | Wheelwright | 280/11.2 |
| 4,893,420 | A | | 1/1990 | Bezin et al. | 36/131 |
| 4,907,813 | A | | 3/1990 | Hall | 280/11.18 |
| 4,928,549 | A | * | 5/1990 | Nagano | 74/594.6 |
| 4,942,778 | A | | 7/1990 | Bryne | 74/594.6 |
| 4,943,075 | A | | 7/1990 | Gates | 280/842 |
| 4,945,658 | A | | 8/1990 | Provence | 36/117 |
| 4,988,122 | A | | 1/1991 | Saunders | 280/841 |
| 5,003,841 | A | | 4/1991 | Nagano | 74/594.4 |
| 5,048,848 | A | | 9/1991 | Olson et al. | 280/11.22 |
| 5,060,537 | A | | 10/1991 | Nagano | 74/594.6 |
| 5,068,984 | A | | 12/1991 | Kaufmann | 36/117 |
| 5,086,576 | A | | 2/1992 | Lamson | 36/131 |
| D324,838 | S | | 3/1992 | Briscadieu | D12/125 |
| 5,092,614 | A | | 3/1992 | Malewicz | 280/11.22 |
| 5,108,125 | A | | 4/1992 | Callegari | 280/615 |
| 5,115,692 | A | | 5/1992 | Nagano | 74/594.4 |
| 5,125,173 | A | | 6/1992 | Nagano | 36/131 |
| 5,142,798 | A | | 9/1992 | Kaufman | 36/117 |
| 5,171,033 | A | | 12/1992 | Olson et al. | 280/11.22 |
| 5,183,276 | A | * | 2/1993 | Pratt | 280/11.221 |
| 5,192,088 | A | * | 3/1993 | Yu | 280/11.225 |
| 5,195,397 | A | | 3/1993 | Nagano | 74/594.4 |
| 5,195,781 | A | | 3/1993 | Osawa | 280/842 |
| 5,199,324 | A | | 4/1993 | Sain | 74/594.4 |
| 5,199,726 | A | | 4/1993 | Willett | 280/11.3 X |
| 5,205,056 | A | | 4/1993 | Okajima et al. | 36/131 |
| 5,211,076 | A | | 5/1993 | Baume et al. | 74/594.6 |
| 5,211,409 | A | | 5/1993 | Mitchell et al. | 280/11.2 |
| 5,213,009 | A | | 5/1993 | Bryne | 74/594.6 |
| 5,224,730 | A | | 7/1993 | Provence et al. | 280/615 |
| 5,232,231 | A | | 8/1993 | Carlsmith | 280/11.2 |
| 5,253,882 | A | | 10/1993 | Mitchell | 280/11.2 |
| 5,299,815 | A | | 4/1994 | Brosnan | 280/11.2 |
| 5,303,940 | A | | 4/1994 | Brandner | 280/11.22 |
| 5,314,199 | A | | 5/1994 | Olson et al. | 180/11.22 |
| 5,316,325 | A | | 5/1994 | Mitchell et al. | 280/11.2 |
| 5,318,310 | A | | 6/1994 | LaBerge | 280/11.17 |
| 5,325,738 | A | | 7/1994 | Bryne | 74/594.6 |
| 5,330,207 | A | | 7/1994 | Mitchell | 280/11.2 |
| 5,331,752 | A | | 7/1994 | Johnson et al. | 36/115 |
| 5,342,071 | A | | 8/1994 | Soo | 280/11.2 |
| 5,357,695 | A | | 10/1994 | Lu | 36/115 |
| 5,363,526 | A | | 11/1994 | Okajima | 74/594.6 |
| 5,372,383 | A | | 12/1994 | Kubierscky | 280/842 |
| 5,382,052 | A | | 1/1995 | Tarng | 280/844 |
| 5,392,537 | A | | 2/1995 | Goldberg | 36/134 |
| 5,393,077 | A | | 2/1995 | Wanous | 280/7.13 |
| 5,397,141 | A | | 3/1995 | Hoshizaki et al. | 280/11.3 |
| 5,401,040 | A | | 3/1995 | Grenko | 280/11.28 |
| 5,405,156 | A | | 4/1995 | Gonella | 280/11.28 |
| 5,415,419 | A | | 5/1995 | Bourke | 280/11.2 |
| 5,423,233 | A | | 6/1995 | Peyre et al. | 74/594.6 |
| 5,435,579 | A | | 7/1995 | Pozzobon | 280/11.2 |
| 5,437,466 | A | | 8/1995 | Meibock et al. | 280/11.22 |
| 5,441,287 | A | | 8/1995 | Tang | 280/11.28 |
| 5,446,977 | A | | 9/1995 | Nagano | 36/131 |
| 5,465,984 | A | | 11/1995 | Pellegrini | 280/11.2 |
| 5,470,085 | A | | 11/1995 | Meibock et al. | 280/11.2 |
| 5,484,148 | A | | 1/1996 | Olivieri | 280/11.18 |
| 5,497,680 | A | | 3/1996 | Nagano | 74/594.6 |
| 5,501,474 | A | | 3/1996 | Conte | 280/11.2 |
| 5,505,111 | A | | 4/1996 | Nagano | 74/594.6 |
| 5,505,470 | A | | 4/1996 | Hoshizaki | 280/11.22 |
| 5,507,506 | A | | 4/1996 | Shadroui | 280/11.22 |
| 5,511,803 | A | | 4/1996 | Klukos | 280/11.2 |
| 5,522,282 | A | | 6/1996 | Nagano | 74/594.6 |
| 5,524,912 | A | | 6/1996 | Laub et al. | 280/7.13 |
| 5,546,829 | A | | 8/1996 | Bryne | 36/131 |
| 5,551,711 | A | | 9/1996 | Mangelsdorf | 280/11.2 |
| 5,557,985 | A | | 9/1996 | Nagano | 74/594.6 |
| D374,759 | S | | 10/1996 | Edauw et al. | D2/902 |
| D374,760 | S | | 10/1996 | Edauw et al. | D2/902 |
| 5,564,718 | A | | 10/1996 | Mitchell et al. | 280/11.2 |
| 5,566,958 | A | * | 10/1996 | Sinelnikov et al. | 280/11.231 |
| 5,595,396 | A | | 1/1997 | Bourdeau | 280/607 |
| 5,615,901 | A | | 4/1997 | Piotrowski | 280/7.14 |
| 5,628,129 | A | | 5/1997 | Kilgore et al. | 36/134 |
| 5,630,597 | A | | 5/1997 | Klukos | 280/11.2 |
| 5,641,169 | A | | 6/1997 | Bekessy | 280/11.18 |
| 5,649,715 | A | | 7/1997 | Mitchell | 280/11.2 |
| 5,651,556 | A | | 7/1997 | Mitchell | 280/11.2 |
| 5,655,783 | A | | 8/1997 | Brosnan | 280/11.2 |
| 5,664,794 | A | | 9/1997 | Mitchell et al. | 280/11.2 |
| 5,687,492 | A | | 11/1997 | Muraoka | 36/131 |
| 5,699,699 | A | | 12/1997 | Nagano | 74/594.6 |
| 5,704,619 | A | | 1/1998 | Mitchell et al. | 280/11.2 |
| 5,716,074 | A | | 2/1998 | Theodorou | 280/843 |
| 5,727,429 | A | | 3/1998 | Ueda | 74/594.6 |
| 5,738,360 | A | | 4/1998 | Petell et al. | 280/11.22 |
| 5,755,144 | A | | 5/1998 | Ueda | 74/594.6 |
| 5,769,434 | A | | 6/1998 | Wurthner | 280/11.18 |

| | | | | |
|---|---|---|---|---|
| 5,771,757 | A | 6/1998 | Hanamura | 74/534.4 |
| 5,772,221 | A | 6/1998 | Daley | 280/11.22 |
| 5,778,739 | A | 7/1998 | Takahama | 74/594.6 |
| 5,784,930 | A | 7/1998 | Ueda | 74/594.6 |
| 5,784,931 | A | 7/1998 | Ueda | 74/594.6 |
| 5,787,764 | A | 8/1998 | Peyre | 74/594.6 |
| 5,791,663 | A | 8/1998 | Klukos | 280/11.2 |
| 5,794,950 | A | 8/1998 | Svensson et al. | 280/11.2 |
| 5,799,957 | A | 9/1998 | Okajima et al. | 280/14.2 |
| 5,806,379 | A | 9/1998 | Nagano | 74/594.6 |
| 5,813,678 | A | 9/1998 | Robins | 280/11.2 |
| 5,820,138 | A | 10/1998 | Suni | 280/7.13 |
| 5,839,734 | A | 11/1998 | Steinhauser, Jr. | 280/7.13 |
| RE35,993 | E | 12/1998 | Gierveld | 280/11.22 |
| 5,845,927 | A | 12/1998 | Steinhauser, Jr. | 280/7.14 |
| 5,855,380 | A | 1/1999 | Di Filippo et al. | 280/613 X |
| 5,860,492 | A | 1/1999 | Talaska | 188/5 |
| 5,899,465 | A | 5/1999 | Mayer | 280/11.2 |
| 5,908,196 | A | 6/1999 | Weiss | 280/11 X |
| 5,913,530 | A | 6/1999 | Berger et al. | 280/613 X |
| 5,967,552 | A * | 10/1999 | Roderick et al. | 280/843 |
| 5,992,266 | A | 11/1999 | Heim | 74/594.6 |
| 6,035,743 | A | 3/2000 | Gapinski et al. | 74/594.6 |
| 6,120,038 | A | 9/2000 | Dong et al. | 280/11.3 |
| 6,234,046 | B1 | 5/2001 | Coombe | 74/594.6 |
| 6,270,089 | B1 * | 8/2001 | Marechal | 280/11.3 |
| 6,276,235 | B1 | 8/2001 | Heim | 74/594.6 |
| 6,331,007 | B1 * | 12/2001 | Bryce | 280/11.3 |
| 6,341,540 | B2 | 1/2002 | Steinberg | 74/594.6 |
| 6,422,578 | B1 * | 7/2002 | Oh | 280/11.232 |
| 6,425,304 | B1 | 7/2002 | Bryne | 74/594.6 |
| 6,494,117 | B1 | 12/2002 | Bryne | 74/594.6 |
| 6,497,420 | B2 * | 12/2002 | Ricci | 280/11.16 |
| 6,729,629 | B2 * | 5/2004 | Chi | 280/11.27 |
| 6,955,360 | B2 * | 10/2005 | Krivulin | 280/11.206 |
| 2003/0201614 | A1 * | 10/2003 | Chi | 280/11.3 |

FOREIGN PATENT DOCUMENTS

| | | | |
|---|---|---|---|
| CH | 602147 | | 7/1978 |
| DE | 2745040 | | 12/1979 |
| DE | G9208063.4 | | 6/1992 |
| DE | 2507279 | A1 | 2/1995 |
| DE | 19654899 | | 11/1997 |
| DE | 19613208 | | 1/1998 |
| EP | 0551704 | A2 | 7/1993 |
| EP | 0559179 | A1 | 8/1993 |
| EP | 0545250 | | 9/1993 |
| FR | 2718652 | | 10/1995 |
| FR | 2720286 | | 12/1995 |
| WO | WO 94/20176 | | 9/1994 |
| WO | WO 95/03101 | | 2/1995 |
| WO | WO 97/26054 | | 7/1997 |
| WO | WO 97/36655 | | 10/1997 |

* cited by examiner

≅40°

WHEELED SKATE WITH STEP-IN BINDING AND BRAKES

CROSS-REFERENCE TO RELATED APPLICATION

This Application is a Continuation-In-Part of my application Ser. No. 09/228,206, filed Jan. 11, 1999 now abandoned, and priority is hereby claimed on application Ser. No. 09/228,206 under 35 U.S.C. Section 120, and the content of which Application is hereby incorporated by reference.

FIELD OF THE INVENTION

The present invention relates generally to wheeled skates, and in particular, to in-line and quad wheeled skates. Further, the present invention relates to the use of locking mechanisms such as step-in bindings with an article of footwear and wheeled skate which can be easily removably attached. In addition, the present invention relates to the use of several brake devices for wheeled skates which can be variously employed by toe drag, snow-plow, or hockey-stop braking techniques.

Definitions

The human foot consists of a rearfoot that includes the calcaneus and talus, a midfoot that includes the navicular, cuboid, and three cuneiforms, and a forefoot that includes the metatarsals, phalanges, and sesamoid bones. Obviously, there can be some individual variability with respect to these anatomical landmarks which are not normally visible to the human eye. Accordingly, for the sake of clearly defining the scope of the present invention, general reference herein to the forefoot will refer to any portion of an individual's foot or an article of footwear which is anterior to one half of its length as measured from the posterior side, and reference to the rearfoot will refer to any portion of an individual's foot or an article of footwear which is posterior to one half of its length as measured from the posterior side. Further, the ball of the foot is generally located proximate the metatarsal-phalangeal joints of the foot. The position of these anatomical landmarks can likewise vary from person to person. However, the first metatarsal-phalangeal joint is normally located at approximately 70 percent of foot length, and the fifth metatarsal-phalangeal joint is normally located at greater than 60 percent of foot length, but less than that of the first metatarsal-phalangeal joint. Accordingly, the center of the ball of the foot is approximately between 60 and 70 percent of a given foot length. The use of the word anterior shall mean at the front, or in a direction closer to the front of a individual's foot, an article of footwear, a wheeled skate, or other object, and the word posterior shall mean at the rear, or in a direction closer to the rear of an individual's foot, an article of footwear, a wheeled skate, or other object. The use of the word longitudinal axis shall mean a line running anterior to posterior and generally bisecting an individual's foot, an article of footwear, or a wheeled skate and consistent with the intersection of the sagittal and transverse planes. The use of the word transverse axis shall mean a line that intersects and is perpendicular to the longitudinal axis and consistent with the intersection of the frontal and transverse planes. The use of the word transverse shall mean a line, action, or force which is directed substantially consistent with or parallel to the transverse axis, thus approximately perpendicular to the longitudinal axis.

BACKGROUND OF THE INVENTION

Many prior art roller skates have included mechanical engagement means such as clamping devices for adjusting the width of the wheeled skate, thereby engaging the sides of a skater's article of footwear and securing the wheeled skate thereto. In this regard, a key or wretch was commonly used to adjust a screw or bolt-like drive mechanism. And many prior art roller skates have also included straps and buckles for further securing the chassis of a wheeled skate to a wearer's article of footwear, e.g., U.S. Pat. No. 240,970, U.S. 1,700,058, and U.S. Pat. No. 2,552,987. Some prior art wheeled skates also included length adjusting mechanical means, such as U.S. Pat. No. 1,609,612, and the like, thus permitting a single wheeled skate chassis to accommodate wearers having different size foot lengths. Formerly, it was common for conventional articles of footwear to be used with removable wheeled roller skates.

In recent times, the main trend of the skate industry has been to construct skates having an integral chassis and upper. Accordingly, the relatively rigid integral uppers of many in-line wheeled skates today closely resemble those of ski boots. A few modern wheeled skate uppers can be removed, but most are not intended to be selectively removable. If and when removed from a wheeled skate, these uppers are normally unsuitable to stand alone and serve as a conventional article of footwear. Most of these wheeled skates are of the in-line variety, and the uppers are commonly made of injection molded thermoplastics. The thermoplastic upper normally extends far above the ankle of a wearer. The interior of the upper of many current in-line wheeled skates includes a padded inner liner. The upper and chassis are sometimes molded as a single unit, or alternatively bolted or riveted together. When consisting of a separate component, the chassis portion of the wheeled skate is commonly made of thermoplastics, carbon fiber, or metal such as aluminum, titanium or steel. These types of wheeled skates are often relatively large, awkward, heavy, and expensive. They generally do not breathe well, and as result can be hot and uncomfortable. Wheeled skates of this kind are not easy to transport, and take up considerable space when packing and traveling.

Accordingly, there have been several recent attempts to depart from the use of uppers which generally resemble rigid thermoplastic ski boots in the manufacture of in-line wheeled skates. NIKE, Inc., Canstar Sports Group, Salomon, K-2 Corporation, Hypno, and Rollerblade Inc. have introduced products which have included uppers, that at least in part, more closely resemble conventional athletic shoes. For example, see U.S. Pat. No. 5,331,752 assigned to Rollerblade, U.S. Pat. No. 5,437,466 assigned to K-2 Corporation, and U.S. Pat. No. 5,397,141 assigned to Canstar Sports Group, all of these patents being hereby incorporated by reference herein.

Hypno has made a high top upper which can be selectively attached to a skate chassis, as has Rollerblade, Inc., as disclosed in U.S. Pat. No. 5,331,752. However, these attempts to re-introduce a more conventional and selectively removable shoe upper have not met with great commercial success. One of the reasons is that the would-be shoe uppers have been marginally functional in their dual role as conventional articles of footwear when disengaged from the wheeled skate. However, the present inventor believes that there are other reasons for the commercial failure of these initiatives.

The inventor was raised in Minnesota, and during his lifetime first learned to skate on ice during the wintertime on a generic child's skate characterized by relatively low elevation of the foot, then later on figure skates, hockey skates, and speed skates. Hockey is a major winter sport in Minnesota, and the development of modern in-line skates was largely in response to the need of hockey players to skate and condition themselves in the summer months. And today, nearly the entire in-line skating industry has adopted what is essentially the hockey skate model for their product as concerns skate geometry and skating technique. This is one of the bottlenecks or problems which has stifled the industry. It has prevented consumers, who have no desire to be hockey players or to skate like them, from obtaining more functional skates for the purpose of aerobic exercise, or artistic skating.

The hockey skate is faster, but it is both less maneuverable and less capable of providing high quality skating relative to the figure skate. Many of the maneuvers commonly performed by figure skaters are simply not possible on a hockey skate. The elevation as between the heel of the foot and the ball of the foot is commonly 1¼ inches in a figure skate. The distance between the bottom of the wearer's heel and the supporting ice surface is commonly 2⅝ inches, and the distance between the bottom of the wearer's ball of the foot and the supporting ice surface is commonly between 1⅞ and 2 inches. In contrast, the elevations associated with hockey skates are much higher, that is, commonly 3⅝ inches under the heel, and 2¾ inches under the ball of the foot. As a result of this geometry, the effective leverage and magnitude of the loads which need to be managed about the ankle joint with respect to inversion and eversion of the foot, in particular, by the stabilizing structures of the foot and lower leg such as the peroneals and posterior tibialis, are much greater in the hockey skate, and those skates having like geometry, relative to the figure skate. As result, the configuration of the upper of a hockey skate is normally high, thereby providing support and partial immobilization of the ankle in order to control inversion or eversion of a skater's foot. Figure skates are also characterized by high uppers, but this construction is not required for normal skating on the ice surface, rather this is required to support the ankle and foot regarding the high loads associated with the jumps and gymnastic-like maneuvers that figure skaters commonly perform. No high skate upper is required for normal skating given the common elevation of the heel and ball of the foot consistent with the figure skate model. The loads associated with normal skating maneuvers are generally always less than 2½ body weights, whereas loads in the range between 5–10 body weights can be associated with the jumps commonly performed by figure skaters.

Speed skates for use on ice do not normally include a high upper. The geometry of most speed skates places the ball of the foot higher, and the heel somewhat lower, than that of figure skates. However, in-line speed skates for use on dry land commonly adopt the higher elevations at the ball and heel of the hockey skate model in order to include the use of large wheels which provide for higher speeds when rolling on asphalt. The common practice and need for high and relatively rigid uppers, or other stabilizing devices intended to resist inversion and eversion of the foot in wheeled skates, then largely derives from the adoption of relatively high elevations of the heel and ball of the foot normally associated with the hockey skate model. The relatively high elevation of conventional in-line skates makes skating more difficult for the general public, and likely contributes to many of the falls and injuries which are experienced during in-line skating. Given these considerations, it can be readily understood that much can be said for introducing lower elevations with respect to the heel and ball of the foot in a wheeled skate.

While speed is desired in hockey and speed skates, such is a secondary consideration for those who desire to participate in skating in order to enjoy a non-impact form of aerobic exercise. In fact, the speeds provided by current in-line hockey and speed skates can be unmanageable as concerns safety and braking, in particular, given the presence of hilly terrain or a traffic filled environment. Further, many recreational athletes would be pleased to obtain 30–60 minutes of aerobic exercise each day. Wheeled skates characterized by a skating speed of even 6 minutes per mile would result in 10 miles distance being covered during an hour of exercise. Clearly, slower wheeled skates which might also require a higher aerobic demand could then be suitable for use in aerobic exercise. Today, most wheeled skates are simply too fast to effectively control given the height at which the foot is elevated, the hazards present in an urban or suburban environment, and the lack of truly effective braking systems. The adoption of the hockey skate geometry and model, and focus on attaining high speeds has limited the potential of wheeled skates to meet other criteria with respect to skating, such as the consumer's desire for a non-impact form of aerobic exercise and safety.

A relatively short side stroke is commonly used with a hockey skate, whereas a somewhat longer side stroke is commonly used with a speed skate. Both of these side stroke styles place considerable loads upon the ankle, knee, hip, and lower back of skaters. Accordingly, the side stroke skating style places demands upon a skater which require a high level of conditioning. In truth, the side stroke skating style is more taxing on the anatomy, and more likely to result in injury than the relatively linear stroke technique used in figure skating. The side stroke skating style is also harder to learn and to manage than the linear stroke technique. Walking and running are examples of relatively linear motions with which the general public is most familiar and competent. Accordingly, a wheeled skate built more along the figure skate geometry and model which permits both the use of the linear stroke skating style, and if desired, the side stroke skating style, can be advantageous for use by members of the general public.

The side stroke skating style also requires considerable space in order to execute. On a sidewalk or street, the presence of cars and pedestrians and the danger of collision renders the side stroke style somewhat less safe or manageable. Moreover, the herringbone technique will have to be used when attempting to ascend a hill using a wheeled skate when employing the side stroke skating style, just as when scaling a steep hill using cross-country skis. This technique requires numerous quick side strokes in order to gain elevation, and is both physically taxing and inefficient. In contrast, a wheeled skate which facilitates a linear skating style can enable a skater to ascend a hill with a more direct line of attack.

It is known in the art to include mechanical mating means for properly locating and stabilizing an article of footwear with regards to the chassis of a wheeled skate. For example, "male" members upon the upper surface of a wheeled skate chassis have been used to interact with corresponding "female" grooves or like features in the sole of an article of footwear, as disclosed in U.S. Pat. No. 38,173, and U.S. Pat. No. 5,331,752, or vice-versa, as disclosed in U.S. Pat. No. 2,998,260, U.S. Pat. No. 3,963,251, and possibly wheeled skates made by the Hypno company. The use of mating "male" and "female" members as between an article of footwear and ski is also known in prior art cross-country and downhill ski boot and binding systems.

It is known to use step-in mechanical engagement means such as the Shimano, Inc. SPD bicycle cleat system with bicycle shoes and petals, and snowboard bindings and boots. The teachings of Shimano, Inc. in this regard include the following U.S. patents: U.S. Pat. No. 5,557,985, U.S. Pat. No. 5,522,282, U.S. Pat. No. 5,505,111, U.S. Pat. No. 5,497,680, U.S. Pat. No. 5,446,977, U.S. Pat No. 5,205,056, U.S. Pat. No. 5,195,397, U.S. Pat. No. 5,125,173, U.S. Pat. No. 5,115,692, U.S. Pat No. 5,060,537, U.S. Pat No. 5,003,841, U.S. Pat. No. 5,778,739, U.S. Pat. No. 5,755,144, U.S. Pat. No. 5,727,429, U.S. Pat No. 5,363,526, U.S. Pat No. 5,806,379, U.S. Pat. No. 5,799,957, U.S. Pat. No. 5,784,931, U.S. Pat. No. 5,784,930, U.S. 5,771,757, U.S. Pat No. 5,699,699, U.S. Pat. No. 5,687,492, U.S. Pat. No. 5,199,324, U.S. Pat. No. 4,622,863, all of these patents being hereby incorporated by reference herein. The teachings of Look, S. A., with respect to step-in bicycle cleat systems includes U.S. Pat. No. 5,787,764, U.S. Pat. No. 5,423,233, U.S. Pat. No. 5,211,076, U.S. Pat. No. 4,893,420, U.S. Pat. No. 4,840,086, U.S. Pat. No. 4,686,867, and U.S. Des. 324,838, all of these patents being hereby incorporated by reference herein. The teachings of Speedplay, Inc. of San Diego, Calif. include U.S. Pat. No. 6,494,117, U.S. Pat. No. 6,425,304, U.S. Pat. No. 5,546,829, U.S. 5,325,738, U.S. Pat. No. 5,213,009, and U.S. Pat. No. 4,942,778, all of these patents being hereby incorporated by reference herein. Other recent patents directed to clipless bicycle systems include U.S. Pat. No. 6,341,540, U.S. Pat. No. 6,276,235, U.S. Pat. No. 6,234,046, U.S. Pat. No. 6,035,743, and U.S. Pat. No. 5,992,266, all of these patents being hereby incorporated by reference herein. However, there appears to be no teaching with respect to the use of a step-in bicycle cleat system in the wheeled skate prior art.

It is known to use aperture plugs with respect to the axles of in-line wheeled skates, e.g., see U.S. Pat. No. 5,048,848 assigned to Rollerblade, Inc. It is also known in the art to provide rocker with respect to an ice skate blade, but also with respect to the geometry of a wheeled skate. And with regards to in-line wheeled skates, it is known to provide adjustable rocker means by providing for movement of one or more of the wheels vertically. In some cases, the front and rear wheels can be moved vertically upwards in order to introduce greater rocker, and in others skates, the middle wheel(s) can be moved vertically downwards to accomplish the same result. U.S. Pat. No. 5,505,470 granted to T. Blaine Hoshizaki and assigned to Canstar Sports Group, hereby incorporated by reference herein, teaches a generally triangular shaped removable insert for quickly making changes to the position of skate wheels in order to adjust the rocker of the wheeled skate as desired. The total amount of rocker introduced in a full sized men's skate is normally less than ½ inch, and more commonly closer to ¼ inch. The desired amount of rocker and adjustment is then normally less than 10 mm, and increments of merely 3 mm are often desirable.

When speaking of in-line wheeled skates, it is not really possible to introduce rocker in a two-wheeled skate, but such is possible with skates having three or more wheels. When rocker is suitably introduced a short distance behind the metatarsal-phalangeal joints associated with the ball of the skater's foot, a three wheeled skate can permit substantially all of the skater's weight and ground contact of the skate to be selectively placed upon the middle wheel. For this reason a three wheeled skate can be advantageous for changing from forward to rearward skating, and vice versa, as well as the conduct of other more demanding skating maneuvers. In an in-line three wheeled skate configuration, both the need for proper rocker in a skate, and the fact that most of the power in the side stroke skating technique during accelerations is transferred from the forward part of the skate, tends to favor placing the middle wheel closer to the front wheel, rather than closer to the rear wheel. In this regard, it can be desirable to change not only the vertical orientation of the middle wheel in order to introduce or fine tune the rocker of the skate, but also to change the horizontal orientation of the middle wheel, that is, to shift the position of the middle wheel towards the toe or heel, as desired, in order enhance the rocker effect.

In a quad wheeled skate, that is, in a four wheeled skate in which the wheels are not positioned in-line, it is normally not possible to perform the so-called hockey-stop braking action unless the skating surface is exceptionally smooth, and/or the frictional characteristics of the wheel and skating surface permit. However, in an in-line two or three wheeled skate the hockey-stop braking action is possible. When braking on a rough surface, the rearmost wheel can then become rapidly abraded. Nevertheless, with respect to side slippage, an in-line two or three wheeled skate behaves much more like a true ice skate, than does a quad wheeled skate. The ability of an in-line three wheeled skate to include rocker and to perform the hockey-stop braking action, thus makes it the closest to a true ice skate as concerns its handling and performance characteristics.

It is known to use roller bearings, ball bearings, but also journal type bearings in wheeled skates, e.g., see German Patent DT 2,507,279 A1, dated Feb. 20, 1975. And it is also known to use thermoplastic bearings with or without lubrication in wheeled vehicles. Manufacturers of suitable thermoplastic bearings include IGLIDE® bearings by IGUS of East Providence, R.I., and NYLINER® bearings by Thompson Industrial Molded Products, Inc. of Port Washington, N.Y. Supplies of resins for such thermoplastic bearings include LUBRICOMP® materials by LNP Engineering Plastics, Inc. of Exton, Pa., and DSM Engineering Plastics of Evansville, Ind. The use of such thermoplastic bearings can reduce bearing weight and cost, and facilitate the design of novel wheel configurations.

Wheeled skates having toe stop or toe drag front brakes are known in the art and such include both roller skates and in-line wheeled skates, e.g., U.S. Pat. No. 5,401,040, U.S. 4,373,736, U.S. Pat. No. 4,392,659, and U.S. Pat. No. 5,372,383. A toe stop or toe drag front brake can serve to check a skater's forward speed when the skater drags the toe of the wheeled skate behind their body upon the skating surface. This action does not so greatly disturb the skater's balance nor result in forces being directed into and thereby disturbing the pelvis as when a skater raises their foot and extending it in front of themselves in order to engage a brake pad that is placed at the rear of a wheeled skate, as is common in some of the in-line wheeled skate prior art. Further, during forward motion the toe stop or toe drag front brake can facilitate turning, thus acting to rotate the torso in the direction of the desired turn much as a bulldozer or tank maneuvers. In addition, when a skater has reversed and is skating rearwards, the toe stop or toe drag front brake can then act de facto as a rear brake, and more substantial braking power can then be generated, that is, relative to a rear mounted brake when the skater is moving forwards. This is due to the fact that the toe stop or toe drag front brake is then more or less directly under the skater's center of gravity and nearly all of the skater's weight can be brought to bear upon the brake without the skater losing balance.

Wheeled skates having fixed brake pads or other braking devices positioned at the rear of a wheeled skate are known in the prior art, e.g., numerous patents granted to David Mitchell including, U.S. Pat. No. 5,664,794, U.S. Pat. No. 5,704,619, U.S. Pat. No. 5,651,556, U.S. Pat. No. 5,649,715, U.S. Pat. No. 5,564,718, U.S. Pat. No. 5,330,207, U.S. Pat. No. 5,211,409, U.S. Pat. No. 5,253,882, and U.S. 5,316,325. Many of these teachings include cuff actuation of a brake pad which is then lowered to engage the skating surface. A skate brake including a rear mounted wheel and brake drum structure is taught in U.S. patents granted to Ed Klukos including U.S. Pat. No. 5,791,663, U.S. Pat. No. 5,630,597, and U.S. Pat. No. 5,511,803. Other rear mounted brake systems include U.S. Pat. No. 5,501,474 assigned to Roces, U.S. Pat. No. 5,415,419 assigned to Canstar Sports Group, U.S. Pat. No. 5,470,085 and U.S. Pat. No. 5,794,950 assigned to K-2 Corporation, U.S. Pat. No. 5,435,579 and U.S. Pat. No. 5,465,984 assigned to Nordica, and U.S. Pat. No. 5,655,783, U.S. Pat. No. 5,299,815 granted to Keller Brosnan.

Most of the existing rear mounted brakes developed for in-line wheeled skates do not develop sufficient braking power to stop a skater moving at speed within a short distance. Further, these rear mounted brake systems do not generally permit the execution of rapid avoidance maneuvers while braking, that is, the act of braking is achieved at the expense of maneuverability. In addition, these rear mounted brakes generally require an erect posture of the skater and leg movements such as straightening the knees to actuate an ankle cuff mechanism, or placing the lower leg and foot well in front of the torso, thus substantially in front of the skater's center of gravity. These actions are not conducive to maintaining balance when stopping suddenly. When skating, the normal reaction of an individual moving forwards when startled and desiring to arrest movement is to crouch and lower the center of gravity, put their hands forward, and to adduct the feet and pronate. Skaters will also dig in their heels, that is, if and when this can be accomplished without losing their balance. These actions are generally consistent with the snow-plow braking methods used in ice skating and skiing. Unfortunately, these actions are generally inconsistent with the posture and movements required to successfully actuate many of the rear positioned brake systems that are presently being used on in-line wheeled skates.

Locating brake pads at either extreme end of an in-line wheeled skate can be counter-productive both from the standpoint of being able to applied substantial forces to the brake pad, and also the skater's need or desire to simultaneously maintain balance, control, and maneuverability while braking. Human anatomy is such that most of the stabilizers of the foot as concerns inversion and eversion, such as the peroneals and posterior tibialis, insert in the midfoot area. The further away that brake pads or similar devices are position from these anatomical stabilizing structures, generally, the greater is the potential leverage and force which can be developed to work against them. This can undermine an in-line skater's ability to brake, balance, and maintain control and maneuverability during hard braking. However, because of the greater stability of a quad wheeled skate, locating brake pads at the front and rear of a quad wheeled skate poses no such problem.

Again, the so-called hockey-stop method can be used to stop an ice skate. Essentially, while moving forwards, a skater turns their skates sideways while applying sufficient force as to more greatly slow the forward part of their skates, then slowly rotates the rear portion of the blade about while dragging the side of the blade across the ice so as to come to a full stop while moving sideways. As stated previously, this maneuver generally cannot be performed with a quad wheeled skate unless the skating surface is smooth and/or characterized by a low coefficient of friction, but it can be performed with in-line two wheeled skates, and in particular, with in-line three wheeled skates. However, this braking maneuver quickly consumes the rear wheel of a skate, as the wheel then effectively doubles as a brake pad. This maneuver is also more difficult and dangerous to perform on dry land given the relative unevenness of most skating surfaces. Moreover, if skaters fall on dry land they will not slide as on ice, and unlike relatively smooth ice, an asphalt skating surface can severely cut and abrade.

There is a need for effective brakes on both in-line and quad wheeled skates, that is, brakes which can safely and quickly stop a skater who is moving rapidly, and without substantially compromising the skater's control and maneuverability. This is believed to be the greatest single issue which prevents in-line and quad wheeled skates from becoming a safe and reliable form of non-impact aerobic exercise. Further, while in-line wheeled skates can provide advantages in speed and maneuverability for a proficient skater, they are not as stable or forgiving for use by the general public as quad wheeled skates. Accordingly, there is a need for an improved quad wheeled skate that would reduce the elevation of a skater's foot, but also increase the width of the wheel base relative to conventional roller skates for the purpose of enhancing stability. Further, there is need for an improved quad wheeled skate that would provide means for employing a relatively linear skating technique. In addition, there is need for a relatively simple, light-weight, and inexpensive suspension for wheeled skates. Moreover, there is need for an improved quad wheeled skate which includes means for rapidly and easily selectively removing an article of footwear that can also be used for one or more activities such as walking, running, and bicycling, and skating, whether in partial or complete combination.

SUMMARY OF THE INVENTION

The present invention teaches an apparatus and method for securing an article of footwear that is suitable for walking, running, or bicycling to a wheeled skate. Further, the present invention teaches brake devices which can facilitate use of toe stop, toe drag, heel drag, snow-plow, and hockey-stop braking maneuvers. The wheeled skates and brakes are configured to enable a skater to retain balance, control and maneuverability even when engaged in hard braking. In addition, the present invention teaches a wheeled skate which can be propelled with the use of linear or side stroke skating techniques.

A wheeled skate can comprise a chassis, and an article of footwear. The wheeled skate and article of footwear can comprise a locking mechanism assembly for removably securing the article of footwear to the wheeled skate. The locking mechanism assembly can comprise a footwear portion of locking mechanism assembly secured to the article of footwear, and the chassis of the wheeled skate can comprise a compatible skate portion of locking mechanism assembly. The footwear portion of locking mechanism assembly can comprise a bicycle cleat portion of a bicycle cleat locking apparatus, whereby the article of footwear can be removably secured in functional relation to a bicycle pedal including a compatible pedal portion of bicycle cleat locking apparatus, and alternatively, to the chassis of the wheeled skate comprising the compatible skate portion of locking mechanism assembly.

The footwear portion of locking mechanism assembly can comprise a female part, and the compatible skate portion of locking mechanism assembly can comprise a male part. Alternatively, the footwear portion of locking mechanism assembly can comprise a male part, and the compatible skate portion of locking mechanism assembly can comprise a female part. Alternatively, the footwear portion of locking mechanism assembly, the compatible skate portion of locking mechanism assembly, and also the pedal portion of bicycle cleat locking apparatus can each comprise both male and female features, and therefore be characterized as hermaphroditic.

The wheeled skate and article of footwear can further include means for removably securing the rearfoot of the article of footwear to the wheeled skate including a rearfoot retainer flange, and a strap.

The wheeled skate can further comprise a rotatable brake pad including a peripheral portion which is orientated to engage a skating surface supporting the wheeled skate when the medial side of the wheeled skate is inclined inwardly. The wheeled skate can further comprise a renewable wear surface on the chassis for engagement with a rotatable brake pad. A rotatable brake pad can be substantially spherical, oval, or cylindrical in shape. The wheeled skate can further comprise a longitudinal axis, and a rotatable brake pad can be configured for rotation substantially parallel with respect to the longitudinal axis of the wheeled skate. Alternatively, a rotatable brake pad can be configured for rotation substantially transversely with respect to the longitudinal axis of the wheeled skate. Further, a peripheral portion of a rotatable brake pad can be engaged with a portion of the chassis of the wheeled skate. In addition, a rotatable brake pad can be engaged with a brake pad retainer, and the rotatable brake pad and brake pad retainer can be removable and renewable.

The wheeled skate can comprise a chassis having an inferior side, and the chassis can include a platform on the superior side. The rotatable brake pad can comprise an oval brake pad, and the brake pad retainer can comprise an oval brake pad retainer. The oval brake pad retainer can extend between a position near the inferior portion of the chassis and the platform of the chassis at an angle in the range between 25–45 degrees.

The wheeled skate can comprise a rocker adjustment device.

The wheeled skate can comprise a chassis having an anterior chassis portion and a posterior chassis portion which can be secured in functional relation using fastening means, whereby the effective length of said chassis and wheeled skate can be adjusted.

The wheeled skate can comprise a longitudinal axis, and the anterior portion of the chassis can include an oval brake pad configured for rotation substantially parallel with respect to the longitudinal axis of the wheeled skate, and the posterior portion of the chassis can include a cylindrical brake pad configured for rotation substantially transversely with respect to the longitudinal axis of the wheeled skate.

The wheeled skate can have a plurality of wheels for rolling upon a skating surface and can comprise a chassis having a longitudinal axis, a medial side, and an oval brake pad mounted to a brake pad support. The oval brake pad can include a peripheral portion which is orientated to engage a skating surface supporting the wheeled skate by inclining the medial side of the wheeled skate inwardly. The oval brake pad can be located exterior to the medial side of the chassis, and the oval brake pad can rotate substantially parallel with respect to the longitudinal axis of the wheeled skate and independently of the plurality of wheels, when the peripheral portion of the oval brake pad engages the skating surface when the medial side of the wheeled skate is inclined inwardly.

The wheeled skate can have a plurality of wheels for rolling upon a skating surface and can comprise a chassis having a longitudinal axis, and a medial side. A rotatable brake pad can be mounted to a brake pad support. The rotatable brake pad can be orientated to engage the skating surface supporting the wheeled skate when the medial side of the wheeled skate is inclined inwardly. The rotatable brake pad can be located exterior to the medial side of the chassis, and the rotatable brake pad can rotate substantially parallel with respect to the longitudinal axis of the wheeled skate and independently of the plurality of wheels, when the medial side of the wheeled skate is inclined inwardly.

The wheeled skate can have a chassis comprising a longitudinal axis, a medial side, and a rotatable brake pad mounted to a brake pad support. The rotatable brake pad can include a peripheral portion which is orientated to engage a skating surface supporting the wheeled skate when the medial side of the wheeled skate is inclined inwardly. The rotatable brake pad can be configured for rotation during braking mode such that a surface of the peripheral portion of the rotatable brake pad rotates substantially transversely with respect to the longitudinal axis of the wheeled skate when the medial side of the wheeled skate is inclined inwardly, and contact is made with the skating surface. The rotatable brake pad can be located exterior to the medial side of the chassis, and at least a portion of the peripheral portion of the rotatable brake pad can bear against a portion of the chassis. The chassis can further include a removable and renewable wear surface, and the wear surface can bear against the peripheral portion of the rotatable brake pad.

The wheeled skate can comprise a chassis having a medial side, and an article of footwear. The wheeled skate can further comprise a rotatable brake pad including a peripheral portion which is orientated to engage a skating surface supporting the wheeled skate when the medial side of the wheeled skate is inclined inwardly. The rotatable brake pad can be located exterior to the medial side of the chassis. The wheeled skate and the article of footwear can further comprise means for removably securing the article of footwear to the wheeled skate comprising a footwear portion of locking mechanism assembly secured to the article of footwear, and the chassis can comprise a compatible skate portion of locking mechanism assembly. The footwear portion of locking mechanism assembly can comprise a bicycle cleat portion of a bicycle cleat locking apparatus. The article of footwear can be removably secured in functional relation to a bicycle pedal including a compatible pedal portion of bicycle cleat locking apparatus, and alternatively, to the chassis of the wheeled skate comprising the compatible skate portion of locking mechanism assembly.

A wheeled skate can comprise a chassis, and an article of footwear can comprise an anterior side, a posterior side, a medial side, a lateral side, a forefoot portion, and a rearfoot portion. The wheeled skate and article of footwear can comprise means for removably securing the forefoot portion of the article of footwear to the wheeled skate comprising a footwear portion of locking mechanism assembly secured to the article of footwear, and the chassis of the wheeled skate comprising a compatible skate portion of locking mechanism assembly. The footwear portion of locking mechanism assembly and the skate portion of locking mechanism assembly are capable of being removably secured in functional relation by inserting and rotating compatible portions thereof. The wheeled skate can further include means for removably securing the rearfoot of the article of footwear to the chassis of the wheeled skate. The means for removably securing the rearfoot of the article of footwear to the chassis of the wheeled skate can include the use of a rearfoot retainer flange encompassing a portion of the medial, lateral, and posterior sides of the article of footwear. When the forefoot of the article of footwear is secured in functional relation to the chassis of the wheeled skate and the rearfoot is inserted in functional relation to the rearfoot retainer flange, the rearfoot of the article of footwear can then be further secured by fastening means to the rearfoot retainer flange. The footwear portion of locking mechanism assembly can comprise a bicycle cleat portion of bicycle cleat locking apparatus, whereby the article of footwear can be removably secured in functional relation to a bicycle pedal including a compatible pedal portion of bicycle cleat locking apparatus, and alternatively, to the chassis of the wheeled skate comprising the skate portion of locking mechanism assembly.

The wheeled skate can comprise an in-line wheeled skate having two, three, four, five, or other number of wheels. Alternatively, a wheeled skate can include a single centrally positioned wheel.

A wheeled skate can include a rear bumper.

A wheeled skate can include a male vertical stabilizer.

A wheeled skate can include tool retainers and tools.

A rotatable brake pad can have a spherical, oval, cylindrical, flat, or rounded shape. A rotatable brake pad can be made of a natural or synthetic rubber material, a thermoplastic material, or hybrid combination thereof A rotatable brake pad can rotate substantially parallel with the longitudinal axis of the skate. Alternatively, a rotatable brake pad can rotate transversely with reference to the longitudinal axis of the skate. Rotatable brake pads having various shapes and functional capabilities can be used in synergistic combinations on a wheeled skate. Alternatively, a wheeled skate can comprise a front brake pad and rear brake pad that are stationary, and each can be removably secured to the chassis of the wheeled skate with fastening means.

A wheeled skate can include means for securing the rearfoot of an article of footwear in functional relation to the wheeled skate including a rearfoot retainer flange, at least one strap, a male rearfoot retainer such as a male hinged rearfoot retainer including a hinge, projection, and a snap lock, a male vertical stabilizer, a male snap fit rearfoot retainer, a male rearfoot push button retainer, a male clip rearfoot retainer, a male threaded rearfoot retainer, and other conventional mechanical engagement means. A wheeled skate can also include means for securing the rearfoot of an article of footwear in functional relation to the wheeled skate including an integral skate upper. The integral skate upper can further include a forefoot portion, a rearfoot portion, and an opening. It can be readily understand that the recited means for securing the rearfoot of an article of footwear, and their equivalents, can be used in various alternate combinations.

An article of footwear can be characterized as low cut, mid cut or high cut, and can include a plurality of straps. An article of footwear can include an external heel counter, a medial side counter, and a lateral side counter, whether in partial or complete combination. An article of footwear can include a spring element. An article of footwear can further comprise a female rearfoot retainer.

A quad wheeled skate for use by a wearer having a given foot length size, the wearer's foot length size being assigned a dimensionless value of 1 for the purpose of expressing and defining at least one relationship and ratio between the given foot length size and specific dimensions of the wheeled skate. The wheeled skate comprising an anterior side, a posterior side, a medial side, a lateral side, a superior side, an inferior side, a longitudinal axis, a transverse axis, a chassis having a platform, a front axle having a middle, a rear axle having a middle, a plurality of wheels consisting of two front wheels and two rear wheels, and an overall longitudinal length. The overall longitudinal length being a function of the wearer's foot length size and expressed as a ratio of the overall longitudinal length to the wearer's foot length size being preferably in the range between 1/1 and 1.25/1, and most preferably in the range between 1.045/1 and 1.136/1. The wheeled skate having a longitudinal wheel base length between the middle of the front axle and the middle of the rear axle, the longitudinal wheel base length being a function of the wearer's foot length size and expressed as a ratio of the wearer's foot length size and the longitudinal wheel base length being preferably in the range between 1.2/1 and 1.6/1, and most preferably in the range between 1.25/1 and 1.5/1. The wheeled skate having a first transverse wheel base length consisting of the outside measurement between the front wheels and a second transverse wheel base length consisting of the outside measurement between the rear wheels, and each of the first transverse wheel base length and the second transverse wheel base length preferably being in the range between 4 and 6½ inches, and most preferably in the range between 4½ and 6 inches. The wheeled skate having a length between the middle of the front axle and the anterior side of the wheeled skate, and also a length between the middle of the rear axle and the posterior side of the wheeled skate, each length preferably being in the range between 1 to 3 inches, and most preferably being in the range between 1½ and 2½ inches. When the wheeled skate is resting upright and level upon a level support surface the inferior side of the chassis has a height above the support surface preferably in the range between ¼ to ¾ inches, and most preferably in the range between ⅜ to ½ inches. And the height of the platform of the chassis of the wheeled skate adjacent to the front axle is preferably in the range between 1 to 2½ inches.

A quad wheeled skate can further comprise a front brake pad extending to the anterior side of the quad wheeled skate, and a rear brake pad extending to the posterior side of the quad wheeled skate, and the front brake pad and the rear brake pad each can be removably secured by fastening means.

A quad wheeled skate can further comprise an anterior chassis portion, a posterior chassis portion, and fastening means, whereby the longitudinal length of the quad wheeled skate is adjustable.

A quad wheeled skate can further comprise an anterior chassis portion, a posterior chassis portion, and a skate portion of locking mechanism assembly secured to the anterior chassis portion.

A quad wheeled skate can further comprise a skate portion of locking mechanism assembly and an article of footwear for receiving and securing the foot of a wearer. The article of footwear can have an anterior side, a posterior side, a superior side, an inferior side, a medial side, and a lateral side, a forefoot, and a rearfoot. The forefoot of the article of footwear extends greater than one half of the length of the article of footwear when measured from the posterior side, and the rearfoot extends between the posterior side and one half of the length of the article of footwear. The article of footwear can further include a footwear portion of locking mechanism assembly secured to the inferior side of the forefoot, and the article of footwear including the footwear portion of locking mechanism assembly can be removably secured to the skate portion of locking mechanism assembly.

The footwear portion of locking mechanism assembly can comprise a bicycle cleat portion of bicycle cleat locking apparatus.

The quad wheeled skate can further include means for removably securing the rearfoot of the article of footwear to the quad wheeled skate, and such can include a rearfoot retainer flange, and also a strap. The quad wheeled skate can further include a male rearfoot retainer which can be removably secured to the rearfoot retainer flange of the quad wheeled skate, but also to an article of footwear which further comprises a female rearfoot retainer. The male rearfoot retainer can comprise a rearfoot push button retainer.

In a preferred quad wheeled skate, the angle drawn between a level support surface and the inferior side of the front brake pad from the tangent point of contact of the front wheel with the level support surface, and also the angle drawn between the level support surface and the inferior side of the rear brake pad from the tangent point of contact of the rear wheel with the level support surface, are preferably each in the range between 5–35 degrees, and most preferably in the range between 5–15 degrees.

A wheeled skate can further comprise an elastomeric suspension comprising an axle retainer and an elastomer, the axle retainer can have a superior side, inferior side, anterior side, posterior side, medial side, and lateral side, and the elastomer can substantially encompass the axle retainer on at least the superior side, inferior side, anterior side, and posterior side.

A quad wheeled skate can further include a substantially plastic body.

A quad wheeled skate can further include an integral skate upper for receiving and securing a wearer's foot. The integral skate upper can further comprise a forefoot portion, and a rearfoot portion.

A method of removably securing an article of footwear to a wheeled skate, the wheeled skate comprising a longitudinal axis, a skate portion of locking mechanism assembly having a first center of rotation, and a rearfoot retainer flange. The article of footwear comprises an upper for receiving and securing the foot of a wearer. The article of footwear having an anterior side, a posterior side, a superior side, an inferior side, a medial side, and a lateral side, a forefoot, and a rearfoot, the forefoot extending greater than one half of the length of the article of footwear when measured from the posterior side, and the rearfoot extending between the posterior side and one half of the length of the article of footwear. The article of footwear further includes a footwear portion of locking mechanism assembly having a second center of rotation secured to the inferior side of the forefoot. Accordingly, when the wearer dons the article of footwear and places the second center of rotation of the footwear portion of locking mechanism assembly in alignment with the first center of rotation of the skate portion of locking mechanism assembly when the rearfoot of the article of footwear is rotated laterally with respect to the longitudinal axis of the wheeled skate in the range between 0–40 degrees, the footwear portion of locking mechanism assembly and the skate portion of locking mechanism assembly are each positioned for mechanical engagement. The wearer can then sufficiently elevate the rearfoot of the article of footwear to clear the lateral side of the rearfoot retainer flange while rotating the rearfoot of the article of footwear medially. The wearer can then place the article of footwear in substantial alignment with the longitudinal axis of the wheeled skate thereby mechanically engaging and locking the footwear portion of locking mechanism assembly and the skate portion of locking mechanism assembly causing the forefoot of the article of footwear to be secured to the wheeled skate. The wearer can then removably secure the rearfoot of the article of footwear to the wheeled skate by lowering the rearfoot within the confines of the rearfoot retainer flange, the rearfoot retainer flange then encompassing the rearfoot of the article of footwear on a portion of the medial, posterior, and lateral sides. The wearer can then further removably secure the rearfoot of the article of footwear to the wheeled skate using fastening means.

The footwear portion of locking mechanism assembly can comprise a bicycle cleat portion of bicycle cleat locking apparatus. Accordingly, an article of footwear including the bicycle cleat portion of bicycle cleat locking apparatus can be removably secured to a compatible wheeled skate including the skate portion of locking mechanism assembly, or alternatively, to a bicycle pedal including a corresponding bicycle cleat portion of bicycle cleat locking apparatus.

A wheeled skate can comprise an elastomeric suspension including an axle retainer and an elastomer, the axle retainer can have a superior side, inferior side, anterior side, posterior side, medial side, and lateral side, and the elastomer can substantially encompass the axle retainer on at least the superior side, inferior side, anterior side, and posterior side.

DETAILED DESCRIPTION OF THE PREFERRED EMBODIMENTS

Figure 1:
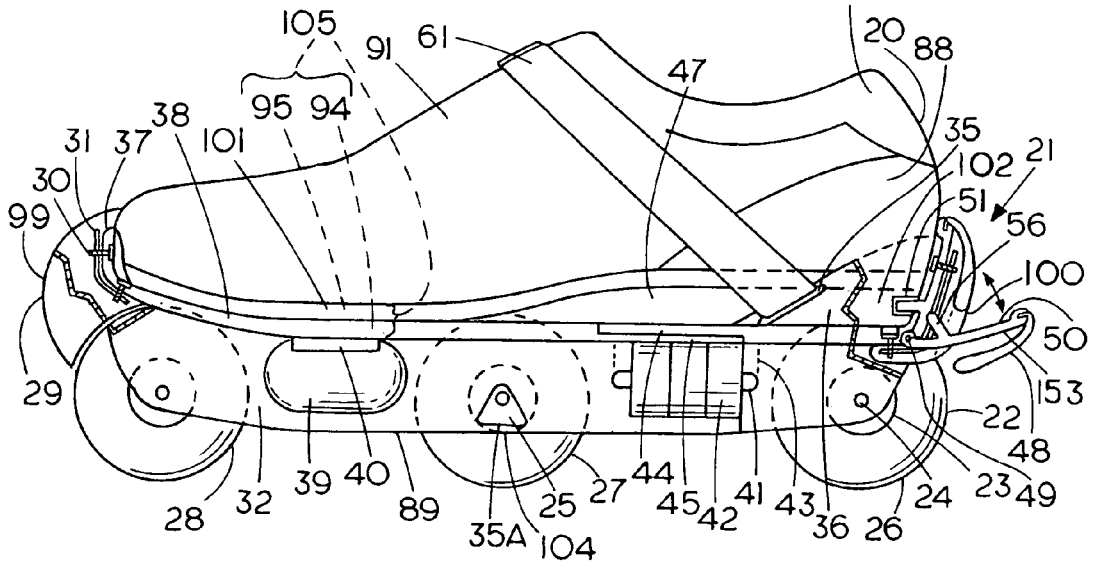
FIG. 1 is side view of an article of footwear secured to a skate having parts broken away.

FIG. 1 is a side view of an article of footwear 20 secured to a wheeled skate 21 having a posterior portion of the chassis 32 and rearfoot retainer flange 36 broken away to show portions of the male rearfoot retainer 153 and the female rearfoot retainer 51. The male rearfoot retainer 153 consisting of a male hinged rearfoot retainer 50 is shown in both an open and closed position with an arrow in order to illustrate operation of the device. In addition, parts of the toe retainer flange 37, chassis 32, and front brake pad 29 are broken away to show retainer 31 and bolts 30. Shown with respect to the wheeled skate 21 are the anterior side 99, medial side 91, posterior side 100, front wheel 28, middle wheel 27, rear wheel 26, axles 24, rocker adjustment device 25, chassis 32, inferior portion of chassis 89, platform 38, footwear portion of locking mechanism assembly 95 and skate portion of locking mechanism assembly 94 which can be mechanically engaged in functional relation to form a locking mechanism assembly 105, toe retainer flange 37, bolts 30, retainers 31, a toe stop or toe drag brake pad which will hereinafter be indicated as front brake pad 29, oval brake pad 39, oval brake pad retainer 40, cylindrical brake pad 42, cylindrical brake pad retainer 41, vertical brace 43, anterior chassis portion 45, posterior chassis portion 44, rearfoot retainer flange 36, opening 35*a*, strap 61, hinge pin 49, projection 56, loop 48, external heel counter 88, and rear bumper 55. In the specification and drawing figures, general reference to a structure will normally be indicated by a numeral, and when a more specific reference to a particular structure would appear to be helpful, it will then be indicated by a numeral and the addition of an alphabetical suffix. For example, in the specification and drawing figures, general reference to a bolt will be indicated by numeral 30, and when a more specific reference to a particular bolt would appear to be helpful, it will then be indicated by numeral 30 and the addition of an alphabetical suffix.

Front brake pad 29 projects beyond the anterior portion of the chassis 32 and front wheel 28 and can thereby serve as a bumper to attenuate impact of the anterior side 99 of the wheeled skate 21 with an object, thus protecting the wheeled skate 21, article of footwear 20 and skater from damage or possible injury. Further, the front brake pad 29 can be dragged upon the skating surface behind the skater by rearward extension of the skater's leg and pointing the toe towards the skating surface, thus serving to check the skater's speed and possibly arrest the skater's forward movement. In addition, when the front brake pad 29 is dragged upon a skating surface that side of the skater can be slowed relative to the other, thereby causing the skater's body to rotate and turn in the direction of the dragged wheeled skate. This provides a simple means of simultaneously braking and turning without the need for more dramatic maneuvering.

Figures 3, 4:
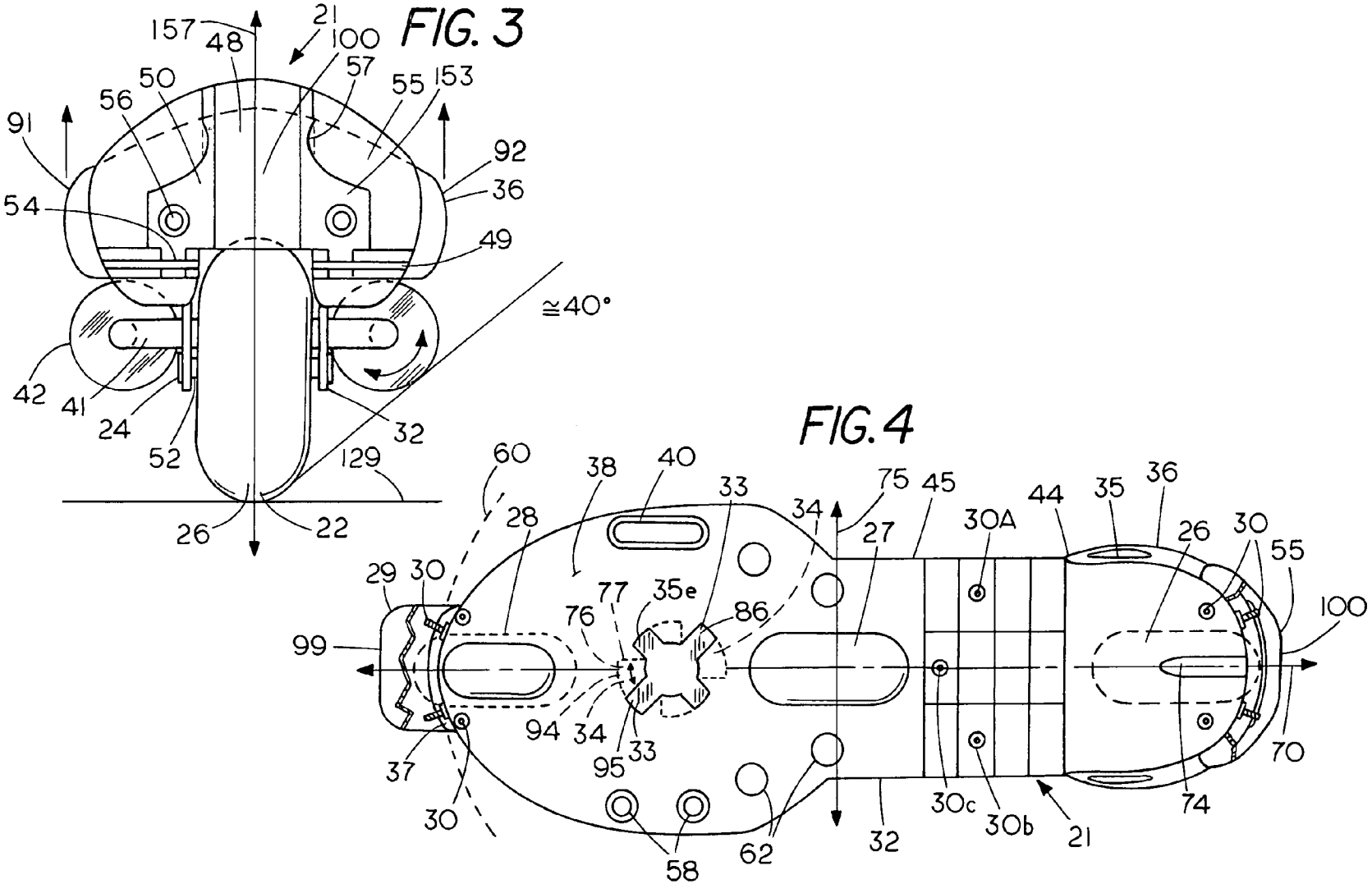
FIG. 3 is a rear view of a skate showing a male hinged rearfoot retainer for securing the rearfoot of an article of footwear to the skate, but also the presence of cylindrical brake pads on either side of the chassis of the skate.
FIG. 4 is a top plan view of a skate having symmetric configuration for use on either the left or right foot with parts broken away.

An oval brake pad 39 is shown secured in position upon oval brake pad retainer 40 mounted in an anterior position upon the chassis 32 of the wheeled skate 21. Oval brake pad 39 is capable of rotation substantially parallel with the longitudinal axis 70 of the wheeled skate 21. In this regard, the longitudinal axis 70 of a wheeled skate 21 is shown in FIG. 4. Oval brake pad 39 can be engaged by inclining the wheeled skate 21 from the vertical axis 157, as when the skater would choose to use the snow-plow braking technique, that is, simultaneously inverting, pronating, and adducting the foot. The ability of the oval brake pad 39 to rotate generally parallel with respect to the longitudinal axis 70 of the wheeled skate 21 makes it most suitable for the performance of the snow-plow braking technique, in particular, when the oval brake pad 39 is mounted in an anterior position. Alternatively, oval brake pad 39 can also be used in the performance of the hockey-stop braking technique in which the skater turns both skates sideways and into the direction of the forward movement while braking with the anterior portion of the skate and then sweeping the posterior portion of the skate about as to complete the braking maneuver facing generally sideways with respect to the initial forward line of movement.

The ability of the oval brake pad 39 to rotate enables the wear surface to be constantly renewed and decreases the rate at which the material is abraded. Further, this characteristic provides a source of friction dampening and can contribute to exhibited braking power. In addition, the ability of the oval brake pad 39 to yield and rotate reduces the magnitude of the shock load imparted to the wheeled skate upon initial braking and de-acceleration, thereby contributing to the skater's ability to maintain balance and stability while braking and maneuvering. The proximity of oval brake pad 39 to the center of the skater's downward line of force and moment, and the skater's anatomical stabilizing structures with respect to inversion and eversion of the foot, contributes to the braking power which can be developed while still affording the skater balance, stability and control during braking and maneuvering.

A cylindrical brake pad 42 is shown secured in position upon cylindrical brake pad retainer 41 mounted in a posterior position upon the chassis 32 of the wheeled skate 21. Cylindrical brake pad 42 is capable of rotation substantially transversely with respect to the longitudinal axis 70 of the wheeled skate 21. In this regard, the perpendicular orientation of the transverse axis 75 with respect to the longitudinal axis 71 is shown in FIG. 4. Cylindrical brake pad 42 can be engaged by inclining the wheeled skate 21 from the vertical axis 157, as when the skater would choose to use the snow-plow braking technique, that is, simultaneously inverting, pronating, and adducting the foot. Alternatively, cylindrical brake pad 42 can be used in the performance of the hockey-stop braking technique in which the skater turns both skates sideways and towards the direction of the forward movement while braking with the anterior portion of the wheeled skate 21, then sweeping the posterior portion of the wheeled skate 21 about as to complete the braking maneuver facing generally sideways with respect to the initial line of movement. The ability of the cylindrical brake pad 42 to rotate generally transversely with respect to the longitudinal axis 70 of the wheeled skate 21 makes it most suitable for performance of the hockey-stop braking technique, in particular, when the cylindrical brake pad 42 is mounted in a posterior position upon the wheeled skate 21. The ability of the cylindrical brake pad 42 to rotate enables the wear surface to be constantly renewed and decreases the rate at which the material is abraded. Further, this characteristic provides a source of friction dampening and can contribute to exhibited braking power. In addition, the ability of the cylindrical brake pad 42 to yield and rotate reduces the magnitude of the shock load imparted to the skate upon initial braking and de-acceleration, thereby contributing to the skater's ability to maintain balance and stability during braking and maneuvering. The proximity of cylindrical brake pad 42 to the center of the skater's downward line of force and moment, and the skater's anatomical stabilizing structures with respect to inversion and eversion of the foot, contributes to the braking power which can be developed while still affording the skater balance, stability and control during braking and maneuvering.

The rocker adjustment device 25 is shown in position with respect to the middle wheel 27 of the wheeled skate 21. Details concerning the structure and function of rocker adjustment device 25 are discussed in connection with discussion of FIGS. 11 and 12.

The rear bumper 55 projects rearward beyond the posterior of the chassis 32 of the wheeled skate 21 and rear wheel 26, and can thereby serve to attenuate impact of the posterior of the wheeled skate 21 with an object, thus protecting the wheeled skate 21, article of footwear 20 and skater from damage or possible injury.

As shown, a male rearfoot retainer 153 including a male hinged rearfoot retainer 50 can rotate about hinge pin 49 thereby moving from a closed to an open position, and vice-versa. Rotation to an open position disengages the projections 56 on male hinged rearfoot retainer 50 from openings in rearfoot retainer flange 36 and female rearfoot retainer 51 in the sole 47 of the article of footwear 20, thereby releasing the rearfoot 102 of the article of footwear 20 from the wheeled skate 21. Rotation to a closed position engages the projections 56 on male hinged rearfoot retainer 50 with openings in rearfoot retainer flange 36 and female rearfoot retainer 51 in the sole 47 of the article of footwear 20, thereby securing the rearfoot 102 of the article of footwear 20 to the wheeled skate 21. A loop 48 for grasping with one or more fingers can be provided on male hinged rearfoot retainer 50. The loop 48 can be made of a natural or synthetic textile such as polyester or nylon, a natural or synthetic rubber material, a thermoplastic material, or hybrid combinations thereof. From the standpoint of biomechanical efficiency and ease of operation, the upwards motion required to close the male hinged rearfoot retainer 50 and thereby secure the article of footwear 20 to the wheeled skate 21, and the downwards motion required to open the male hinged rearfoot retainer 50 and release the article of footwear 20 from the wheeled skate 21, are believed to facilitate performance of the intended actions. However, other configurations, devices, and mechanisms can be used, such as loop and latch means similar to that disclosed in U.S. Pat. No. 5,068,984 to Kaufman et al., hereby incorporated by reference herein.

The article of footwear 20 includes a footwear portion of locking mechanism assembly 95, forefoot 101, rearfoot 102, female rearfoot retainer 51, upper 46, and sole 47. The preferred upper 46 as shown is low cut. However, it is also possible for mid and high cut articles of footwear 20 to be used in the present invention, as desired. Generally, mid and high cut articles of footwear will provide greater support to the skater's ankle. This could be advantageous if and when larger wheels and/or a wheeled skate geometry that entails higher elevation of a skater's foot is contemplated. It is also possible for a removably attachable generally vertical brace and ankle cuff to be used with a wheeled skate (not shown). However, well-conditioned skaters with no anatomical impairment will generally desire to use a low cut article of footwear given the wheeled skate geometry and size wheel shown in FIG. 1. In this regard, the original drawing from which FIG. 1 was derived was drawn to approximate 1/1 scale for a size 11 male and included 60 mm diameter wheels.

Strap 61, which is anchored at opening 35 can be synergistically used in cooperation with other mating or securing structures included in the footwear upper 46, such as VELCRO® hoop and pile means, loops or openings, the closure system of the article of footwear such as laces, straps, buckles, and the like. Further, strap 61 can be affixed in relation to rearfoot retainer flange 36 or the chassis 32 of the skate by other mechanical or bonding means known in the art. In addition, a plurality of other straps could be used into order to further secure the article of footwear to the skate. For example, an additional strap could be used in the forefoot 101 proximate the ball of the foot and metatarsal-phalangeal joints.

The sole 47 includes female rearfoot retainer 51 for securing the rearfoot 102 of the article of footwear 20 in relation to the rearfoot retainer flange 36 and chassis 32 of the wheeled skate 21. The sole 47 also includes the footwear portion of locking mechanism assembly 95 for removably securing in functional relation to the skate portion of the locking mechanism assembly 94 affixed to the chassis 32 of the wheeled skate 21. Preferably, the footwear portion of locking mechanism assembly 95 and the skate portion of locking mechanism assembly 94 are configured and positioned so at to underlay the skater's forefoot 101, and in particular, the area proximate the ball of the foot. Various alternate mechanisms and means for securing the forefoot 101 and rearfoot 102 of the article of footwear 20 in functional relation to the wheeled skate 21 can be used.

The sole 47 of the article of footwear 20 can consist of a midsole and outsole, or simply an outsole. The sole of some bicycling shoes consist of an outsole made of rigid injection molded thermoplastic material including glass or carbon fiber that will not substantially flex or deflect when subjected to the loads encountered during cycling. This simple construction can provide a functional article of footwear for bicycling and possibly for skating, but such articles of footwear are generally not well suited for the role of walking or running.

However, the sole of other bicycling shoes consist of an outsole made of a resilient natural or synthetic rubber material, a thermoplastic material, or a hybrid combination thereof. And some bicycling shoes further provide a midsole consisting of relatively soft foam material, or other cushioning means which are suitable for walking and running. The sole of such bicycling shoes can consist of a more complex multi-part construction which can include a resilient outsole, a relatively soft midsole, but also a moderator plate. The moderator plate can consist of a resilient material which is capable of flexing and recovering, thus acting as a spring. The moderator plate can be made of a thermoplastic material which can include fillers such as glass or carbon fiber, a glass or carbon fiber composite material, or a metal material such as spring steel, stainless steel, aluminum, titanium, and the like. Wood has also been used in prior art bicycling shoes. This more complex sole construction can provide greater versatility since the resulting article of footwear can be used for cycling and skating, and can be better suited for walking or running on man-made or natural surfaces. When the article of footwear is intended to be suitable for running activity, it can be advantageous to include means for permitting flexion of the metatarsal-phalangeal joints of the foot.

Figure 34:
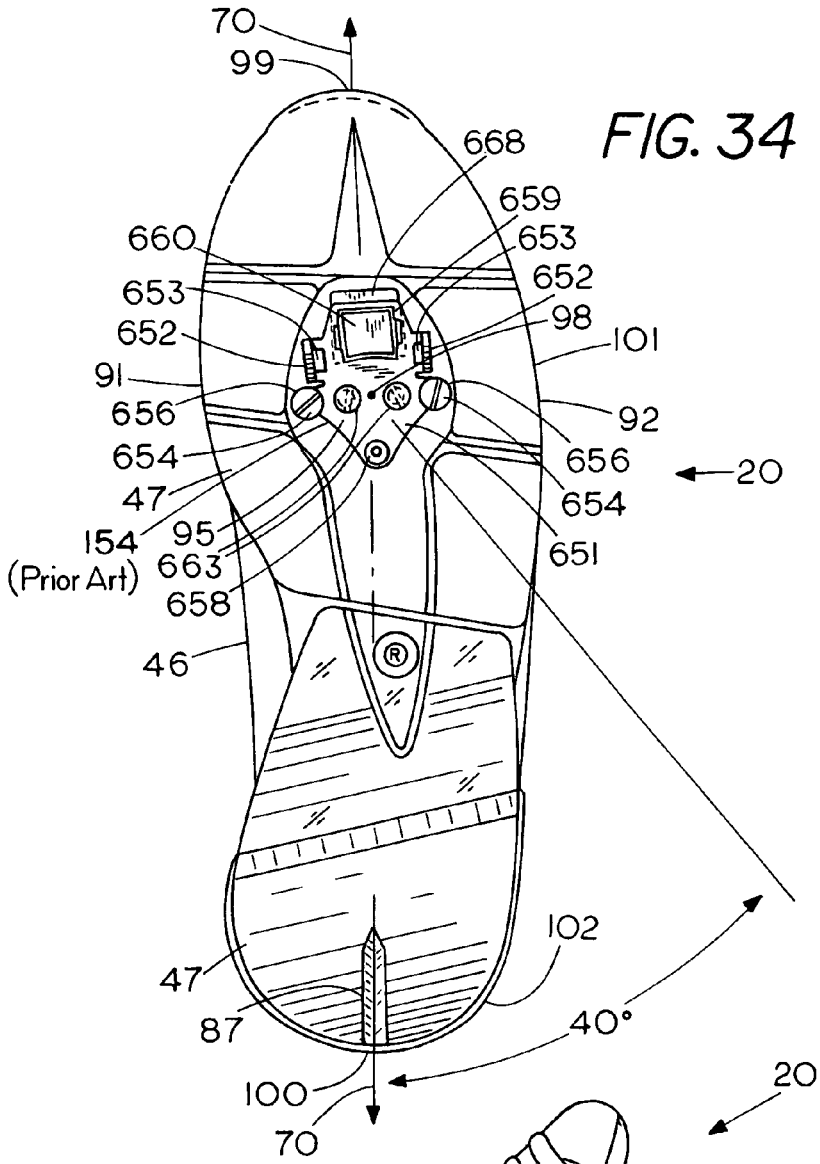
FIG. 34 is a bottom plan view of the article of footwear shown in FIG. 33, including a bicycle cleat portion of bicycle cleat locking apparatus.

The use of a resilient moderator plate within a more complex sole construction can be particularly advantageous as such can serve to stabilize the article of footwear and effect optimal transfer of the forces and loads associated with skating and bicycling. The footwear portion of locking mechanism assembly can be secured to a moderator plate component that is included within a more complex sole construction, thus enabling the forefoot of the article of footwear to be removably secured to a wheeled skate. As discussed in greater detail below in connection with FIGS. 33 and 34, the preferred article of footwear 20 for use with the present invention is taught by the applicant in U.S. Pat. No. 6,449,878. The sole 47 of the article of footwear 20 can also include one or more female apertures 87 for accommodating one or more male vertical stabilizers 74 associated with the wheeled skate 21, as shown in FIGS. 4 and 34.

It is anticipated that the present invention will enable and give rise to a new form of triathlon sports competition in which the contestants will wear the same article of footwear during the biking, skating, and running phases of the competition. Other forms of sports competition that would include biking and skating are also anticipated. For example, more complex sport competitions that would include biking, skating, running, and swimming, or perhaps a different skill sport are envisioned.

Figure 2:
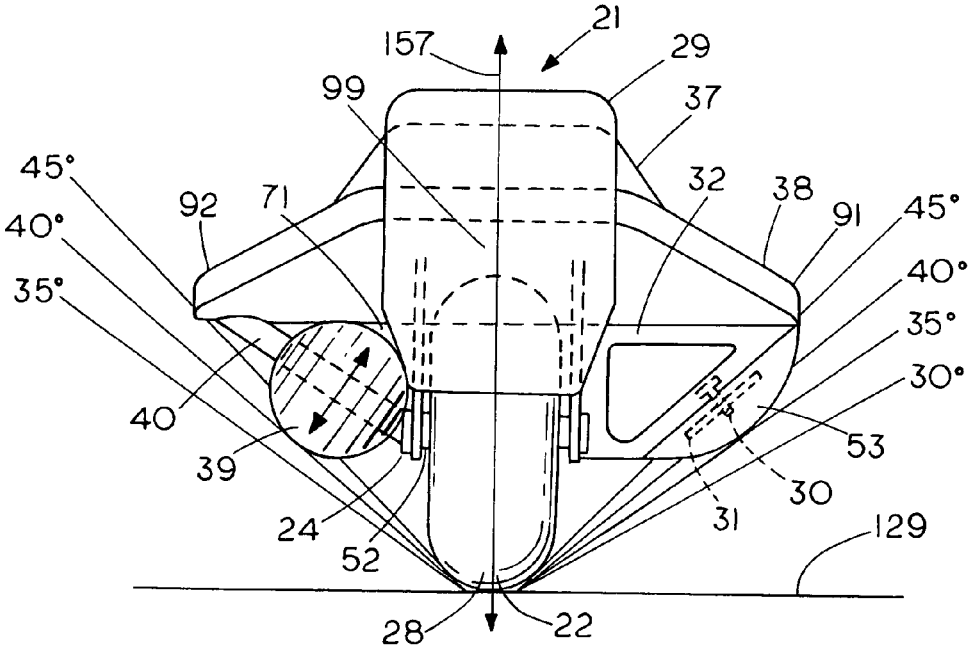
FIG. 2 is a front view of a skate showing a front brake pad, but also the presence of alternate brake pads on either side of the chassis of the skate.

FIG. 2 is a front view of a wheeled skate 21 showing a front brake pad 29, toe retainer flange 37, platform 38, chassis 32, front wheel 28, wheel spacers 52, axle 24, bolt 30, retainer 31, renewable wear surface 71, stationary brake pad 53, and an oval brake pad 39 secured by oval brake pad retainer 40. The alternative use and presence of a spherical brake pad 59 would appear similar to the oval brake pad 39 that is shown, that is, when seen from this frontal view. The representation of a stationary brake pad 53 and different chassis 32 structure on the right side of FIG. 2 relative to the oval brake pad 39 secured by oval brake pad retainer 40 on the left side merely serves an illustrative purpose, although it is possible that different brake pad devices and configurations could be selected for use on different sides of a wheeled skate 21. Generally, either a spherical brake pad 59, oval brake pad 39, cylindrical brake pad 42 or stationary brake pad 53 configuration will be used on both sides of a wheeled skate 21 at the same anterior, middle, or posterior portions. The same brake pad configuration can be used in more than one position, and various brake pad devices and configurations can be used in various combinations.

Also illustrated in FIG. 2 are angular degrees indicating the amount of inclination from the vertical axis 157 that would be required in order to bring the alternate brake pad configurations to bear upon the skating support surface 129. On the left side, oval brake pad 39 would become engaged when the skate is inclined approximately 40 degrees, and on the right side, stationary brake pad 53 would become engaged when the skate is inclined at approximately 35 degrees from the vertical axis 157.

It can be readily understood that the number of angular degrees to which a wheeled skate 21 would need to be inclined from the vertical axis 157 to engage a given brake pad configuration can be engineered by selections made regarding the geometry of the skate chassis, the selection of wheel size and shape, the selection of the type of brake pad configuration to be used, the size and shape of the particular brake pad selected, and the geometry and configuration of the particular brake pad retainer. Generally, skaters will desire to engage a skate brake in the range between 25 and 45 angular degrees of inclination, as a wheeled skate capable of less than 25 degrees can have limited maneuverability, and a wheeled skate capable of greater than 45 degrees can risk the loss of holding power with respect to the skating surface.

However, it can be readily understood that the presence of various brake pad configurations on the sides of a wheeled skate 21, such as a spherical brake pad 59, oval brake pad 39, cylindrical brake pad 42, or stationary brake pad 53, can serve to stabilize a wheeled skate 21 when the brake pad is engaged upon the skating support surface 129, as the skater's base of support is then dramatically increased. Accordingly, a skater is then better able to balance and to apply greater downward braking force than would otherwise be possible or prudent.

Moreover, when spherical brake pads 59, cylindrical brake pads 42, or oval brake pads 39 are being used, it should be recognized that when these brake pads are brought into contact with the skating support surface 129 and loaded with sufficient force, the resilient natural or synthetic rubber, thermoplastic material, or hybrid combination thereof, that constitutes the brake pad material can undergo deformation. Generally, the brake pad material will be caused to displace and bulge in a direction opposite that of the load imparted via contact with the skating support surface 129, thus the surface area and/or loads imparted by the brake pad upon the brake pad retainer, and the renewable wear surface 71 or chassis 22 upon which the brake pad bears can be substantially increased. In the case of an oval brake pad 39 configuration, it should be recognized that the oval brake pad retainer 40 can serve to shield the superior side of the oval brake pad 39 from loads generated by contact with the support surface 129 and can thereby potentially lessen the amount of deformation that superior portions of the oval brake pad 39 will experience. For this reason, it can be advantageous to limit the length of the oval brake pad 39 and corresponding oval brake pad retainer 40 in order to optimize effective braking power.

Figure 5:
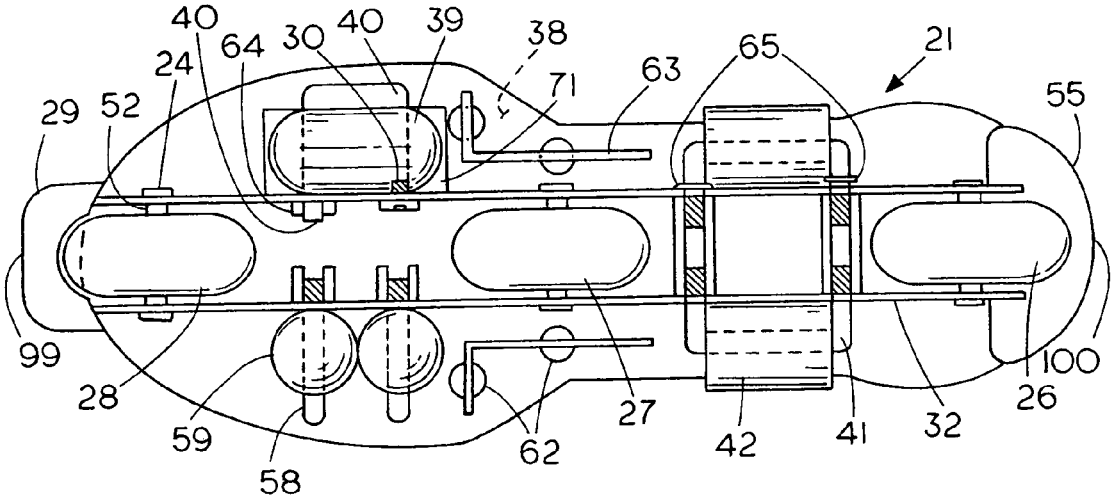
FIG. 5 is a bottom plan view of a skate having symmetric configuration for use on either the left or right foot.
Figure 27:
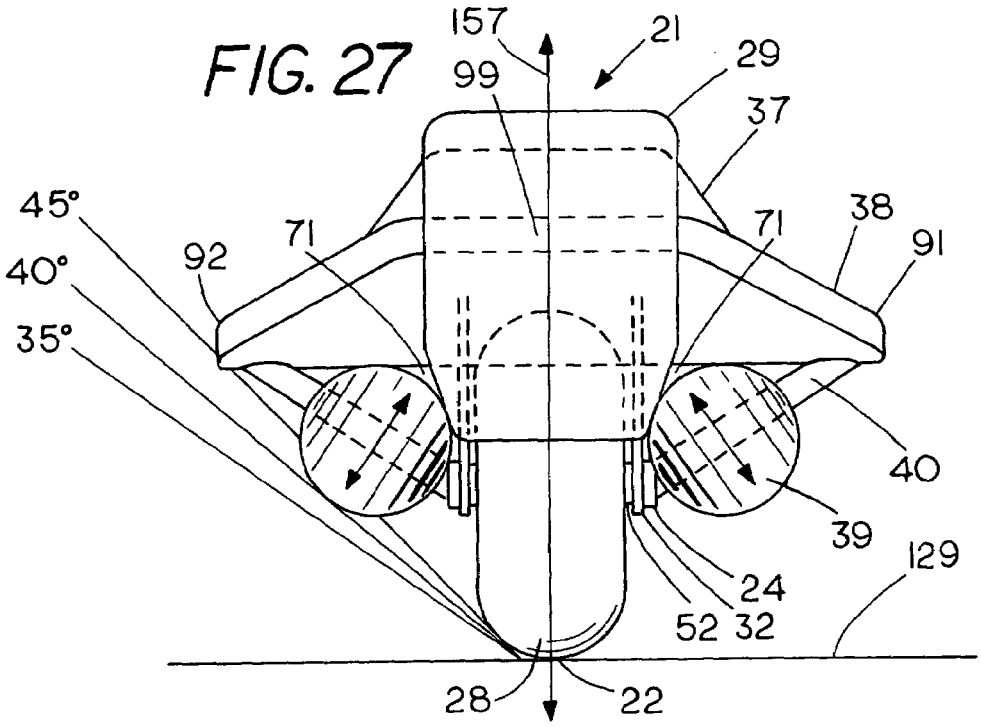
FIG. 27 is a front view of the wheeled skate shown in FIG. 26 with the article of footwear removed.
Figure 28:
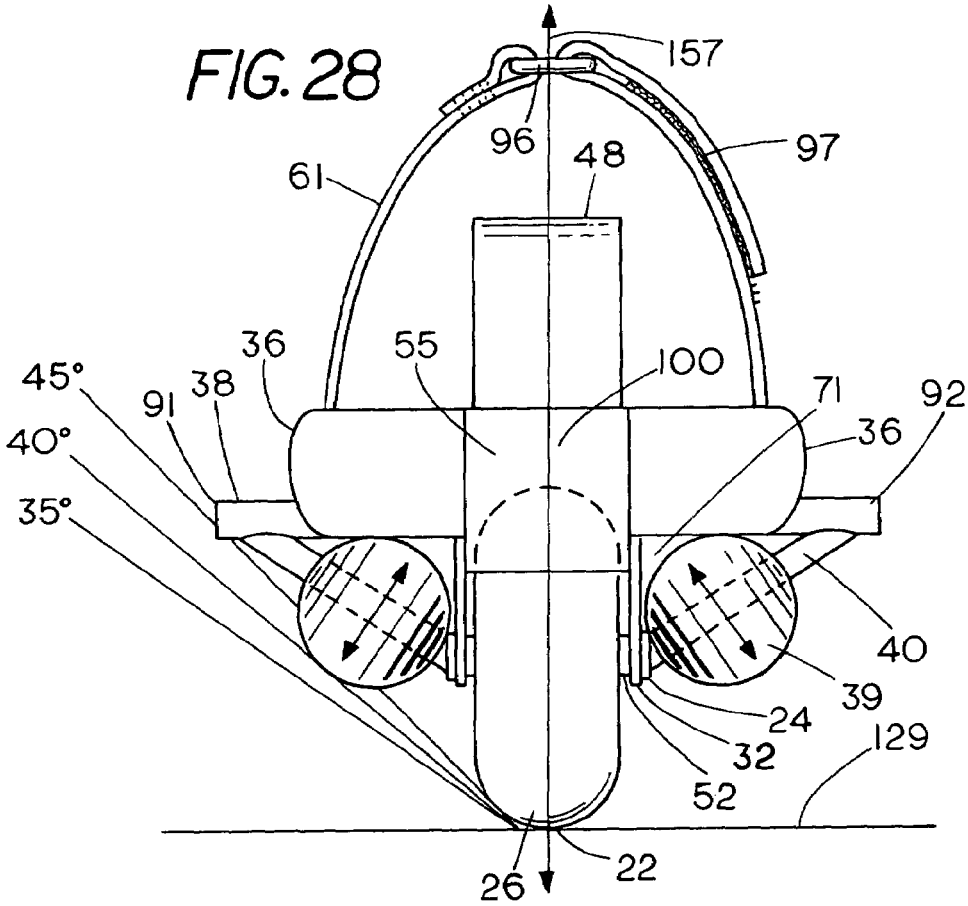
FIG. 28 is a rear view of the wheeled skate shown in FIGS. 26 and 27 with the article of footwear removed.

The optional use of a renewable wear surface 71 for oval brake pad 39 is shown in FIGS. 2 and 5. It can be advantageous to include a renewable wear surface 71 in order to lessen wear and abrasion with respect to the chassis 32 of the wheeled skate 21. In addition, the selected composition and shape of the renewable wear surface 71 can influence the static and dynamic coefficients of friction, and the effective braking surface area and braking power which can be demonstrated. For example, as shown in FIGS. 27 and 28, the use of a renewable wear surface 71 that compliments the shape of the brake pad being used can serve to increase braking power.

FIG. 3 is a rear view of a wheeled skate 21 showing rearfoot retainer flange 36, rear bumper 55, loop 48, rear wheel 26, wheel spacers 52, axle 24, cylindrical brake pad retainers 41, cylindrical brake pads 42, hinge pin 49, hinge 54, and a male rearfoot retainer 153 consisting of a male hinged rearfoot retainer 50 including projections 56. Male hinged rearfoot retainer 50 is shown in the closed position and can be held in such position by snap locks 57. Cylindrical brake pads 42 are capable of rotating transversely with respect to the longitudinal axis 70 of the wheeled skate 21. The size and configuration of cylindrical brake pads 42, as well as that of cylindrical brake pad retainers 41 can be varied, as desired, so as to adjust both the quality of braking power and the degree to which the wheeled skate 21 needs to be inclined from the vertical axis 157 in order to engage the cylindrical brake pads 42 with the skating surface. As shown, the cylindrical brake pad 42 will become engaged with the skating surface when the wheeled skate 21 is inclined approximately 40 degrees from the vertical axis 157. Cylindrical brake pad retainers 41 can optionally include a vertical brace 43 (not shown) which can place the cylindrical brake pad retainers 41 in communication with the bottom of the platform 38 or other supporting portion of the chassis 32 of the wheeled skate 21.

FIG. 4 is a top plan view of a wheeled skate 21 having symmetric configuration for use on either the left or right foot. Parts of the toe retainer flange 37, front brake pad 29, and the rearfoot retainer flange 36 are broken away to show retainers 31 and bolts 30. Shown are the chassis 32, front wheel 28, middle wheel 27, and rear wheel 26, rearfoot retainer flange 36, toe retainer flange 37, rear bumper 55, front brake pad 29, anterior chassis portion 45, posterior chassis portion 44, and bolts 30 for retaining various component parts. Also shown are bolts 30*a*, 30*b*, and 30*c* for optionally adjusting the length of the chassis 32 of the wheeled skate 21. The superior portion of several tool retainers 62, an oval brake pad retainer 40, and spherical brake pad retainers 58 are shown engaged with the platform 38 of the wheeled skate 21. Also shown for reference purposes is the longitudinal axis 70 and also the transverse axis 75 of the wheeled skate 21.

Shown in FIG. 4 is the approximate position of the footwear portion of locking mechanism assembly 95 which is normally affixed to the forefoot 101 of the sole 47 of an article of footwear 20 (not shown), as the footwear portion of locking mechanism assembly 95 is initially inserted into opening 35*e* which is associated with the skate portion of locking mechanism assembly 94. In this embodiment, the footwear portion of locking mechanism assembly 95 can be characterized as being the male portion 33, and the skate portion of locking mechanism assembly 94 can be characterized as being the female portion 34, and when properly mechanically engaged they together form locking mechanism assembly 105. Also shown in phantom are portions of the female portion 34 including recess 76 and stop 77. The locking mechanism assembly 105 consisting of the footwear portion of locking mechanism assembly 95 and the skate portion of locking mechanism assembly 94 is positioned and configured so as to underlay the skater's forefoot, and is preferably located proximate the ball of the skater's foot. The footwear portion of locking mechanism assembly 95 and the skate portion of locking mechanism assembly 94 are compatible and can be engaged to firmly secure an article of footwear 20 to a wheeled skate 21. The footwear portion of locking mechanism assembly 95 and the skate portion of locking mechanism assembly 94 forming the locking mechanism assembly 105 can consist or be generally similar to bicycle cleat and pedal locking mechanisms or apparatus, such as the SPD system made by Shimano, Inc., or alternatively, those bicycle cleat and pedal locking mechanisms or apparatus made by Look, S. A., or Speedplay, Inc., as taught in the numerous U.S. patents previously recited and incorporated by reference herein, or other bicycle cleat and pedal locking mechanisms or apparatus which are known in the art, and the like.

An advantageous feature of the SPD system made by Shimano, Inc., and the like, is that the footwear portion of locking mechanism assembly 95 which is affixed to the forefoot 101 of the sole 47 of an article of footwear 20 can be engaged and secured by the skate portion of locking mechanism assembly 94 by insertion therein with a simple downward application of force. Thereafter, the footwear portion of locking mechanism assembly 95 cannot be disengaged by an upwards, anterior, posterior, or transverse application of force, rather only by clockwise or counter-clockwise rotation of the footwear portion of locking mechanism assembly 95 relative to the skate portion of locking mechanism assembly 94. A skater can then don an article of footwear 20 including the footwear portion of locking mechanism assembly 95 and simply step into the skate portion of locking mechanism assembly 94 which is affixed in functional relation to the chassis 32 of the wheeled skate 21.

An advantageous feature of the Look, S. A. bicycle cleat and pedal locking mechanism or apparatus, and the like, is that the structure of the associated apparatus is simpler in design, and easier to use with a wheeled skate than the SPD system taught by Shimano, Inc. However, a wearer is normally not able to walk or run well on an article of footwear including the structure associated with the apparatus made by Look, S. A.

An advantageous feature of the bicycle cleat and pedal locking mechanism or apparatus made by Speedplay, Inc., as taught in U.S. Pat. No. 5,546,829 and other previously recited patents, is that the bicycle cleat and pedal locking mechanisms are robust, smaller, and less expensive to make than those devices made by Shimano, Inc., or Look, S. A. In particular, the relatively small size and low profile of the bicycle cleat and pedal locking mechanism or apparatus made by Speedplay, Inc. can facilitate providing an article of footwear for a wearer that is suitable for walking and running, as well as bicycling and skating.

In a preferred embodiment of the wheeled skate 21, the skater's heel can be retained in position by rearfoot retainer flange 36 and strap 61, and also by the coupling of a male rearfoot retainer 153, e.g., a male hinged rearfoot retainer 50, male snap-fit rearfoot retainer 66, male clip rearfoot retainer 67, male threaded rearfoot retainer 68, male rearfoot push button retainer 112, and also male vertical stabilizer 74 mating with a female rearfoot retainer 51, aperture 87, and the like. Since the skater's heel and rearfoot 102 is held firmly in position, the article of footwear 20 cannot rotate so as to disengage the footwear portion of locking mechanism assembly 95 from the skate portion of locking mechanism assembly 94 which are preferably positioned under and proximate the area corresponding to the ball of the wearer's foot. However, by releasing strap 61 and disengaging the male rearfoot retainer 153 from the female rearfoot retainer 51, the skater can raise the rearfoot 102 of the article of footwear 20 so as to disengage it from the male vertical stabilizer 74 and rearfoot retainer flange 36. For example, as shown in FIGS. 1 and 3, this can be accomplished by opening and thereby releasing the male hinged rearfoot retainer 50 from the female rearfoot retainer 51. The skater can then rotate the article of footwear 20 including the footwear portion of locking mechanism assembly 95 relative to the skate portion of locking mechanism assembly 94 and wheeled skate 21, or vice versa, thereby releasing the article of footwear 20 from the wheeled skate 21.

It should be noted that some of the bicycle cleat and pedal locking mechanisms or apparatus used in cycling have either incorporated in their design tolerances, or alternatively, have adjustable means of controlling how many degrees of clockwise or counter-clockwise rotation will be permitted by the bicycle cleat and pedal locking mechanism. For example, Look, S. A. manufactures a pedal that is adjustable to permit only approximately 3 degrees of rotation, and both Look, S. A. and Shiniano Inc. manufacture bicycle cleats and pedals having different configurations which permit varying amounts of rotation. Generally, cyclists require approximately 10 degrees of rotation in order to accommodate the normal amount of pronation and tibial rotation which occurs during the cycling movement, as when this is not provided cyclists can become injured.

However, this requirement for accommodating pronation, and rotation of the foot and tibia is not present in a wheeled skating application, thus tighter tolerances and/or adjustment to approximately zero degrees of rotation can be advantageous with respect to the footwear portion of locking mechanism assembly 95 and skate portion of locking mechanism assembly 94 which form a locking mechanism assembly 105 suitable for use in a wheeled skate. Further, higher side loads can be placed upon the locking mechanism assembly during skating relative to bicycling, in particular, when a skater uses the side stroke skating technique. For this reason, it can sometimes be advantageous for the configuration and robustness of the locking mechanism assembly to be modified relative to the normal structure used in bicycling in order to enhance the performance, quality, and durability of the locking mechanism assembly for this activity.

Figure 23:
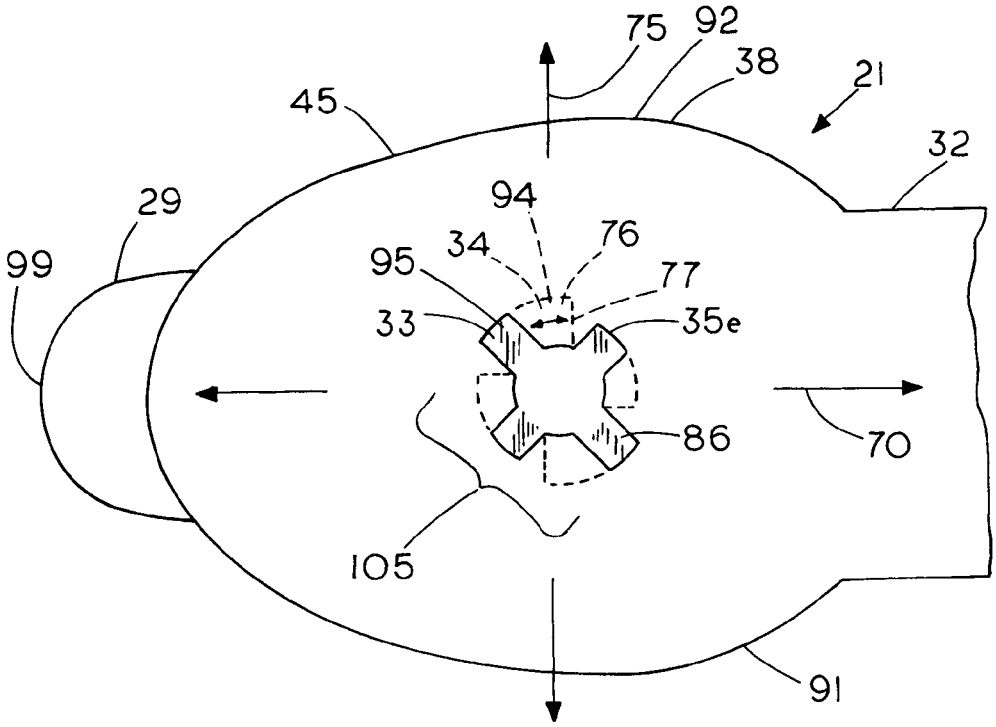
FIG. 23 is a top plan view showing a part of a footwear portion of locking mechanism assembly that is inserted but not yet rotated in functional relation to a compatible skate portion of locking mechanism assembly for removably securing an article of footwear and a wheeled skate.

In particular, some bicycle cleat and pedal locking mechanisms position the point of contact and load transfer proximate the anterior and posterior portions of the locking mechanism. With regards to a wheeled skate, it can be more advantageous to change this point of contact and load transfer such it takes place closer to the medial and lateral sides of a wheeled skate, that is, to effectively rotate the possible orientation of a bicycle cleat and locking mechanism by 90 degrees from the longitudinal axis 70 along the transverse plane so that it is then orientated generally consistent with the transverse axis 75. It can also be advantageous to retain the existing points of contact and load transfer provided by some bicycling cleat and pedal locking mechanisms, but to augment these by the further introduction of side and/or other multiple points of contact and load transfer. Accordingly, the configurations including two or three points of contact and loading which are found in some existing bicycle cleat and pedal locking mechanisms can sometimes be enhanced for use with wheeled skates by creating four or more points of contact and loading. FIG. 23 shows one possible embodiment of a footwear portion of locking mechanism assembly 95 and a skate portion of locking mechanism assembly 94 which when properly mechanically engaged form locking mechanism assembly 105 for use with a wheeled skate 21.

Figure 30:
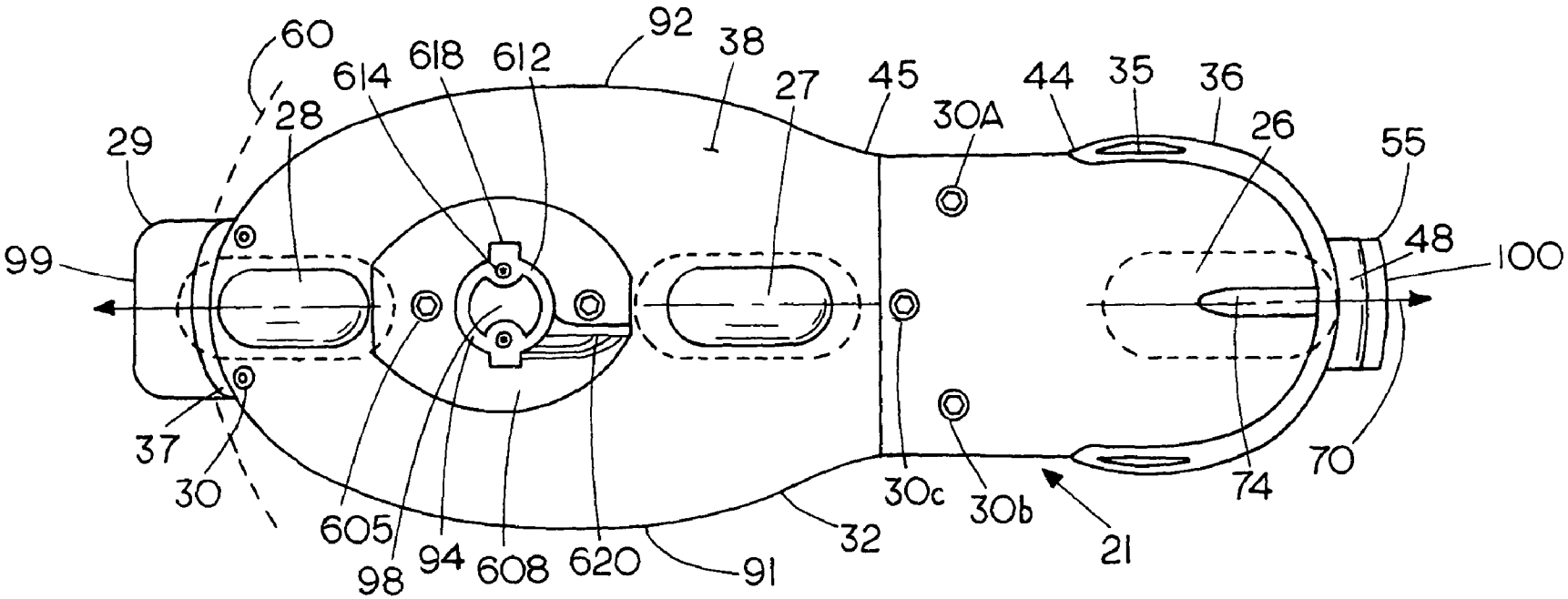
FIG. 30 is a top plan view of the wheeled skate shown in FIGS. 26, 27, 28, and 29 with the article of footwear removed.

In the alternate embodiment shown in FIG. 23, an article of footwear 20 including a footwear portion of locking mechanism assembly 95 can be secured to a wheeled skate 21 by inserting and rotating the footwear portion of locking mechanism assembly 95 in functional relation to the skate portion of locking mechanism assembly 94, and released when desired by counter-rotating and withdrawing the article of footwear 20 including the footwear portion of locking mechanism assembly 95. Alternatively, a footwear portion of locking mechanism assembly 95 consisting of a bicycle cleat portion of bicycle cleat locking apparatus 154 which is identical or similar to that taught in U.S. Pat. No. 5,546,829 assigned to Speedplay Inc., as shown in FIG. 34, can be used in conjunction with a compatible skate portion of locking mechanism assembly 94, as shown in FIG. 30. It can be readily understood that in various alternate embodiments of the invention, the footwear portion of locking mechanism assembly 95 can be characterized as the male portion 33, and the skate portion of locking mechanism assembly 94 can be characterized as the female portion 34, or vice versa. Moreover, it can be readily understood that the footwear portion of locking mechanism assembly 95 and the skate portion of locking mechanism assembly 94 which together form the locking mechanism assembly 105 can be hermaphroditic, that is, each respective portion can include both male and female characteristics.

Figure 24:
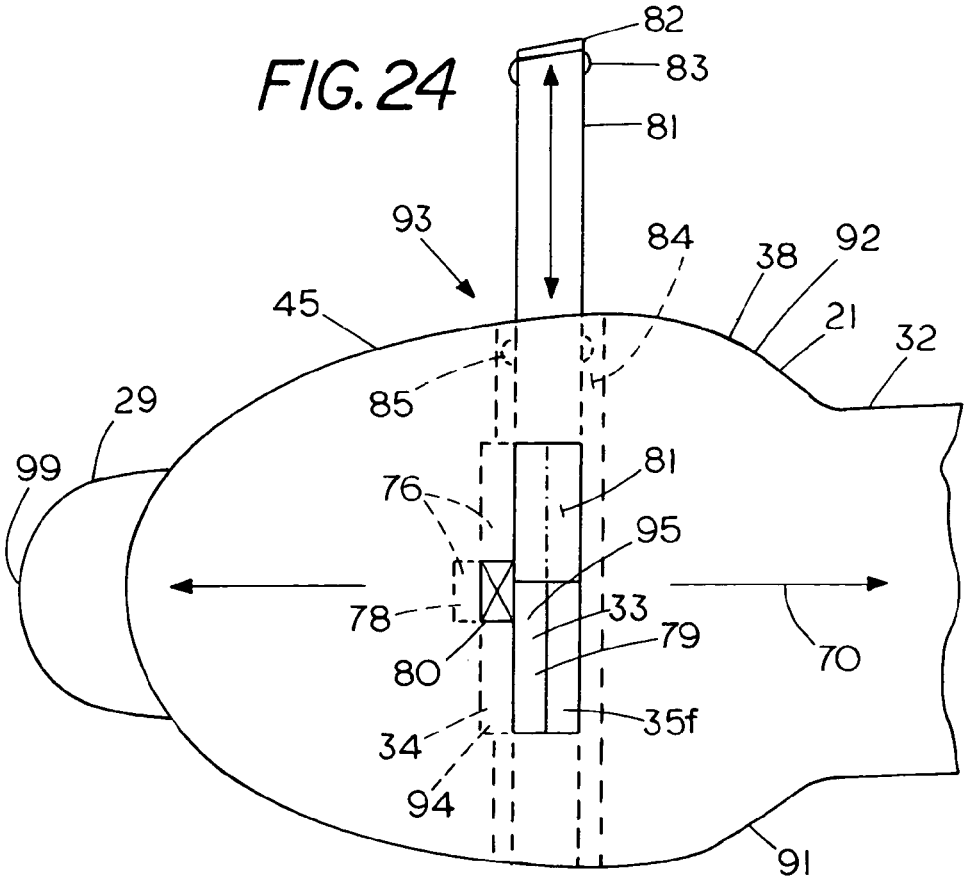
FIG. 24 is a top plan view showing a part of an alternate footwear portion of locking mechanism assembly that is inserted in functional relation to a compatible skate portion of locking mechanism assembly that includes a manually actuated locking device for removably securing an article of footwear and a wheeled skate.

In an alternate embodiment as shown in FIG. 24, an article of footwear 20 including the footwear portion of locking mechanism assembly 95 can be secured to a wheeled skate 21 by placing the footwear portion of locking mechanism assembly 95 in functional relation to the skate portion of locking mechanism assembly 94. A locking device 93 associated with the skate portion of locking mechanism assembly 94 can then be manually actuated to secure the article of footwear 20 including the footwear portion of locking mechanism assembly 95 to the wheeled skate 21. The locking device 93 associated with the skate portion of locking mechanism assembly 94 can later be de-actuated when desired to release the article of footwear 20 including the footwear portion of locking mechanism assembly 95.

FIG. 5 is a bottom plan view of a wheeled skate 21 having symmetric configuration for use on either the left or right foot. Shown are the chassis 32, front wheel 28, middle wheel 27, rear wheel 26, axles 24, wheel spacers 52, rear bumper 55, front brake pad 29, renewable wear surface 71, tool retainers 62, and tools 63. The tool retainers can be made of resilient natural or synthetic rubber, a thermoplastic material, or hybrid combination thereof. The tools 63 can include different working dimensions on one end of the tool 63 relative to the other, and/or the two tools 63 can consists of different working dimensions such that the skater possesses the proper tools with which to disassemble and reassemble any and all components of the wheeled skate 21. The preferred tools 63 can pass through an opening 35, and/or be snap-fit into place with respect to tool retainers 62.

Shown in an anterior position on one side of the wheeled skate 21 are spherical brake pads 59 secured by spherical brake pad retainers 58. Shown in an anterior position on the other side of the wheeled skate 21 are shown alternate oval brake pads 39 secured by oval brake pad retainers 40. Various mechanical means can be used in order to secure spherical brake pad retainers 58 or oval brake pad retainers 40. For example, shown are a nut 64, a bolt 30, and a double threaded nut 72 with parts broken away. Double threaded nut 72 can simultaneously secure opposing bolt 30 ends which project through support members of the chassis 32 into the area of the wheel well 73. Oval brake pad 39 is capable of rotating about oval brake pad retainer 40 in a direction generally parallel with the longitudinal axis 70 of the wheeled skate 21. Likewise, spherical brake pad 59 is capable of rotating about spherical brake pad retainer 58 in a direction generally parallel with the longitudinal axis 70 of the wheeled skate 21.

The coefficients of static and dynamic friction and braking power generated by the rotation of spherical brake pad 59 or oval brake pad 39 can be engineered by selection of the materials of which the pads and their corresponding retainers are made. The surface roughness and surface energy of the various mating materials can also influence the coefficients of static and dynamic friction, and exhibited braking power. The spherical brake pad 59 and oval brake pad 39 can optionally be fitted about their corresponding retainers with or without being elongated or otherwise distended as to cause the pads to be pre-stressed when secured in working position. Pre-stressing the pads can influence the exhibited coefficients of friction and braking power.

Optionally, a spherical, oval, or cylindrical brake pad can bear upon a renewable wear surface 71 which can be removably secured to the chassis 32 of a wheeled skate 21. The provision of a renewable wear surface 71 can prevent wear and possible resulting structural failure of the chassis 32 of a wheeled skate 21. Renewable wear surface 71 can provide another means of influencing the coefficients of friction and exhibited braking power, in particular, as the renewable wear surface 71 can be configured and selected so as to engage various portions of the total surface area of a brake pad.

Shown in a posterior portion of the wheeled skate 21 is a pair of cylindrical brake pads 42 secured to the chassis 32 by cylindrical brake pad retainers 41. Shown is the optional use of double threaded nuts 72 to secure the cylindrical brake pad retainers 41. Also shown on one side of the skate 21 are cylindrical brake pad retainer flanges 65 in two different configurations. In the configuration shown more anteriorly, the flange is shown butted up against the chassis 32 of the wheeled skate 21, whereas in the configuration shown more posteriorly, the flange is shown at some distance from the chassis 32 of the wheeled skate 21. As the cylindrical brake pads 39 wear their diameter will decrease. By adjusting the double threaded nuts 72 the amount of contact and possible pre-stress of the cylindrical brake pads 39 with respect to the renewable wear surface 71 or chassis 32 of the wheeled skate 21 can be selected. At some point, a cylindrical brake pad 39 can wear down such that it should be removed from service and replaced. The presence of cylindrical brake pad flange 65 can thereby serve to indicate when replacement of the cylindrical brake pad 42 is required.

Figure 6:
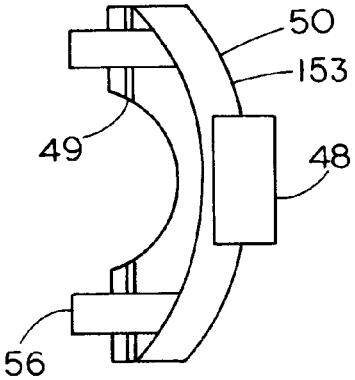
FIG. 6 is a top plan view of a male hinged rearfoot retainer for securing the rearfoot of an article of footwear to a skate.

FIG. 6 is a top view of a male rearfoot retainer 153 consisting of a male hinged rearfoot retainer 50 for securing an article of footwear 20 in function relation to a wheeled skate 21. The two projections 56 of the male hinged rearfoot retainer 50 can pass through openings 35 in the rearfoot retainer flange 36 of the wheeled skate 21 and into the female rearfoot retainer 51 located in the rearfoot 102 of an article of footwear 20. The two projections 56 of the male hinged rearfoot retainer 50 are thereby able to firmly secure both the medial and lateral sides of the rearfoot 102 of the article of footwear 20 in functional relation to the wheeled skate 21. The male hinged rearfoot retainer 50 includes hinges 54 and can pivot about hinge pins 49, and is thus capable of moving from an open position in which the projections 56 on male hinged rearfoot retainer 50 are disengaged from the openings 35 in the rearfoot retainer flange 36 of the wheeled skate 21 and the female rearfoot retainer 51 associated with an article of footwear 20, to a closed position in which the projections 56 engage the rearfoot retainer flange 36, and the female rearfoot retainer 51, thereby securing the rearfoot 102 of the article of footwear 20 to the wheeled skate 21. The approximate range of movement of the male hinged rearfoot retainer 50 is shown in FIG. 1. The male hinged rearfoot retainer 50 can be attached to loop 48 which can be further attached to the rearfoot retainer flange 36 or rear bumper 55 of the wheeled skate 21.

Figure 7:
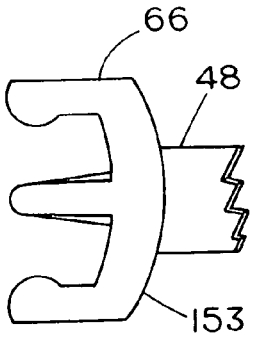
FIG. 7 is a top plan view of a male snap-fit rearfoot retainer for securing the rearfoot of an article of footwear to a skate.

FIG. 7 is a top plan view of an alternate male rearfoot retainer 153 consisting of a male snap-fit rearfoot retainer 66 for securing an article of footwear 20 in function relation to a wheeled skate 21. The three projections of the male snap-fit rearfoot retainer 66 can pass through openings 35 in the rearfoot retainer flange 36 of the wheeled skate 21 and into the female rearfoot retainer 51 associated with an article of footwear 20. The three projections 56 of the male snap-fit rearfoot retainer 66 are thereby able to firmly secure both the medial and lateral sides of the rearfoot 102 of the article of footwear 20 in functional relation to the wheeled skate 21. The male snap-fit rearfoot retainer 66 can be attached to loop 48 which can be further attached to the rearfoot retainer flange 36 or rear bumper 55 of the wheeled skate 21.

Figure 8:
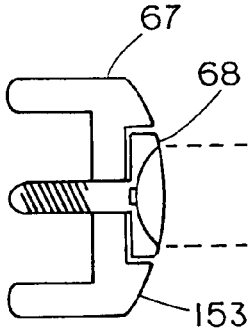
FIG. 8 is a top plan view of a male clip rearfoot retainer and male threaded rearfoot retainer for securing the rearfoot of an article of footwear to a skate.

FIG. 8 is a top plan view of an alternate male rearfoot retainer 153 consisting of a male clip rearfoot retainer 67 which can be further secured using male threaded rearfoot retainer 68. The two projections 56 of the male clip rearfoot retainer 67 can pass through openings 35 in the rearfoot retainer flange 36 of the wheeled skate 21 and into the female rearfoot retainer 51 associated with an article of footwear 20. The two projections 56 of the male clip rearfoot retainer 67 are thereby able to firmly secure both the medial and lateral sides of the rearfoot 102 of the article of footwear 20 in functional relation to the wheeled skate 21. The male threaded rearfoot retainer 68 can be tightened or loosened with the use of a tool 63 or common pieces of spare change. The male clip rearfoot retainer 67 can be attached to loop 48 which can be further attached to the rearfoot retainer flange 36 or rear bumper 55 of the wheeled skate 21.

Figure 9:
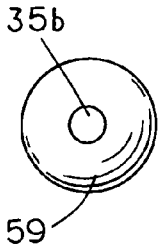
FIG. 9 is a top plan view of the spherical brake pads shown in FIG. 5.

FIG. 9 is a top plan view of the spherical brake pad 59 shown in FIG. 5. The spherical shape generally permits the spherical brake pad 59 to rotate with the greatest ease as compared with other configurations. This prevents a single area of the spherical brake pad 59 from becoming quickly abraded away. However the braking power of a spherical brake pad 59 is not normally as great as that of the oval brake pad 39 or stationary brake pad 53 configurations. When the desire for relatively undisturbed forward movement is desired during braking, as might be the case when performing artistic or trick skating maneuvers, the spherical brake pad 59 configuration can be advantageous. The spherical brake pad 59 can be used in the anterior, middle or posterior positions on a wheeled skate 21. The spherical brake pad 59 is most suitable for use when the braking loads placed upon the skate are generally longitudinal, as when skating forwards or backwards. The spherical brake pad 59 includes an opening 35*b* for accommodating the passage of spherical brake pad retainer 58. In some cases a sleeve or bearing can be advantageous for use between spherical brake pad retainer 58 and spherical brake pad 59, but the introduction of such can reduce exhibited braking power. The spherical brake pad 59 can be made of a durable natural or synthetic rubber, a thermoplastic material, or hybrid combination thereof.

Figure 10:
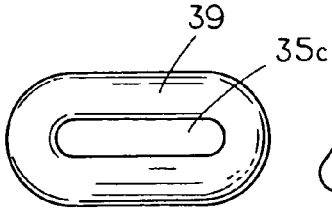
FIG. 10 is a top plan view of the oval brake pads shown in FIG. 5.

FIG. 10 is a top plan view of the oval brake pad 39 shown in FIG. 5. The oval brake pad 39 normally rotates with greater resistance relative to the spherical brake pad 59. Accordingly, the oval brake pad 39 can exhibit greater braking power than the spherical brake pad 59. The surface of the oval brake pad 39 that is placed in contact with the skating support surface 129 and the skate chassis 32 will constantly be renewed as the oval brake pad 39 is caused to rotate about oval brake pad retainer 40, thus preventing a single area of the oval brake pad 39 from becoming quickly abraded away. The oval brake pad 39 can be used in the anterior, middle or posterior positions on a wheeled skate 21. The oval brake pad 39 is most suitable for use when the braking loads placed upon the wheeled skate are generally longitudinal in direction, as when skating forwards or backwards. The oval brake pad 39 includes an opening 35*c* for accommodating the passage of oval brake pad retainer 40. In some cases, a sleeve or bearing can be advantageous for use between oval brake pad retainer 40 and oval brake pad 39, but the introduction of such can reduce braking power. As shown, the oval brake pad 39 preferably has a generally semi-spherical or rounded cross-section. Alternatively, an oval brake pad 39 could have a relatively rectangular cross section. The oval brake pad 39 can be made of a durable natural or synthetic rubber, a thermoplastics material, or hybrid combination thereof.

Figure 11:
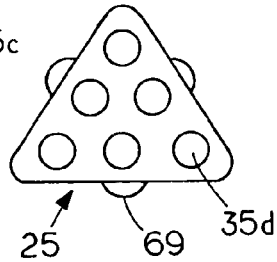
FIG. 11 is a side plan view of the triangular shaped rocker adjustment device shown in FIG. 1.

FIG. 11 is a side plan view of a triangular shaped rocker adjustment device 25 having openings 35*d* for the passage of the axle 24 of a wheel 22, and/or a bolt 30 or other retaining means which is used to secure a wheel 22, and in particular, a middle wheel 27 into position. Also shown is rocker adjustment device flange 69 which prevents the rocker adjustment device 25 from passing completely through the opening 35*a* in the chassis 32 into which rocker adjustment device 25 is inserted. The rocker adjustment device 25 can then simultaneously serve the purpose of a wheel spacer 52. When substantially thermoplastic wheel bearings are being used, the rocker adjustment device 25 can possibly simultaneously serve as a wheel bearing. The openings 35*d* in the rocker adjustment device 25 are proximate the outer edges such that the flange or head normally associated with a bolt 30 or other retaining means used to secure the wheel 22 will at least partially bear upon the chassis 32 of the wheeled skate 21 when secured. The rocker adjustment device 25 permits essentially three different vertical elevations, and five different horizontal positions to be selected. As shown, the maximum possible range of the vertical and horizontal adjustments are slightly under ½ inch or about 10 mm and fine incremental adjustments consisting of just a few millimeters are possible. This accommodates all the rocker adjustment that is normally required or desired by a skater. The rocker adjustment device 25 could alternatively be made in a different shape and geometry, and the number of openings 35*d* included therein could vary as desired. As shown in FIG. 1, the rocker adjustment device 25 is generally positioned approximately at one half of the skate's wheel base length, that is, in the middle 104 of the wheeled skate 21, although it can sometimes be advantageous to positioned the rocker adjustment device 25 slightly nearer the anterior side 99 of the wheeled skate 21.

Figure 12:
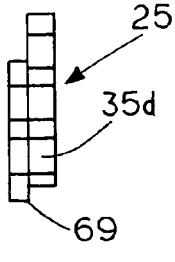
FIG. 12 is an end plan view of the triangular shaped rocker adjustment device shown in FIG. 11.

FIG. 12 is an end plan view of the rocker adjustment device 25 shown in FIG. 11. Shown are openings 35*d* for the passage of the axle 24 of a wheel 22 or the bolt 30 or other retaining means used to secure the wheel 22 into position. Also shown is the rocker adjustment device flange 69. The rocker adjustment device 25 can be positioned in functional relation to the chassis 32 by inserting the rocker adjustment device 25 into an opening 35*a* in the chassis 32 from the area of the wheel well 73, and the rocker adjustment device flange 69 can facilitate securing the rocker adjustment device 25 therein.

Figure 13:
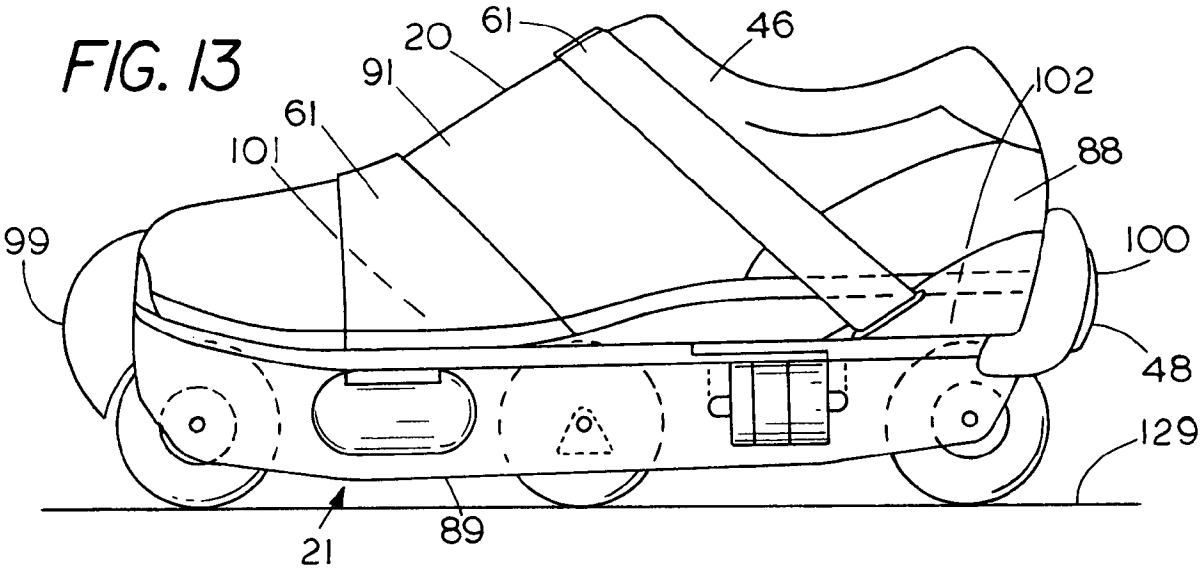
FIG. 13 is a side view of an article of footwear secured to a skate having a geometry similar to a figure skate.

FIG. 13 is a side view of an article of footwear 20 secured to an alternate wheeled skate 21 that elevates the bottom of the heel and ball of the skater's foot in a manner consistent with a figure skate. In a men's size figure skate, the elevation of the bottom of the skater's heel is generally approximately 2¾ inches, and the elevation of the bottom of the skater's ball of the foot is generally approximately between 1⅞ and 2 inches. In a men's size 11 wheeled skate 21 drawn or made to 1/1 scale, the use of 50 mm diameter wheels will provide the approximate geometry, as shown in FIG. 13. Placing the foot closer to the skating support surface 129 greatly decreases the loads placed upon the stabilizing structures of the skater's anatomy, thus can enhance balance, stability, and safety. Some sacrifice of skate speed is normally made when smaller wheels are used. Further, as the wheel size is decreased and the platform 38 of the wheeled skate 21 is brought closer to the skating surface, the maneuverability of the wheeled skate 21 can be reduced. This is due to the fact that the degree to which the wheeled skate 21 can be inclined from the vertical axis 157 before the edges of the platform 38 can be caused to touch the skating support surface 129 will be decreased. Generally, for recreational skaters and those desiring to obtain a non-impact aerobic workout, this possible loss of maneuverability associated with the wheeled skate 21 being placed at extreme inclinations from the vertical axis 157 is of little or no consequence, as recreational skaters will have no desire or need to test the extreme capability of the wheeled skate 21 in this regard. Further, it is possible that a mid or high upper 46 be desired with respect to an article of footwear 20 when the skater desires to perform artistic skating maneuvers associated with high loads. The presence of an additional anterior strap 61 for assisting in stabilizing the forefoot 101 of the article of footwear 20 in functional relation to the wheeled skate 21 is also shown in FIG. 13. In addition, when the skater anticipates much forwards and backwards skating, it can be desirable that an oval brake pad 39 configuration be used in both the anterior and posterior positions on a wheeled skate 21.

Figure 14:
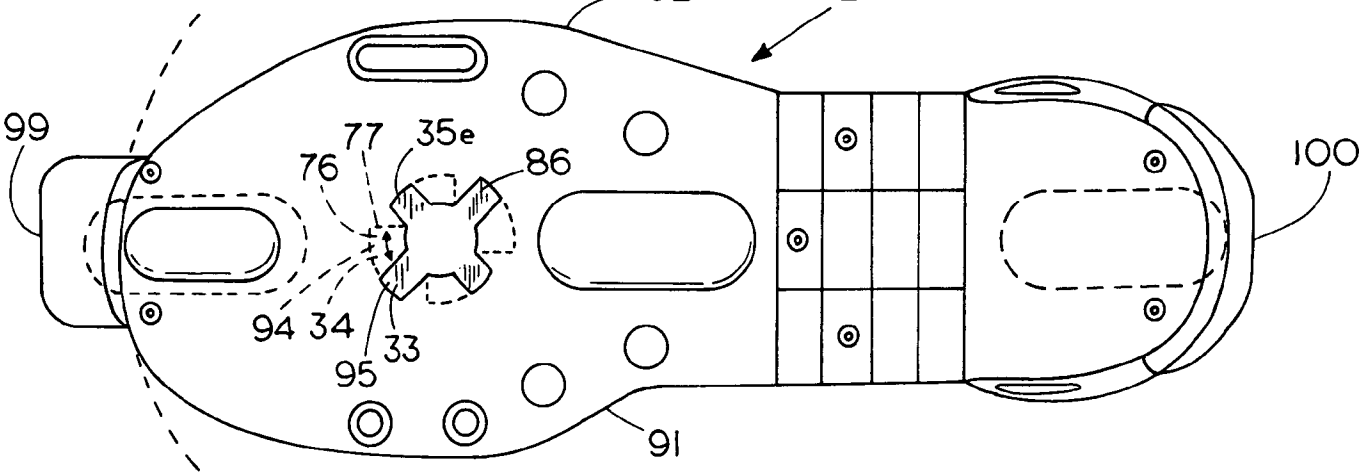
FIG. 14 is a top plan view of a skate having asymmetric configuration for use on a wearer's right foot.

FIG. 14 is a top plan view of a wheeled skate 21 having asymmetric configuration for use on the right foot. A different, but complementary asymmetric configuration would then be used to make the corresponding left wheeled skate 21, which is not shown. An asymmetric configuration can provide better conformance and fit in relation to the skater's foot and article of footwear 20. This can result in better skating performance. The major draw-back of the asymmetric configuration is the need to make twice as many molds and tools in order to produce both a distinct left and right skate. With a symmetric design the skate can be fitted to the right or left foot, thus reducing tooling and manufacturing costs.

Figure 15:
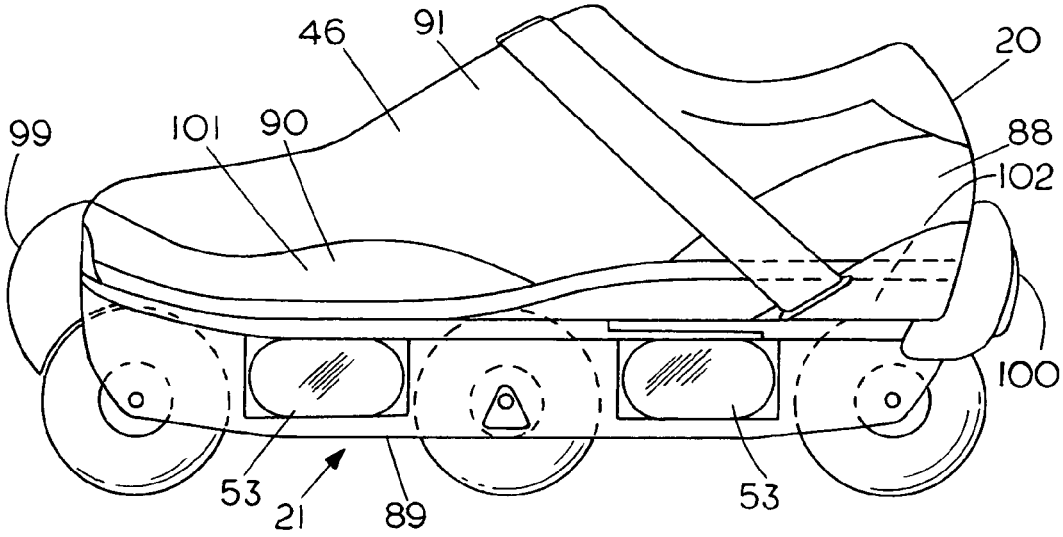
FIG. 15 is a side view of an article of footwear secured to a skate that includes stationary brake pads similar to that depicted on the right side of the skate chassis shown in FIG. 2.

FIG. 15 is a side view of an article of footwear 20 secured to a wheeled skate 21 that includes stationary brake pads 53. These brake pads are simple and effective, as substantial braking power can be developed using stationary brake pads 53. However, as the wear surfaces of the stationary brake pad 53 are not being renewed by way of movement or rotation of the stationary brake pad 53, the local contact areas of a stationary brake pad 53 can be relatively quickly abraded away. Further, the stationary brake pad 53 does not serve to substantially absorb the initial shock loading associated with de-acceleration that takes place when the brake pad first makes contact with the skating support surface, thus may not afford the same stability when braking as the spherical brake pad 59 or oval brake pad 39 configurations. The stationary brake pad 53 can be used in the anterior, middle or posterior positions on a wheeled skate 21. The stationary brake pad 53 is generally suitable for use regardless of the direction of the braking loads placed upon the skate. The stationary brake pad 53 preferably has a generally rounded cross-section as shown, but can have a relatively rectangular or other cross-sectional shape. The stationary brake pad 53 can be made of a durable natural or synthetic rubber, a thermoplastics material, or hybrid combination thereof.

The presence and use of an external heel counter 88, but also a side counter 90 in the forefoot 101 of an article of footwear 20, is also shown in FIG. 15. The inclusion of an external heel counter 88 and/or side counter 90 can enhance the stability of a shoe upper 46 with respect to the side loads commonly experienced during skating.

Figure 16:
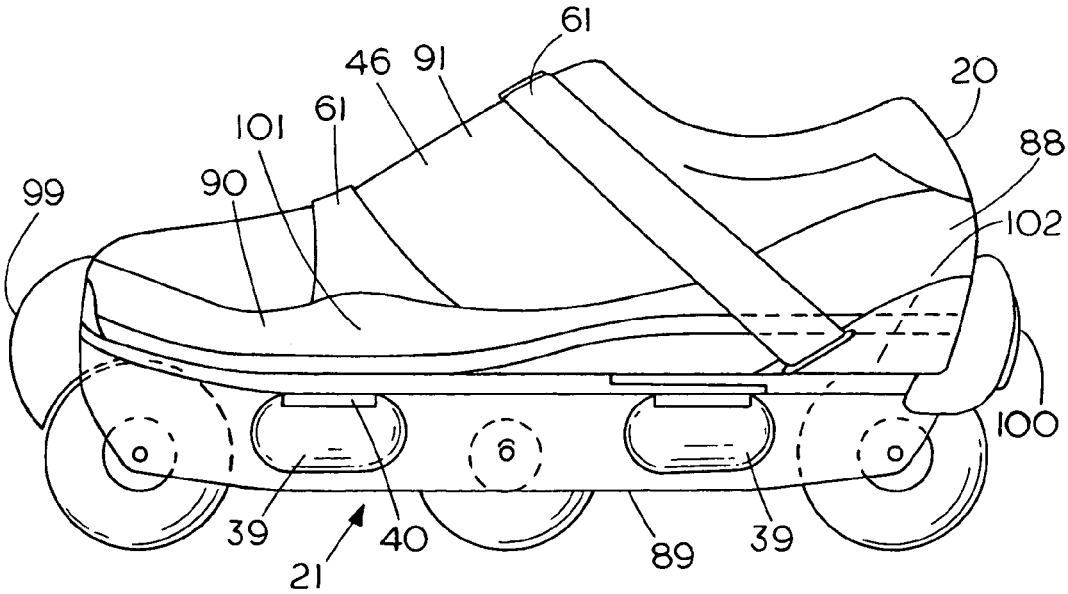
FIG. 16 is a side view of an article of footwear secured to a skate that includes oval brake pads similar to that depicted on the left side of the skate chassis shown in FIG. 2, and in FIG. 10.

FIG. 16 is a side view of an article of footwear 20 secured to a wheeled skate 21 having oval brake pads 39 mounted in both anterior and posterior positions. This configuration can be advantageous when the skater anticipates both forwards and backwards skating and predominantly longitudinal braking actions. The presence and use of a substantially integral and continuous combination external heel counter 88 and side counter 90, is also shown in FIG. 16. It can be readily understood that a heel counter 88, side counter 90, moderator plate, spring element 103, and sole 47 of the article of footwear 20 can be made in partial or complete combination. The inclusion of an external heel counter 88, but also side counter 90 can serve to enhance the stability of a shoe upper 46 with respect to the side loads that are commonly experienced during skating. As shown in FIG. 16, an article of footwear 20 can also include an integral anterior strap 61 for providing support and stability in forefoot 101 of the shoe upper 46.

Figure 17:
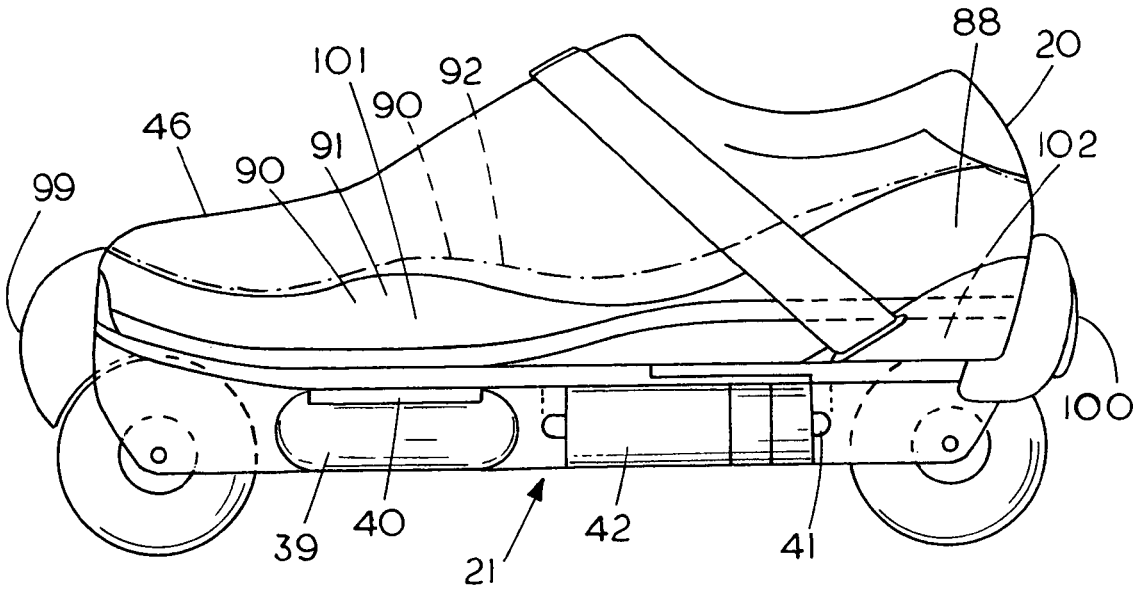
FIG. 17 is a side view of an article of footwear secured to a two wheeled skate having both an oval brake pad and a cylindrical brake pad.

FIG. 17 is a side view of an article of footwear 20 secured to a wheeled skate 21 having oval brake pads 39 mounted in the anterior position, and cylindrical brake pads 42 mounted in the posterior position. This configuration can be advantageous when the skater anticipates braking while forward skating using the snow-plow braking technique, and also the hockey-stop braking technique. However, the oval brake pad 39 configuration is most suitable for accommodating the snow-plow braking technique in which the braking forces are generally longitudinal, whereas the cylindrical brake pad 42 configuration is most suitable for accommodating the hockey-stop braking technique in which the posterior part of the skate is caused to slide sideways and the braking forces are generally transverse, thus perpendicular with respect to the longitudinal axis 70 of the skate 21.

Also shown in FIG. 17, is the presence of an integral heel counter 88 and side counter 90 which extends substantially about the sides of the article of footwear 20. The profile of the side counter 90 on the medial side 91 is asymmetric relative to the side counter 90 on the lateral side 92, which is shown in phantom using a dashed line. This configuration reflects a design choice which takes into consideration human anatomy and the direction and magnitudes of the loads commonly experienced while skating, but other configurations are possible. The counter configuration shown in FIG. 17 generally resembles that found in articles of footwear used in the jumping and throwing events contested in track and field.

Figure 18:
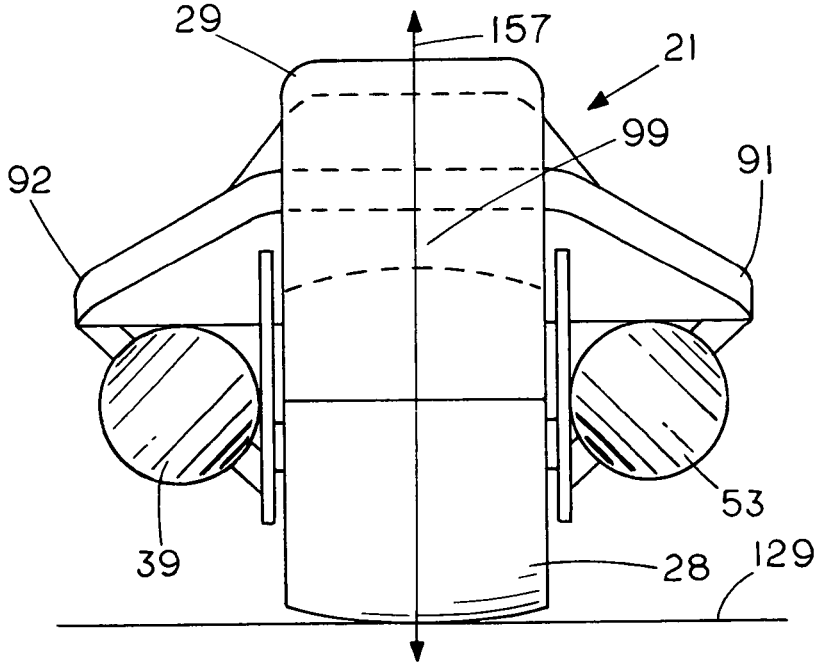
FIG. 18 is a front view of a two wheel skate having relatively wide wheels, and showing a front brake pad, but also the presence of oval brake pads on both sides of the chassis of the skate.

FIG. 18 is a front view of an alternate wheeled skate 21 having two relatively wide wheels. The front wheel 28 of the wheeled skate 21 can be free rolling in forward and backwards direction. Alternatively, the front wheel 28 can be free rolling only in the forward direction, thus will stop its rotation and produce traction when the skate is drawn rearwards by a skater. Wheels having an internal mechanism for providing this characteristic are known in the art and are sometimes used on cross-country ski simulators for dry land use. In this way, the front wheel serves as a brake and a means by which the skater can apply force to the skating surface and thereby propel themselves in a generally linear movement similar to that used in figure skating. In the figure skate, the toe pick provides substantially the same function. A wheel capable of free rolling only in the forwards direction can be used with any or all embodiments of the wheeled skates and any of the wheels disclosed or recited herein. A wheel capable of free rolling only in the forward direction need not be relatively wide, but rather can be of any configuration and dimension. A two wheeled skate 21 does not include rockering per sey, and is normally not as maneuverable or fast as a three wheeled skate. However, a wheeled skate including relatively wide wheels can be easier to balance upon, and such wheels can provide better traction and wear properties. As shown in FIG. 18, a two wheeled skate 21 can include a front brake pad 29, and oval brake pads 39 on the medial side 91 and lateral side 92. Larger brake pads having greater surface area can sometimes be mounted on a two wheeled skate 21.

Figure 19:
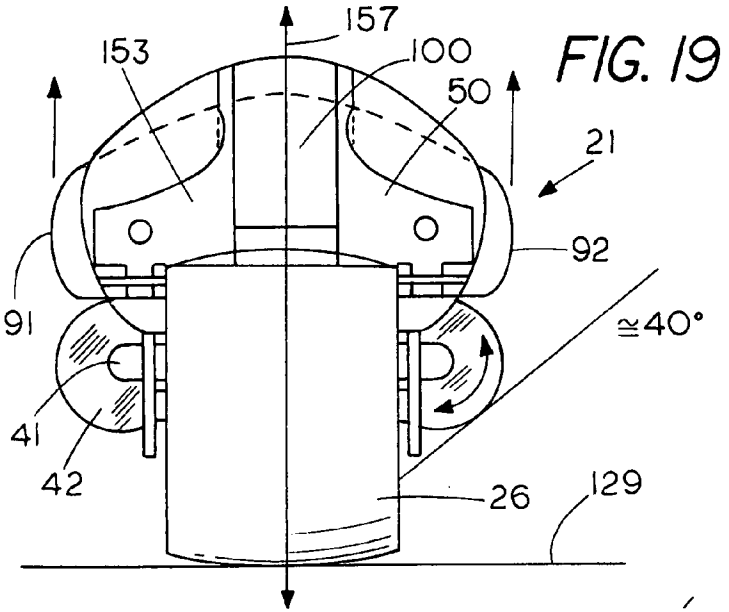
FIG. 19 is a rear view of a two wheeled skate having relatively wide wheels, and showing a male hinged rearfoot retainer for securing the rearfoot of an article of footwear to the skate, but also the presence of cylindrical brake pads on both sides of the chassis of the skate.

FIG. 19 is a rear view of an alternate wheeled skate 21 having two relatively wide wheels 22. Also shown is a male rearfoot retainer 153 consisting of a male hinged rearfoot retainer 50 for securing the rearfoot 102 of an article of footwear 20 in functional relation to the wheeled skate 21, and cylindrical brake pads 42 mounted on cylindrical brake pad retainers 41 on the medial side 91 and lateral side 92.

Figure 20:
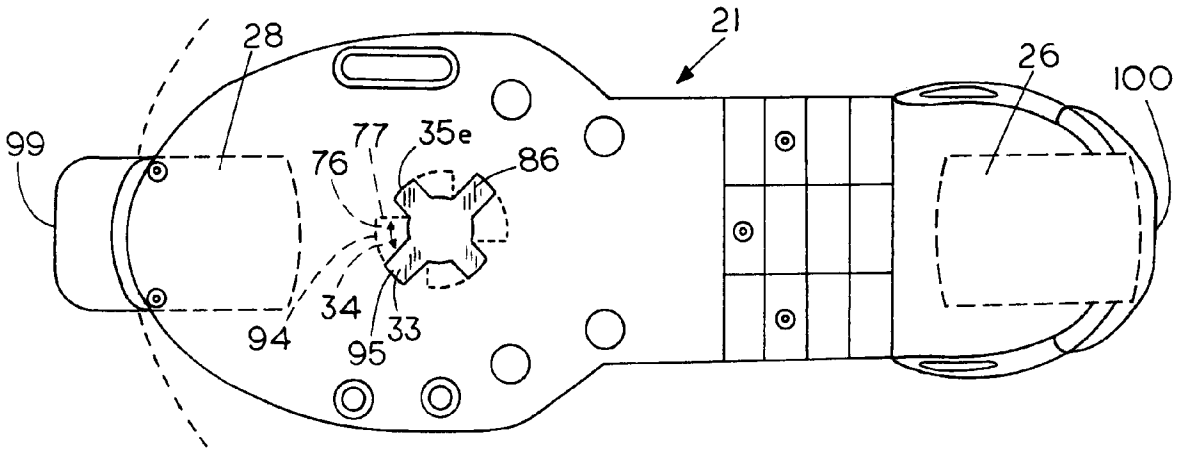
FIG. 20 is a top plan view of a two wheeled skate having symmetric configuration for use on either the left or right foot.

FIG. 20 is a top plan view of an alternate wheeled skate 21 having two relatively wide wheels 26 and 28, and having a symmetric configuration for use on either the left or right foot. Alternatively, a wheeled skate 21 having two relatively wide wheels 26 and 28 could be made in an asymmetric configuration, that is, suitable for use on only the right or left foot, similar to the wheeled skate 21 shown in FIG. 14.

Figure 21:
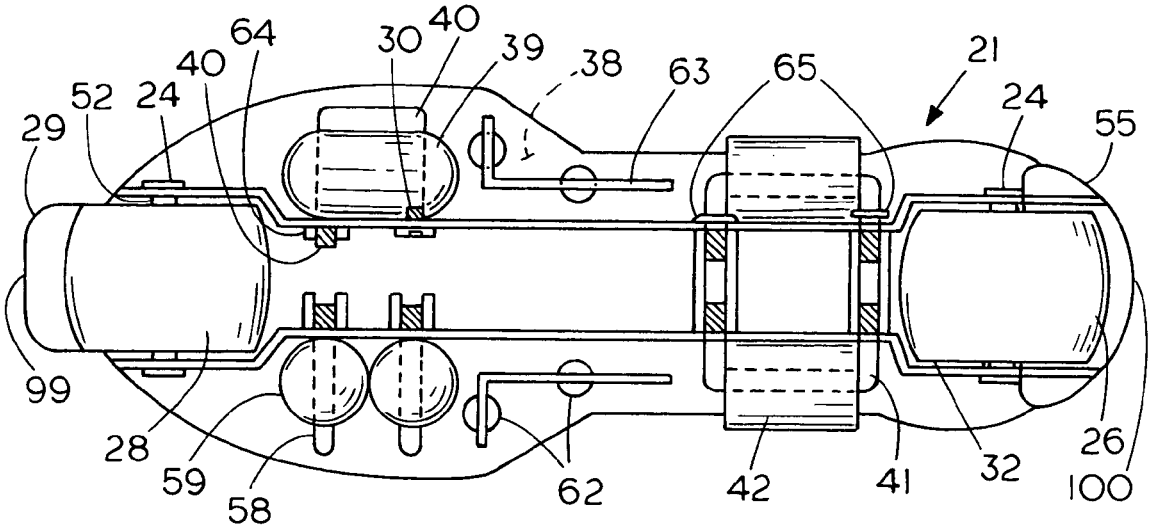
FIG. 21 is a bottom plan view of a two wheeled skate having symmetric configuration for use on either the left or right foot.

FIG. 21 is a bottom plan view of an alternate wheeled skate 21 having two relatively wide wheels 26 and 28, and having a symmetric configuration suitable for use on either the left or right foot. It can be seen that the inclusion of relatively wide wheels 26 and 28 need not compromise the presence and function of various brake systems on a wheeled skate 21.

Figure 22:
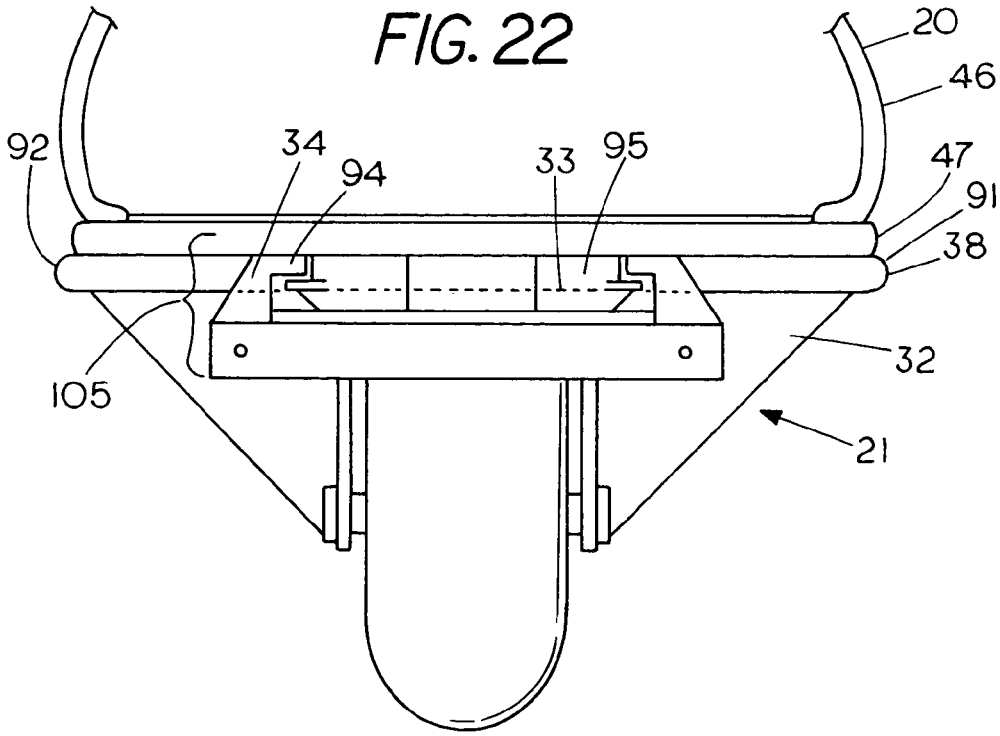
FIG. 22 is a transverse cross-sectional view of an article of footwear having a step-in footwear portion of locking mechanism assembly and a wheeled skate having a compatible skate portion of locking mechanism assembly with parts broken away.

FIG. 22 is a transverse cross-sectional side view, with parts broken away, of an alternate article of footwear 20 including an upper 46, sole 47, and a footwear portion of locking mechanism assembly 95 which can be characterized as the male portion 33 removable secured in functional relation to an alternate wheeled skate 21 including a skate portion of locking mechanism 94 which can be characterized as the female portion 34. The footwear portion of locking mechanism assembly 95 and skate portion of locking mechanism 94 which form locking mechanism assembly 105 have a somewhat similar configuration and operation as that of the Shimano, Inc. SPD system, as taught in U.S. Pat. No. 5,557,985. As shown, the locking mechanism assembly 105 is rotated 90 degrees from the longitudinal axis 70 of the wheeled skate 21 and the orientation commonly used with bicycle shoes and pedals.

FIG. 23 is a top plan view of a wheeled skate 21 including an opening 35*e* in platform 38 for permitting the entrance of the footwear portion of locking mechanism assembly 95 which can be characterized as the male portion 33. The footwear portion of locking mechanism assembly 95 can be secured to the sole 47 of an article of footwear 20. The chassis 32 includes the skate portion of locking mechanism assembly 94 which can be characterized as the female portion 34 in the form of opening 35*e*, recess 76, and stop 77. The footwear portion of locking mechanism assembly 95 can be placed into opening 35*e* and rotated clockwise, and the four fingers 86 will then engage recesses 76 and stops 77. The recesses 76 can be tapered in the manner of a ramp such that the fingers 86 are drawn downwards as the footwear portion of locking mechanism assembly 95 is rotated clockwise, thereby firmly removably securing the footwear portion of locking mechanism assembly 95 and article of footwear 20 to the skate portion of locking mechanism assembly 94 and wheeled skate 21. The surface upon which the fingers 86 bear can included a resilient elastomeric material for facilitating operation and dampening vibration. The footwear portion of locking mechanism assembly 95 can be released by counter-clockwise rotation and withdrawing the footwear portion of locking mechanism assembly 95 from the skate portion of locking mechanism assembly 94 and including opening 35*e*. Many other devices, configurations and dimensions are possible. In this regard, reference is made to various devices and means commonly used to secure cleats to the soles of articles of footwear such as U.S. Pat. No. 5,628,129 assigned to NIKE, Inc., and the prior art recited therein which includes several patents assigned to Adidas, A. G.

FIG. 24 is a top plan view of another alternate wheeled skate 21 including a skate portion of locking mechanism assembly 94 including opening 35*f* and recesses 76, and a manually actuated locking device 93. Wheeled skate 21 also includes slide lock retainer 84, female slide snap-fit retainer 85, and slide lock 81. Slide lock 81 includes male slide lock snap-fit retainer 83 and grip 82. An alternate article of footwear 20 can include the footwear portion of locking mechanism assembly 95 including anterior projection 78, side projections 79, and vertical post 80. When slide lock 81 is withdrawn from the side of the wheeled skate 21, the footwear portion of locking mechanism assembly 95 can be inserted into the skate portion of locking mechanism assembly 94 including opening 35*f* and can slide anteriorly to engage anterior projection 78 and side projections with recesses 76 in chassis 32. Slide lock 81 can then be inserted within slide lock retainer 84 thereby engaging the posterior portions of the footwear portion of locking mechanism assembly 95, thereby removably securing the footwear portion of locking mechanism assembly 95 to the wheeled skate 21. When a skater desires to release the article of footwear 20 from the wheeled skate 21, grip 82 can be grasped and the slide lock 81 withdrawn from the wheeled skate 21 sufficiently so as to disengage from the footwear portion of locking mechanism assembly 95, and permit it to slide posteriorly and then be withdrawn from the skate portion of locking mechanism assembly 94 including opening 35*f*, thereby releasing the article of footwear 20. Many other configurations are possible with respect to manually actuated locking means for disengaging a footwear portion of locking mechanism assembly 95 from a skate portion of locking mechanism assembly 94.

Figure 25:
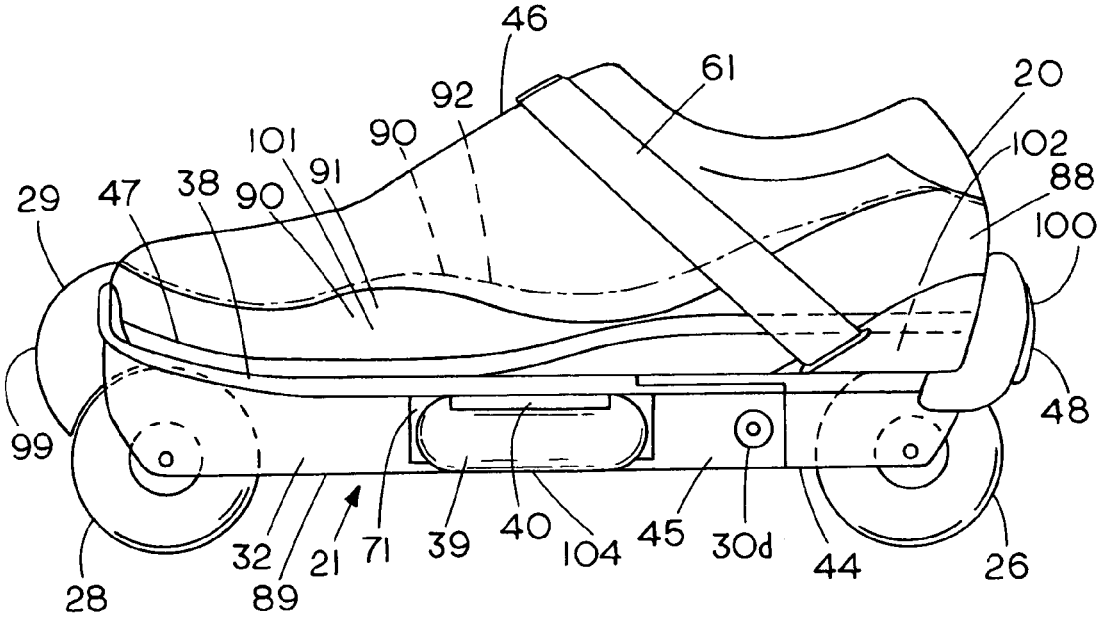
FIG. 25 is a medial side view of an in-line wheeled skate including two wheels and a rotating brake pad.

FIG. 25 is a medial side 91 view of an in-line wheeled skate 21 including two wheels 26 and 28 and a rotating brake pad. In particular, an oval brake pad 39 is shown mounted on an oval brake pad retainer 40 positioned approximately at the middle 104 of the chassis 32. When the wheeled skate 21 in inclined from the vertical axis 157 towards the medial side 91 the oval brake pad 39 can make contact with the ground support surface and rotate about the oval brake pad retainer 40 in a generally longitudinal orientation. The resulting loading, friction and drag associated with the oval brake pad 39, the oval brake pad retainer 40, the possible use of renewable wear surface 71 mounted on the chassis 32, and the support surface, can be effectively used to cause the wheeled skate 21 to stop, as desired. It has been found that the most advantageous functional position for an oval brake pad 39 is approximately at the middle 104 of the chassis 32. In particular, it is advantageous that an oval brake pad 39 be position on the medial side 91 and generally underlying the medial longitudinal arch of a wearer's foot. Accordingly, when the wearer's foot is inwardly rotated, and also possibly pronated via articulation of the subtalar joint in a manner generally similar to the so-called snow-plow braking maneuver used in snow skiing, a substantial force application can be placed upon the oval brake pad 39 and underlying support surface. It has also been discovered that positioning the oval brake pad 39 approximately at the middle of the chassis 32 of an in-line wheeled skate 21 also permits the stabilizing structures associated with a wearer's foot and anatomy to be used most effectively to preserve balance and directional control during hard braking. Accordingly, it is possible to stop aster while better maintaining balance and control with the use of an oval brake pad 39 that is positional approximately at the middle 104 of the chassis 32 of a wheeled skate 21 relative to many of the conventional fixed or mechanically actuated heel drag brake pads which have been commercialized. For this reason, a wheeled skate 21 including the oval brake pad 39 configuration shown in FIG. 25 constitutes the preferred embodiment for an in-line two wheeled skate.

Figure 26:
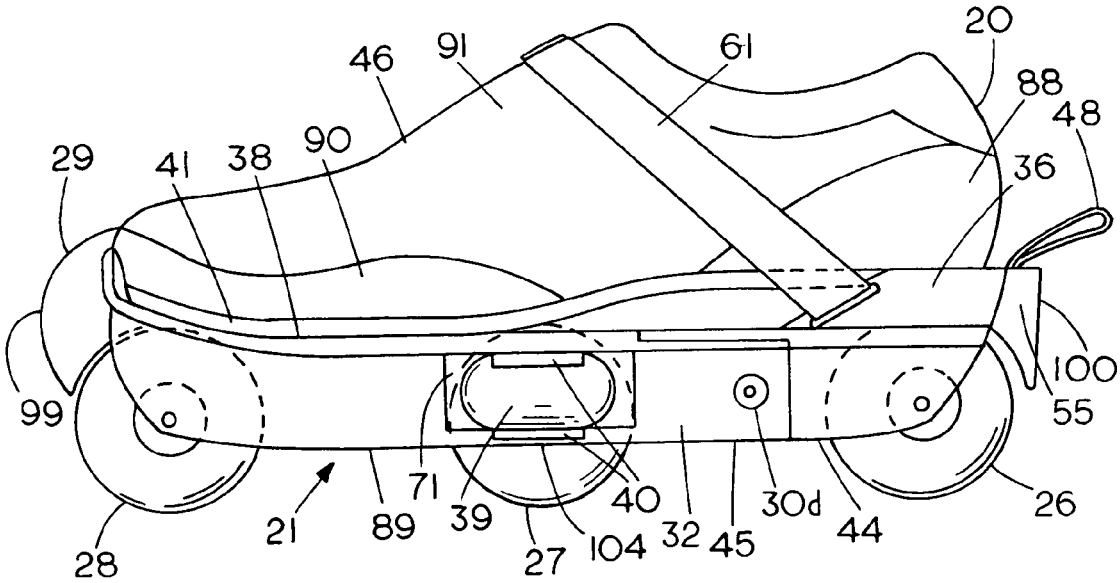
FIG. 26 is a medial side view of an in-line wheeled skate including three wheels and a rotating brake pad.

FIG. 26 is a medial side 91 view of an in-line wheeled skate 21 including three wheels 26, 27, and 28, and a oval brake pad 39 positioned approximately at the middle 104 of the chassis 32. If desired, the inferior portion of the oval brake pad retainer 40 can be removably secured by using the bolt that simultaneously constitutes the axle 24 for the middle wheel 27. As shown in FIG. 26, the size of the oval brake pad 39 and oval brake pad retainer 40 is smaller than in the embodiment shown in FIG. 25. However, it has been discovered with respect to an oval brake pad 39 that even one square inch of working surface can provide substantial braking power. For this reason, a wheeled skate 21 including the oval brake pad 39 configuration shown in FIG. 26 constitutes the preferred embodiment for an in-line three wheeled skate.

FIG. 27 is a front view of the wheeled skate 21 shown in FIG. 26 with the article of footwear 20 removed. Accordingly, the anterior side 99 is shown, but also visible are the oval brake pads 39 and oval brake pad retainers 40 secured approximately at the middle 104 of the chassis 32 on both the medial side 91 and lateral side 92. Alternatively, an oval brake pad 39 and oval brake pad retainer 40 can be secured to only the medial side 91.

FIG. 28 is a rear view of the wheeled skate 21 shown in FIGS. 26 and 27 with the article of footwear 20 removed. Accordingly, the posterior side 100 is shown, but also visible are the oval brake pads 39 and oval brake pad retainers 40 secured near the middle 104 of the chassis 32 on both the medial side 91 and lateral side 92. Also shown is the rearfoot retainer flange 36, loop 48, rear bumper 55, and strap 61 including a D-ring 96 and VELCRO® 97 hook and pile.

Figure 29:
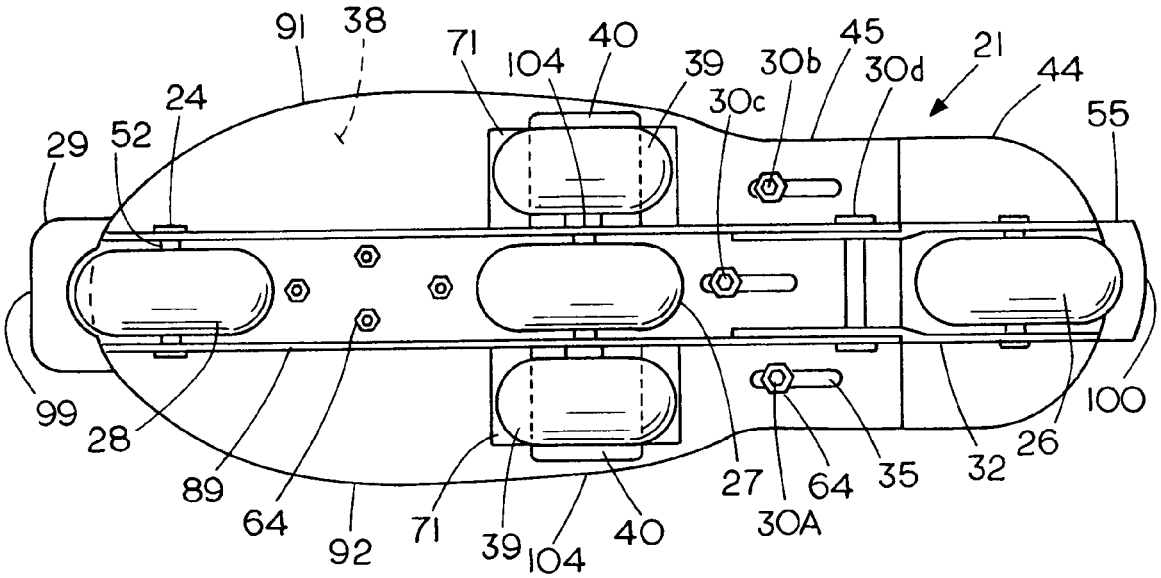
FIG. 29 is a bottom plan view of the wheeled skate shown in FIGS. 26, 27, and 28.
Figure 31:
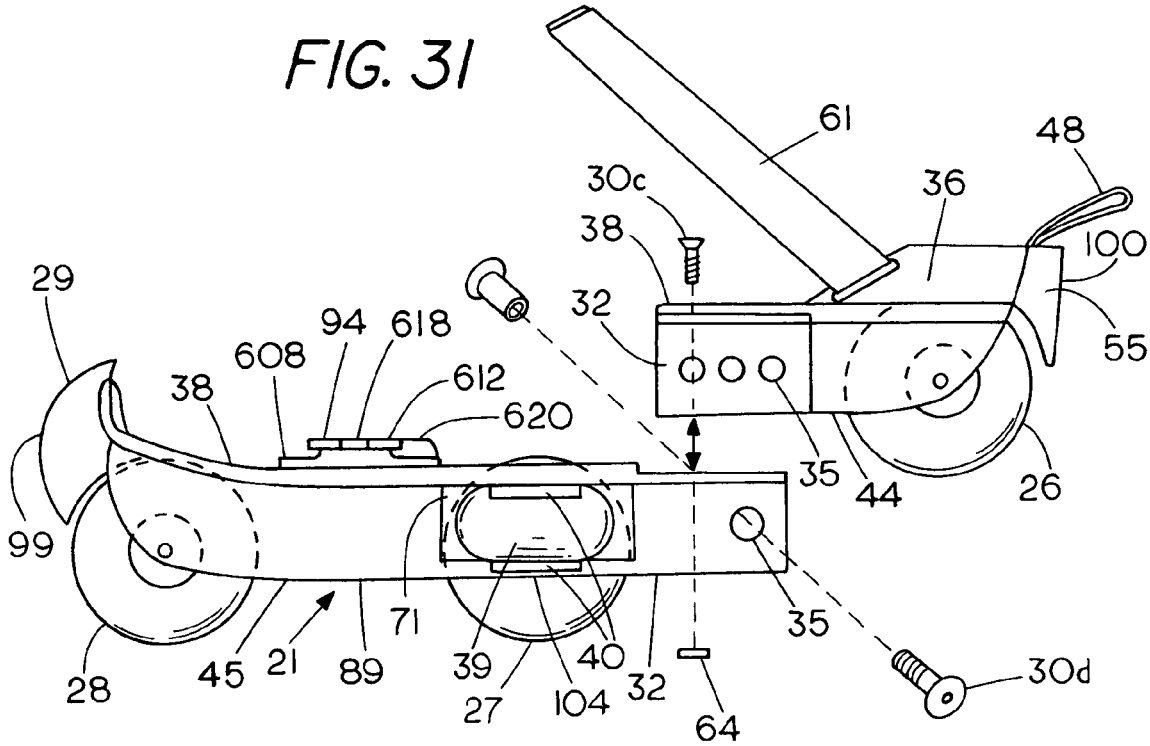
FIG. 31 is a partially exploded medial side view of the wheeled skate shown in FIGS. 26, 27, 28, 29 and 30 with the article of footwear removed.
Figure 32:
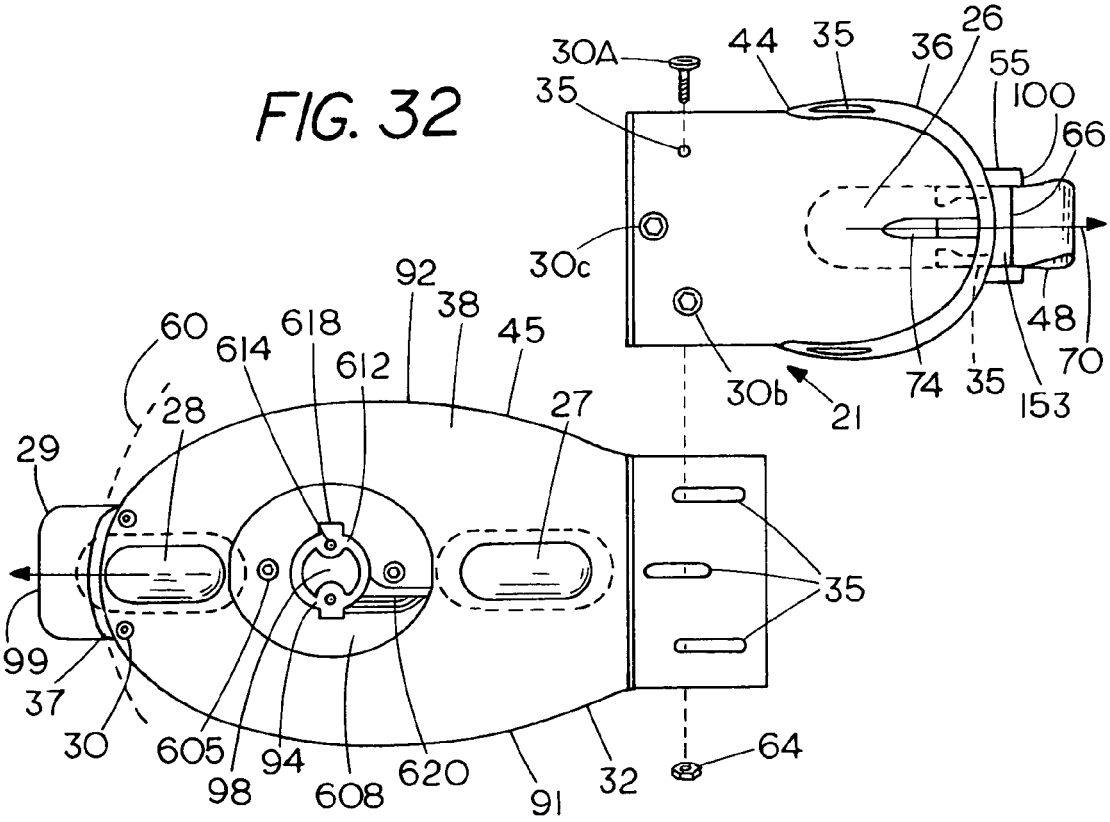
FIG. 32 is a partially exploded top view of a wheeled skate similar to that shown in FIG. 30 with the article of footwear removed, but further including a male snap-fit rearfoot retainer.

FIG. 29 is a bottom plan view of the wheeled skate 21 shown in FIGS. 26, 27, and 28. The posterior chassis portion 44 is shown positioned in functional relation with the anterior chassis portion 45. The overall length of the chassis 32 can be adjusted given the longitudinally elongated openings 35 in the chassis 32 associated with bolts 30*a*, 30*b*, and 30*c*, and also the plurality of alternate transverse openings 35 associated with bolt 30*d*. As shown in FIGS. 31 and 32, the anterior chassis portion 44 and posterior chassis portion 45 can then be secured in a desired position with transverse bolt 30*d*, and also bolts 30*a*, 30*b*, and 30*c* and nuts 64.

FIG. 30 is a top plan view of the wheeled skate 21 shown in FIGS. 26, 27, 28, and 29 with the article of footwear 20 removed. Shown are bolts 30*a*, 30*b*, and 30*c* for adjusting the length of the chassis 32. As shown, the skate portion of locking mechanism assembly 94 includes a first center of rotation 98 and can be generally similar or identical in structure to that taught in U.S. Pat. No. 5,546,829, which has been previously incorporated by reference herein. In particular, screws 605, top surface 608, head 612, screws 614, head tabs 618, and cam stop 620 indicate parts of the skate portion of locking mechanism assembly 94 that are also shown in FIGS. 31–32, 35, 36, 38, 40–41, and 43–49, which are substantially the same as those recited in U.S. Pat. No. 5,546,829 granted to Bryne, previously incorporated by reference herein.

A wearer of an article of footwear 20 including a complementary footwear portion of locking mechanism assembly 95 which includes a complementary second center of rotation 98 can then insert or step into the skate portion of locking mechanism assembly 94 with the centers of rotation 98 on the corresponding parts in alignment and with their rearfoot 102 rotated laterally, that is, their toes and the anterior side 99 of the article of footwear 20 is then pointed inwards and their heel and rearfoot 102 is then rotated laterally outwards less than or equal to approximately 40 degrees, thereby causing the footwear portion of locking mechanism assembly 95 and the skate portion of locking mechanism assembly 94 to be positioned for mechanical engagement. The article of footwear 20 and wheeled skate 21 each include a generally bisecting longitudinal axis 70 extending between their anterior side 99 and posterior side 100, and when the wearer then rotates their toes and the anterior side 99 of the article of footwear 20 laterally outwards and therefore the rearfoot 102 and posterior side 100 of the article of footwear medially inwards to bring the longitudinal axis 70 of the article of footwear 20 into approximate alignment with the longitudinal axis 70 of the wheeled skate 21, then the footwear portion of locking mechanism assembly 95 is removably secured to the skate portion of locking mechanism assembly 94 and they together then form locking mechanism assembly 105, and the forefoot 101 of the article of footwear 20 is thereby removably secured to the wheeled skate 21.

In this regard, the configuration and flexibility of the article of footwear 20 and the dimensions of the wheeled skate 21, and in particular, the height of the rearfoot retainer flange 36 are engineered such that the rearfoot 102 of the article of footwear 20 can clear the rearfoot retainer flange 36 by a relatively small margin when the rearfoot 102 of the article of footwear 20 is being elevated and rotated in or out of alignment with the longitudinal axis 70 of the wheeled skate 21. However, when the rearfoot 102 of the article of footwear 20 is lowered and secured within the confines of the rearfoot retainer flange 36 which encompasses a portion of the medial side 91, lateral side 92 and posterior side 100 of the article of footwear 20, then the rearfoot 102 of the article of footwear 20 is prevented from rotating outwards towards the lateral side 92, or thereby causing the footwear portion of locking mechanism assembly 95 and the skate portion of locking mechanism assembly 94 to become disengaged.

The rearfoot 102 of the article of footwear 20 can then be further removably secured to the wheeled skate 21 with the use of fastening means such as at least one strap 61, a male vertical stabilizer 74 on the wheeled skate 21 in combination with an aperture 87 in the sole 47 of the article of footwear 20, a male rearfoot retainer 153 such as a male hinged rearfoot retainer 50, a male snap-fit rearfoot retainer 66, a male clip rearfoot retainer 67, a male threaded rearfoot retainer 68, or a male rearfoot push button retainer 112, and the like, in combination with an opening 35 in the rearfoot retainer flange 36 of the wheeled skate 21 and also a female rearfoot retainer 51 in the rearfoot 102 of the article of footwear 20.

The method of disengaging and removing the article of footwear 20 from the wheeled skate 21 is essentially the reverse process of the method of removably securing the article of footwear 20 and wheeled skate 21 which has been described above. The fastening means securing the rearfoot 102 of the article of footwear 20 to the wheeled skate 21 such as straps 61 and male rearfoot retainer 153 are removed, and then the rearfoot 102 of the article of footwear 20 can be sufficiently elevated by the wearer to clear the rearfoot retainer flange 36, and then the rearfoot 102 of the article of footwear 20 can be rotated laterally outwards less than 40 degrees, thereby causing the footwear portion of locking mechanism assembly 95 to be released from mechanical engagement with the skate portion of locking mechanism assembly 94, thus permitting the article of footwear 20 to be removed from the wheeled skate 21.

Figure 54:
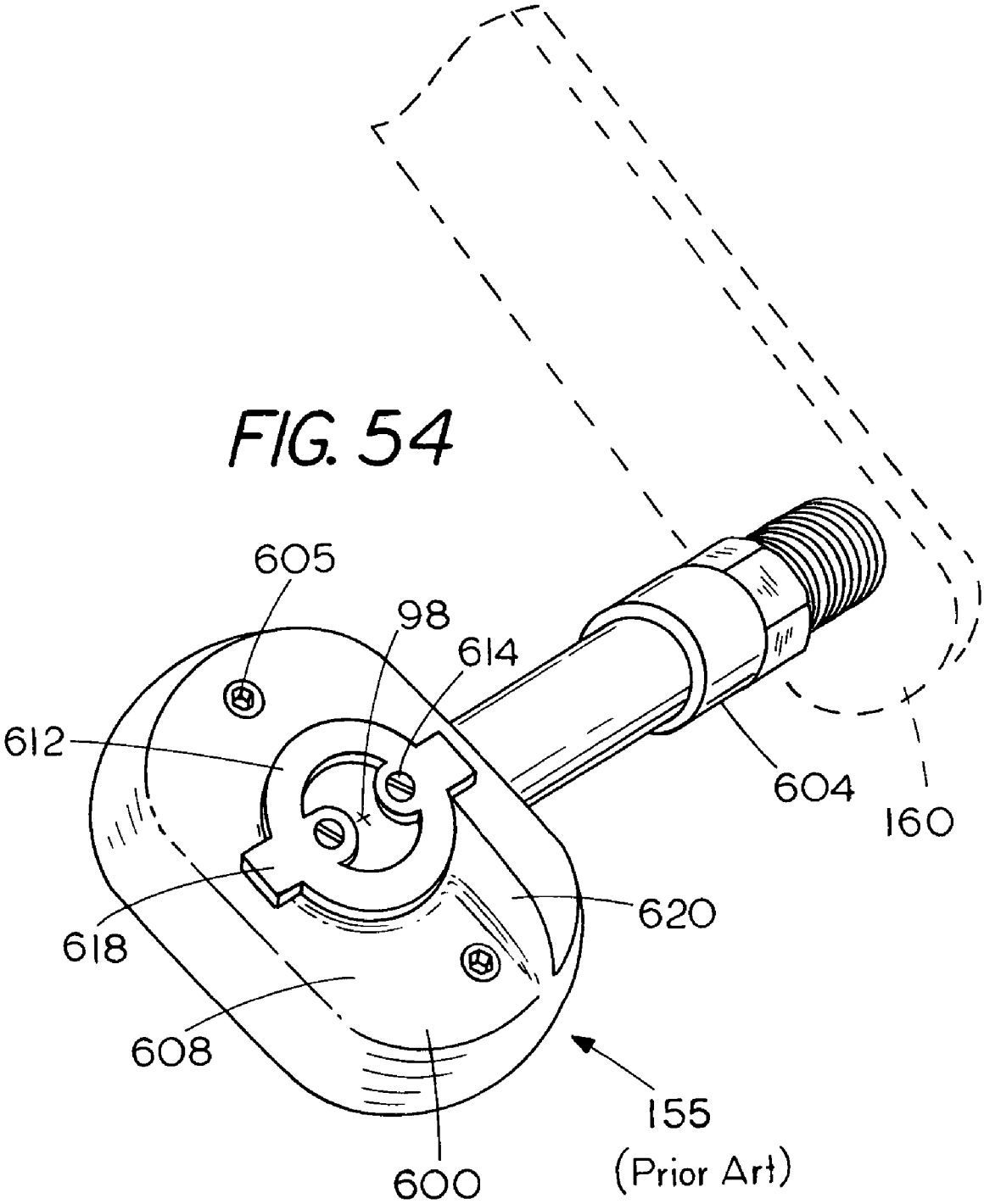
FIG. 54 is a perspective view of a bicycle pedal including a bicycle cleat portion of a bicycle cleat locking apparatus, and also a bicycle crank show in phantom with dashed lines.

Moreover, as shown in FIG. 34, the footwear portion of locking mechanism assembly 95 can consist of a bicycle cleat portion of bicycle cleat locking apparatus 154. The bicycle cleat portion of bicycle cleat locking apparatus 154 can be generally similar or identical in structure to that taught in U.S. Pat. No. 5,546,829, previously incorporated by reference herein. An article of footwear 20 including a bicycle cleat portion of bicycle cleat locking apparatus 154 can then be used with a corresponding pedal portion of bicycle cleat locking apparatus 155, as shown in FIG. 54. Accordingly, the same article of footwear 20 including a footwear portion of locking mechanism assembly 95 which consists of a bicycle cleat portion of bicycle cleat locking apparatus 154 can be used to removably secure the article of footwear 20 to a wheeled skate 21, or alternatively, to a bicycle pedal 600 including a corresponding pedal portion of bicycle cleat locking apparatus 155.

FIG. 31 is a partially exploded medial side 91 view of the wheeled skate 21 shown in FIGS. 26, 27, 28, 29 and 30 with the article of footwear 20 removed. Shown are a plurality of alternative transverse openings 35 in the posterior chassis portion 44 for accommodating bolt 30*d*, whereby the provided foot length size and overall length of the chassis 32 of the wheeled skate 21 can be selectively adjusted. Also shown is a side view of the skate portion of locking mechanism assembly 94, and also a vertically orientated bolt 30*c* and nut 64 for use in adjusting the provided length and securing the anterior chassis portion 45 and posterior chassis portion 44. For the sake of simplicity, vertically orientated bolts 30*a* and 30*b* and corresponding nuts 64 are not shown in the view.

FIG. 32 is a partially exploded top view of a wheeled skate 21 substantially similar to that shown in FIG. 30, but further including a male rearfoot retainer 153 consisting of a male snap-fit rearfoot retainer 66. Also shown are bolts 30*a*, 30*b*, and 30*c*, as well as corresponding longitudinally orientated slots or openings 35 for varying the provided foot length size and overall length of the wheeled skate 21, as desired, and then securing the anterior chassis portion 45 to the posterior chassis portion 44. After the forefoot 101 of the article of footwear 20 has been removably affixed to the wheeled skate 21 using the footwear portion of locking mechanism assembly 95 and the complementary skate portion of locking mechanism assembly 94, the rearfoot 102 of the article of footwear 20 can be secured using strap 61. In addition, the male snap-fit rearfoot retainer 66 can be removably inserted into at least one opening 35 in the rearfoot retainer flange 36 and also the void space which forms the female rearfoot retainer 51 that is present between the spring element 103 and upper 46 of the preferred article of footwear 20 shown in FIG. 33, thus further securing the rearfoot 102 of the article of footwear 20 in functional relation to the wheeled skate 21.

Figure 33:
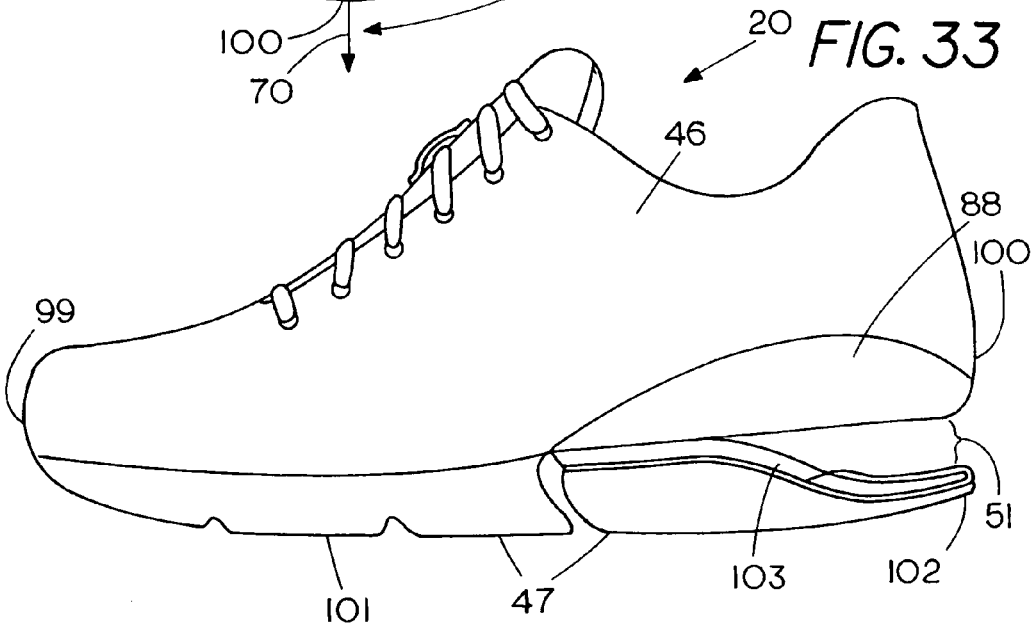
FIG. 33 is a medial side view of an article of footwear including a spring element and a female rearfoot retainer.

FIG. 33 is a medial side 91 view of an article of footwear 20 including a spring element 103 and a female rearfoot retainer 51. The preferred article of footwear 20 is taught in U.S. Pat. No. 6,449,878 granted to the applicant on Sep. 17, 2002, and in pending U.S. patent application Ser. Nos. 09/573,121, 10/152,402, and also Ser. No. 10/279,626, all of these patents and patent applications hereby being incorporated by reference herein. As previously discussed, a male rearfoot retainer 153 such as a male snap-fit rearfoot retainer 66, a male clip rearfoot retainer 67, a male threaded rearfoot retainer 68, a male hinged rearfoot retainer 50, a male rearfoot push button retainer, or other male retention means can be inserted in functional relation to the rearfoot retainer flange 36, and female rearfoot retainer 51 present in the article of footwear 20, thereby at least partially removably securing the rearfoot 102 of the article of footwear 20 to the chassis 32 of a wheeled skate 21.

FIG. 34 is a bottom plan view of the article of footwear 20 shown in FIG. 33 showing a preferred footwear portion of locking mechanism assembly 95 having a center of rotation 98 which consists of a bicycle cleat portion of bicycle cleat locking apparatus 154 that can be removably secured to the skate portion of locking mechanism assembly 94 and which together form the locking mechanism assembly 105. When a wearer of the article of footwear 20 including the footwear portion of locking mechanism assembly 95 steps into the skate portion of locking mechanism assembly 94 with the centers of rotation 98 on the corresponding parts in alignment and their rearfoot 102 rotated laterally, that is, their toes and the anterior side 99 of the article of footwear 20 is pointed inwards and their heel and rearfoot 102 is rotated laterally outwards less than or equal to approximately 40 degrees, then the footwear portion of locking mechanism assembly 95 and the skate portion of locking mechanism assembly 94 are positioned for mechanical engagement. When the wearer then rotates their toes and the anterior side 99 of the article of footwear 20 laterally outwards and thus their heel and rearfoot 102 medially inwards to bring the longitudinal axis 70 of the article of footwear 20 into approximate alignment with the longitudinal axis 70 of the wheeled skate 21, then the footwear portion of locking mechanism assembly 95 can become mechanically engaged and removably secured to the skate portion of locking mechanism assembly 94 and which together form the locking mechanism assembly 105, and the forefoot 101 of the article of footwear 20 is thereby removably secured to the wheeled skate 21. Also shown are various components of the bicycle cleat portion of bicycle cleat locking apparatus 154 including the cleat plate 651, guide rails 652, cut outs 653, T or mushroom shaped screws 654, 656 which is the top portion of 654, opening 659, ramp 668, and resilient tab 660, and plastic pillow 663, substantially as recited in U.S. Pat. No. 5,546,829 granted to Bryne, previously incorporated by reference herein. A bicycle pedal 600 such as that shown in FIG. 54 which includes a pedal portion of bicycle cleat locking apparatus 155 can be mechanically engaged and removably secured to an article of footwear 20 including a complimentary footwear portion of locking mechanism assembly 95 which also consists of a bicycle cleat portion of bicycle cleat locking apparatus 154, thus enabling the article of footwear 20 to be removably secured to a wheel skate 21 including a skate portion of locking mechanism assembly 94, or alternatively, to the aforementioned bicycle pedal 600, as desired.

The configuration and flexibility of the article of footwear 20 and dimensions of the wheeled skate 21, and in particular, the height of the rearfoot retainer flange 36 are engineered such that the wearer can elevate the rearfoot 102 of the article of footwear 20 to clear the rearfoot retainer flange 36 by a relatively small margin when the rearfoot 102 and longitudinal axis 70 of the article of footwear 20 is rotated in or out of alignment with the longitudinal axis 70 of the wheeled skate 21. However, when the rearfoot 102 of the article of footwear 20 is lowered and secured within the confines of the rearfoot retainer flange 36 which encompasses a portion of the medial side 91, lateral side 92 and posterior side 100 of the article of footwear 20, then the rearfoot 102 of the article of footwear 20 is prevented from rotating outwards towards the lateral side 92, or thereby causing the footwear portion of locking mechanism assembly 95 and the skate portion of locking mechanism assembly 94 to become disengaged.

The rearfoot 102 of the article of footwear 20 can then be further removably secured to the wheeled skate 21, as described previously in connection with FIGS. 30–33. Again, when fastening means such as a strap 61, or a male rearfoot retainer 153 such as male hinged rearfoot retainer 50, male snap-fit rearfoot retainer 66, male clip rearfoot retainer 67, male threaded rearfoot retainer 68, male rearfoot push button retainer 112, loop and latch means similar to that disclosed in U.S. Pat. No. 5,068,984 to Kaufman et al., previously incorporated by reference herein, or other rearfoot retention means are released, the rearfoot 102 of the article of footwear 20 can then be elevated by a wearer to clear the height of the rearfoot retainer flange 36, and the rearfoot 102 of the article of footwear 20 can then be rotated laterally outwards, thus releasing the footwear portion of locking mechanism assembly 95 from the skate portion of locking mechanism assembly 94 and thereby disengaging the article of footwear 20 from the wheeled skate 21.

Accordingly, the article of footwear 20 shown in FIGS. 33 and 34 including a footwear portion of locking mechanism assembly 95 which can consist of a bicycle cleat portion of bicycle cleat locking apparatus 154 can be functional for use in walking, running, bicycling, and skating. In particular, the provision for at least 10 mm of deflection in the rearfoot 102, and also at least 5 mm of deflection in the forefoot 101 of the preferred article of footwear 20 during walking and running activity, and combination of advantageous cushioning and energy return characteristics can provide substantial comfort and benefit to a wearer.

Figure 35:
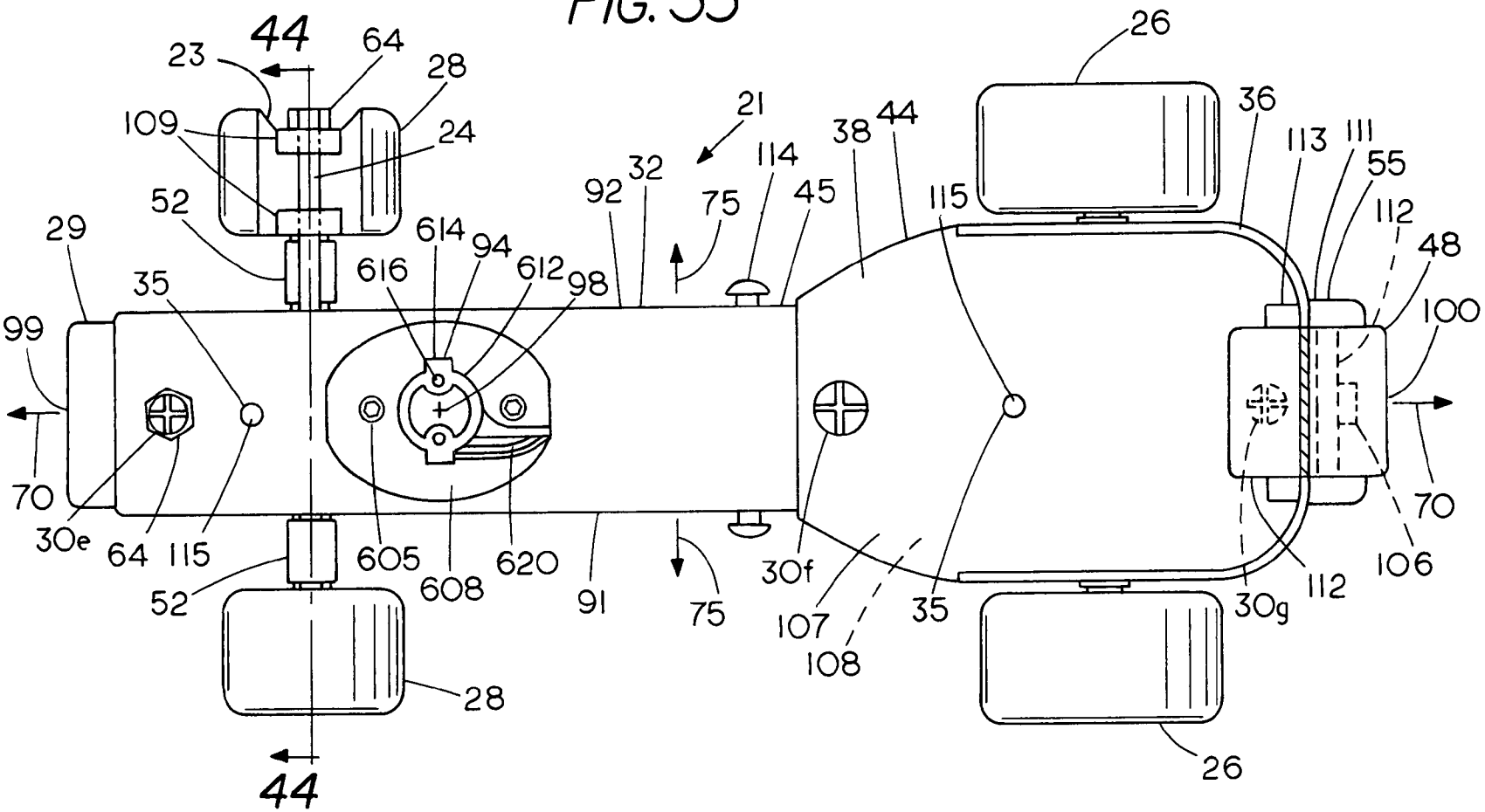
FIG. 35 is a top plan view of a quad wheeled skate.

FIG. 35 is a top plan view of a quad wheeled skate 21, that is, a skate having four wheels which are not aligned along a single straight longitudinal line. The front wheels 28 and rear wheels 26 can include a hub 23 that seats two sealed ball bearings 109, and can be mounted on axles 24 and secured with a nut 64, such as a nylon lock nut. Spacers 52 can be mounted upon the axles 24 to establish and maintain the desired wheel base. In order to better show structure that is not visible in a normal top plan view, the front right wheel 28 and spacer 52 are shown with parts broken away.

Figure 36:
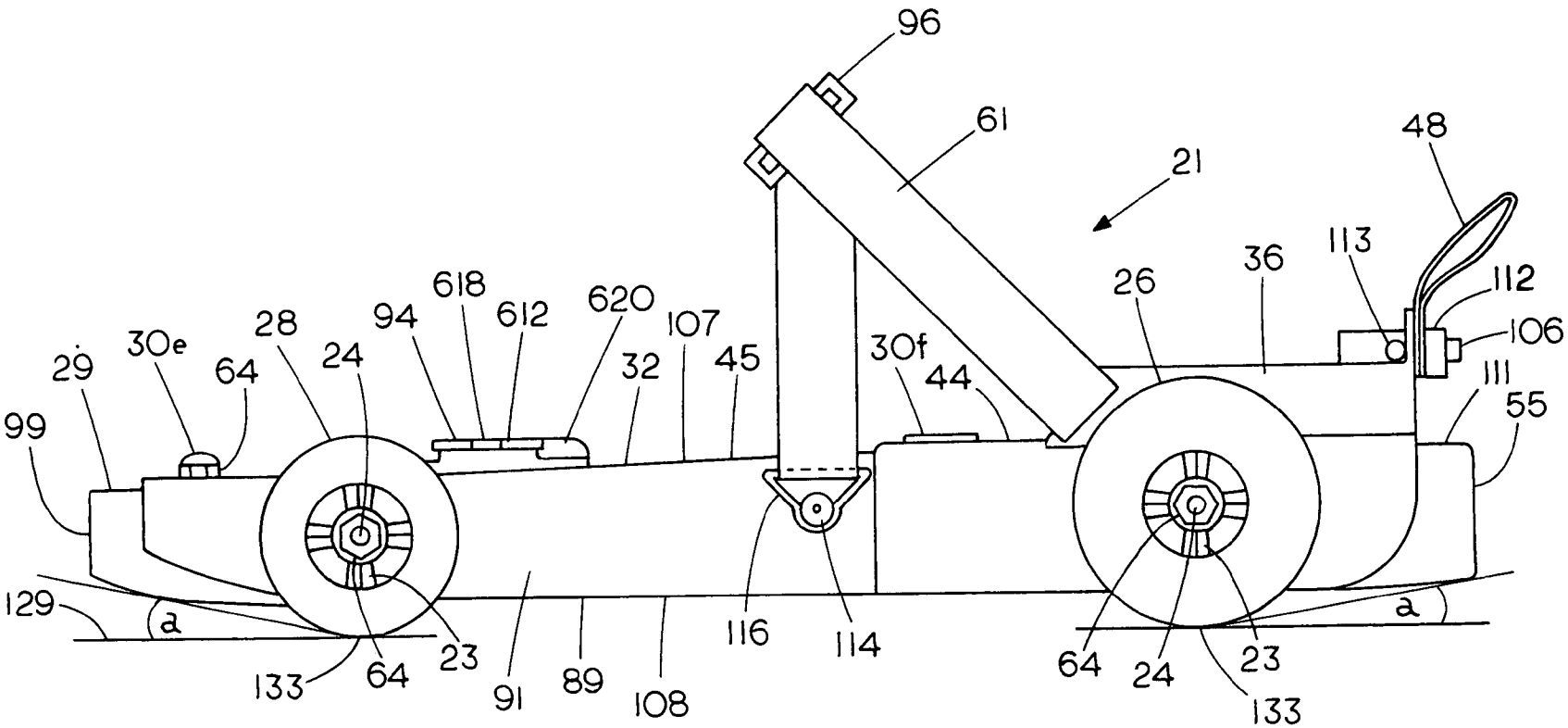
FIG. 36 is a medial side view of the quad wheeled skate shown in FIG. 35.

As best shown in FIG. 36, the wheeled skate 21 has a relatively low profile, and this can contribute to stability, but also the ability to brake effectively using the front brake pad 29 and rear brake pad 111. Accordingly, when the wheeled skate 21 is resting upright and level upon a level support surface 129 the inferior side 108 of the chassis 32 has a height preferably in the range between ¼ and ¾ inches, and most preferably in the range between ⅜ and ½ inches. Further, the height of the platform 38 of the chassis 32 adjacent the front axle 24 is preferably in the range between 1 to 2½ inches. Given the aforementioned height and overall geometry of the wheeled skate 21, and the skater's desire to effectively use the front brake pad 29 and rear brake pad 111, a skater can engage the front brake pad 29 and rear brake pad 111 by inclining the wheeled skate 21 by a relatively small angle preferably in the range between 5–35 degrees, and most preferably in the range between 5–15 degrees.

In order to provide advantageous stability and skating performance for an adult skater, the maximum outside measurement of the wheel base taken along a transverse line having a position similar to 44—44 is preferably in the range between 4 to 6½ inches, and most preferably in the range between 4½ to 6 inches for both the front wheels 28 and rear wheels 26. It has been discovered that a transverse wheel base having an outside measurement less than 4 inches does not provide sufficient space for accommodating the width of a wearer's forefoot 101 between the opposing front wheels 28 mounted on the medial side 91 and lateral side 92, whereas a transverse wheel base greater than 6½ inches does not permit a wearer's feet to pass one another without frequently striking or tangling with the wheeled skate 21 on the opposite foot.

Further, it has been discovered that advantageous skating and braking performance can be provided to an adult wearer when the position of the front axle 24 is preferably in the range between 1 to 3 inches posterior of the anterior side 99 of the front brake pad 29 and/or chassis 32 of the wheeled skate 21, and most preferably in the range between 1½ and 2½ inches. Moreover, it has been discovered that advantageous skating and braking performance can be provided to an adult skater when the position of the rear axle 24 is preferably in the range between 1 to 3 inches anterior of the posterior side 100 of the rear brake pad 111 and/or chassis 32 of the wheeled skate 21, and most preferably in the range between 1½ and 2½ inches. This structure provides the wearer with stability during normal skating, and facilitates a smooth transition when the wearer inclines the wheeled skate 21 and applies the front brake pad 29 or rear brake pad 111. In contrast, placing the axle 24 any closer than one inch from either the anterior side 99 or posterior side 100 makes for an abrupt transition, and does not facilitate engagement of the front brake pad 29 or rear brake pad 111 before a wheeled skate 21 would pass under a skater's center of gravity and possibly cause instability. Given the height and overall geometry of the wheeled skate 21, and the skater's desire to effectively use the front brake pad 29 and rear brake pad 111, the aforementioned range between 1½ and 2½ inches permits a skater to engage the front brake pad 29 and rear brake pad 111 by inclining the wheeled skate 21 by a relatively small angle preferably in the range between 5–35 degrees, and most preferably in the range between 5–15 degrees.

For a male wearer having a size 11 article of footwear 20, the preferred overall longitudinal length of the wheeled skate 21 is in the range between 11 and 13 inches, and most preferably approximately 12 inches. In addition, the preferred length of the wheel base as measured between the middle of the front and rear axles 24 is in the range between 7 and 9 inches, and most preferably approximately 8 inches. However, the appropriate longitudinal length of a wheeled skate 21 and also the longitudinal length of the wheel base as measured between the middle of the front and rear axles 24 is a function of the foot length size of a given wearer. Accordingly, the wearer's foot length size can be assigned a dimensionless value of 1 for the purpose of expressing and defining at least one relationship and ratio between a given foot length size and specific dimensions of a wheeled skate 21. In this regard, the overall longitudinal length of a preferred wheeled skate 21 can be expressed as the ratio of the overall longitudinal length of the wheeled skate 21 to the wearer's foot length size which is preferably in the range between 1/1 and 1.25/1, and most preferably in the range between 1.045/1 and 1.136/1. A corresponding overall longitudinal length shorter than this would not adequately accommodate a wearer's foot length size, whereas an overall longitudinal length much longer that this would increase the probability of one skate interfering with the other, thus possibly causing the wearer to trip. Further, the longitudinal wheel base length between the middle of the front and rear axles 24 can be expressed as the ratio of the wearer's foot length size and the longitudinal wheel base length which is preferably in the range between 1.2/1 and 1.6/1, and most preferably in the range between 1.25/1 and 1.5/1. A shorter longitudinal wheel base length tends to make the wheeled skate unstable at the anterior side 99 and posterior side 100, whereas a longer longitudinal wheel base makes difficult for a skater to transition, that is, to easily incline the wheeled skate 21 and enjoy sufficient stability when applying the front brake pad 29 or rear brake pad 111 to the skating support surface 129.

Shown in FIG. 35 on the medial side 91 and lateral side 92 of wheeled skate 21 is a strap retainer 114. On the superior side 107 of the anterior chassis portion 45 is shown the skate portion of locking mechanism assembly 94. As shown, the skate portion of locking mechanism assembly 94 can be generally similar or identical in structure to that taught in U.S. Pat. No. 5,546,829, this patent having been previously incorporated by reference herein However, as discussed previously, it can be desirable to alter or change the structure of the locking mechanism assembly 105 in order to substantially prevent rotation while skating and also to enhance robustness. Again, screws 605, top surface 608, head 612, screws 614, head tabs 618, and cam stop 620 indicate parts of the skate portion of locking mechanism assembly 94 substantially as recited in U.S. Pat. No. 5,546,829. A wearer of an article of footwear 20 including a complementary footwear portion of locking mechanism assembly 95 generally similar or identical in structure to that taught in U.S. Pat. No. 5,546,829, can then insert and rotate their foot causing the two portions of the locking mechanism assembly 105 to be removably secured. The anterior chassis portion 45 and posterior chassis portion 44 can be selectively affixed together using length adjusting bolt 30*f* to adjust the provided foot length size and overall length of the wheeled skate 21. Shown is a rear bumper 55 on the posterior side 100 that also serves as the rear brake pad 111. The elevation of the rear brake pad 111 relative to the support surface 129 can be adjusted using one or more spacers 122 and the rear pad adjusting bolt 30*g*, and also the selections make regarding the size and shape of the rear brake pad 111. Also shown is a front brake pad 29 on the anterior side 99 of the wheeled skate 21. The elevation of the front brake pad 29 relative to the support surface 129 can be adjusted using one or more spacers 122 with the front brake pad adjusting bolt 30*e* and nut 64, and also the selections made regarding the size and shape of the front brake pad 29. The superior end of the pivot arms 115 corresponding to the front pivot suspension 125 and rear pivot suspension 126 are shown in position within openings 35 in the superior side 107 of the chassis 32. Also shown is a male rearfoot push button retainer 112 for insertion into the rearfoot retainer flange 36 of the wheeled skate 21 and also the female rearfoot retainer 51 of an article of footwear 20 for the purpose of removably securing the rearfoot 102 of the article of footwear 20 in functional relation to the wheeled skate 21. In particular, the push button 106 actuates pistons 113 that can be used to lock or release the male rearfoot push button retainer 112.

FIG. 36 is a medial side 91 view of the quad wheeled skate 21 shown in FIG. 35. The amount of ground clearance between the chassis 32 and the support surface 129 is preferably in the range between ¼ to ¾ inches, and most preferably approximately in the range between ⅜ to ½ inches. When the wheeled skate 21 is resting level upon a level support surface 129, an angle can be measured from the tangent point 133 of contact of the front wheel 28 with the support surface 129 between the level support surface 129 and the front brake pad 29. Another angle can be measured from the tangent point 133 of contact of the rear wheel 26 with the support surface 129 between the level support surface 129 and the rear brake pad 111. These angles indicate the amount of inclination of the wheeled skate 21 that is required to engage the front brake pad 29, and the rear brake pad 111, respectively. The preferred amount of angular inclination required to engage the front brake pad 29, or alternatively, the rear brake pad 111 is preferably in the range between 5–35 degrees, and most preferably approximately between 5–15 degrees. If desired, a skater can then use a linear walking or skating movement to incline the wheeled skate 21 and cause the front brake pad 29 to engage the support surface 129 and thereby provide traction for producing forward motion. Alternatively, or in addition to the use of a front brake pad 29 for the purpose of making an efficient linear walking or skating movement, the front wheels 28 of the wheeled skate 21 can further include an internal ratchet or other stop mechanism for preventing the wheels 28 from rotating backwards. Also shown in FIG. 36 is a strap 61 including a D-ring 96 and also a triangle ring 116 for at least partially securing an article of footwear 20 to the wheeled skate 21. As shown, the anterior chassis portion 45 can be fitted and slide within a part of the posterior chassis portion 44 and then be secured with the length adjusting bolt 30*f* in order to adjust the provided foot length size and overall length of the chassis 32 and wheeled skate 21, as desired.

Figure 37:
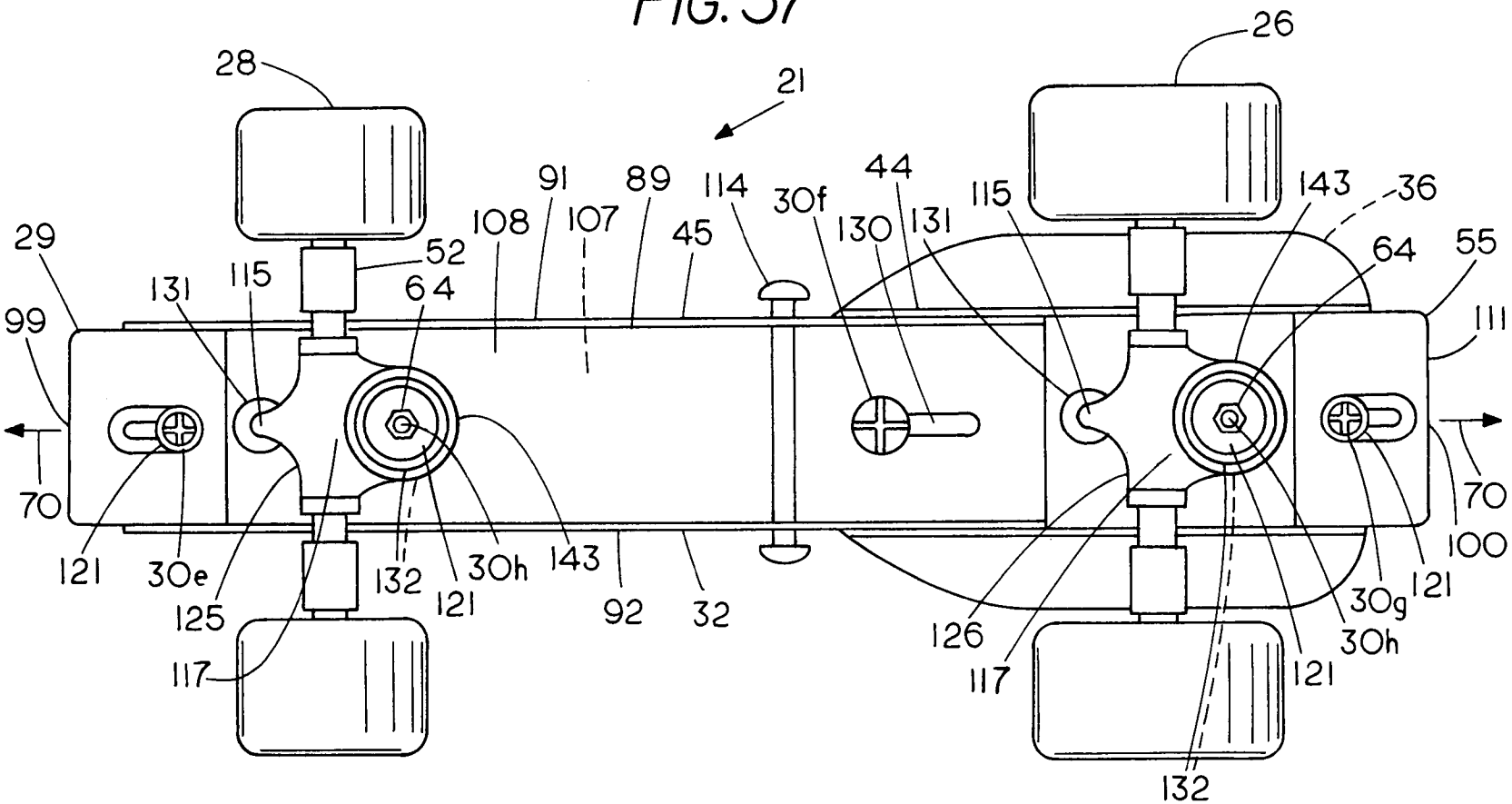
FIG. 37 is a bottom plan view of the quad wheeled skate shown in FIG. 35.

FIG. 37 is a bottom plan view showing the inferior side 108 of the quad wheeled skate 21 shown in FIG. 35. Shown is the bottom portion of the front brake pad bolt 30*e*, the length adjusting bolt 30*f*, and rear brake pad bolt 30*g*, and washers 121. Also shown is the front pivot suspension 125 having an axle retainer 117 including a pivot arm 115 that inserts within an opening in the chassis 32 and is fitted within a grommet 131, and a spring and dampener retaining bolt 30*h* for securing a spring and dampener 132 between the circular lobe 143 and the inferior side 108 of the chassis 32, but also another spring and dampener 132 positioned between the circular lobe 143 and the washer 121 and nut 64. The spring and dampener 132 can be made of a resilient elastomeric thermoset or thermoplastic rubber, a plastic, or polyurethane material, and the like. The front pivot suspension 125 is then able to deflect upwards and also downwards to attenuate shock and vibration. Further, when the wheeled skate 21 is loaded on the medial side 91 during a skating side stroke, the chassis 32 can be caused to tilt and the resulting orientation of the wheels 28 can cause the wheeled skate 21 to steer in a direction generally towards the midline of the skater's body. Likewise, the rear pivot suspension 126 has an axle retainer 117 including a pivot arm 115 that inserts within an opening in the chassis 32 and is fitted within a grommet 131, and a spring and dampener retaining bolt 30*h* for securing a spring and dampener 132 between the circular lobe 143 and the inferior side 108 of the chassis 32, but also another spring and dampener 132 positioned between the circular lobe 143 and washer 121 and nut 64. The rear pivot suspension 126 is then able to deflect upwards and also downwards to attenuate shock and vibration. Further, when the wheeled skate 21 is loaded on the medial side 91 during a skating side stroke, the chassis 32 can be caused to tilt and the resulting orientation of the wheels 28 can cause the wheeled skate 21 to steer in a direction generally towards the midline of the skater's body. The front pivot suspension 125 and rear pivot suspension 126 shown in FIG. 37 generally resemble in structure those suspensions provided in conventional roller skates.

Figure 38:
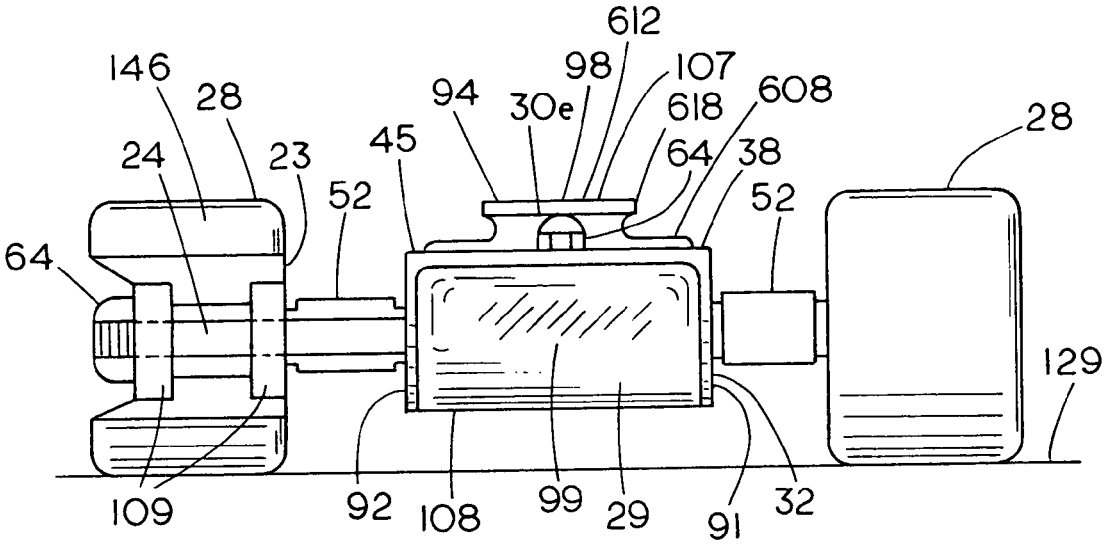
FIG. 38 is a front view of the quad wheeled skate shown in FIG. 35.

FIG. 38 is a front view of the quad wheeled skate 21 shown in FIG. 35. In order to better show structure that is not visible in a normal front view, the wheel 28 and spacer 52 on the left side of FIG. 38 are shown with parts broken away.

Figure 39:
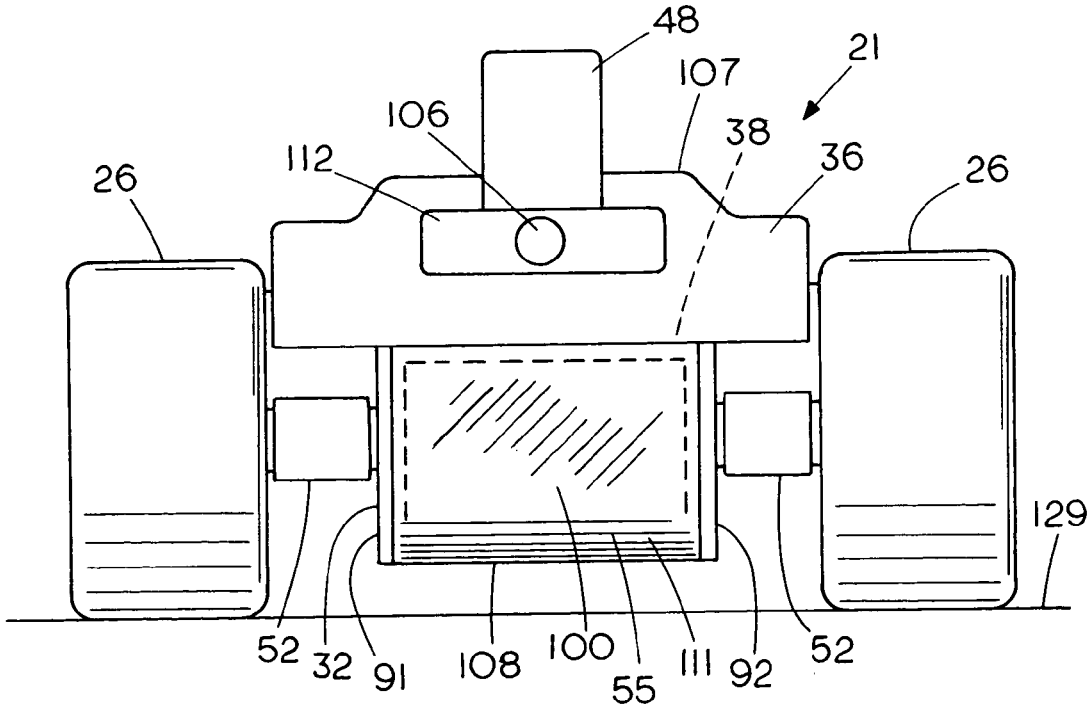
FIG. 39 is a rear view of the quad wheeled skate shown in FIG. 35.

FIG. 39 is a rear view of the quad wheeled skate 21 shown in FIG. 35. Shown is the rear brake pad 111, rearfoot retainer flange 36, and also the male rearfoot push button retainer 112 including a push button 106 and a loop 48.

Figure 40:
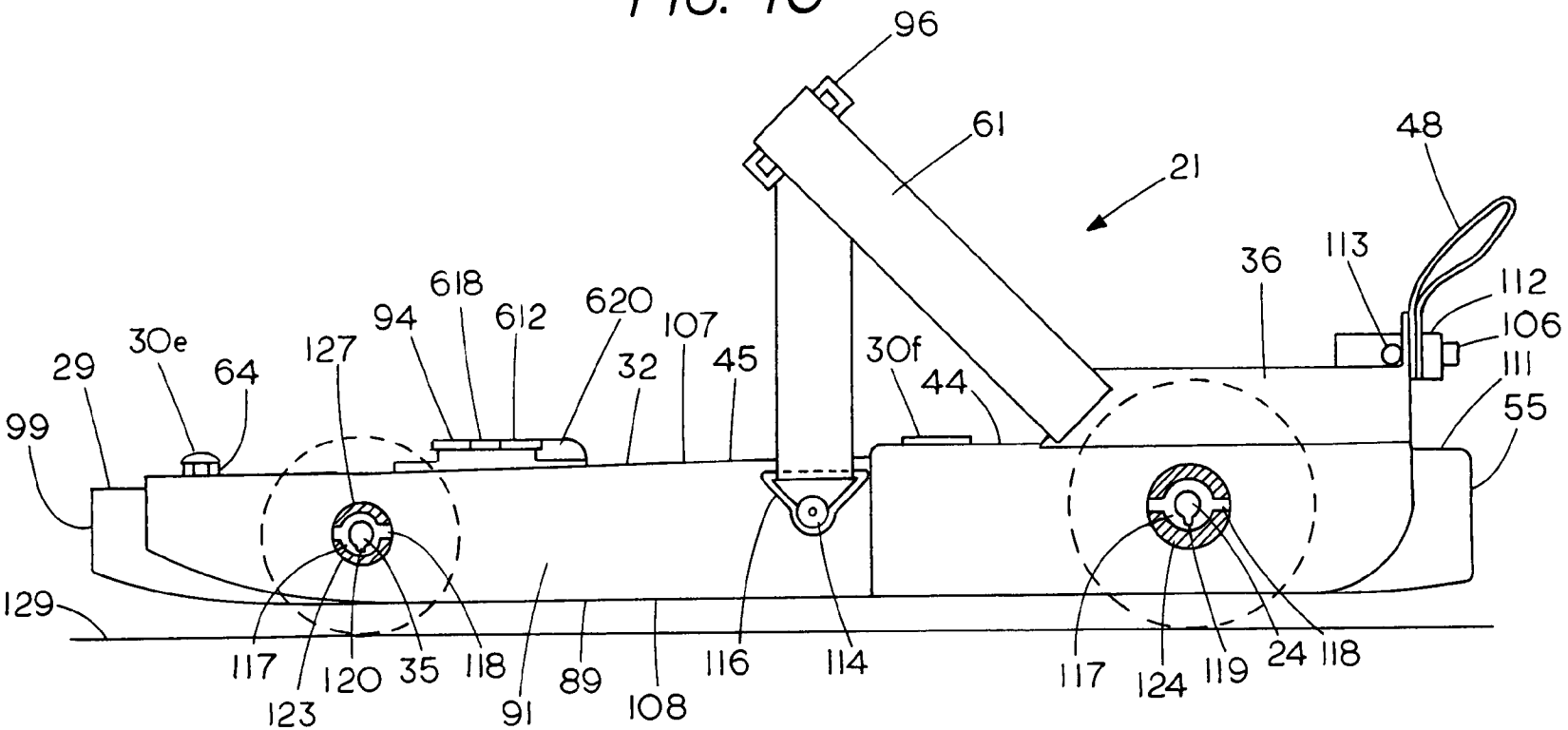
FIG. 40 is a medial side view of an alternate quad wheeled skate generally similar to that shown in FIG. 35, but including an elastomeric front suspension and elastomeric rear suspension.

FIG. 40 is a medial side 91 view of an alternate quad wheeled skate 21 generally similar to that shown in FIG. 35, but including a substantially elastomeric front suspension 123 and also an elastomeric rear suspension 124. The axle retainer 117 has an opening 35 for holding the axle 24 that can include a slot 120 for receiving a key 119 which can be present on the axle 24 for the purpose of preventing it from rotating. The axle retainer 117 can also include at least one extension 118 in order to better load a larger area and secure the axle retainer 117 in relation to the substantially surrounding or encapsulating elastomer 127, but also to prevent the axle retainer 117 from being able to pass through the openings 35 provided through the medial side 91 and lateral side 92 of the chassis 32 for the axle 24. Accordingly, the wheels 28 and 26 can impart loads to the axles 24 which can then transfer these loads to the axle retainers 117 including extensions 118 causing the axle retainers 117 to be deflected or partially rotate, thus causing compression or extension of the surrounding elastomer 127 which then acts both as a spring and a dampener to attenuate shock and vibration.

Figure 41:
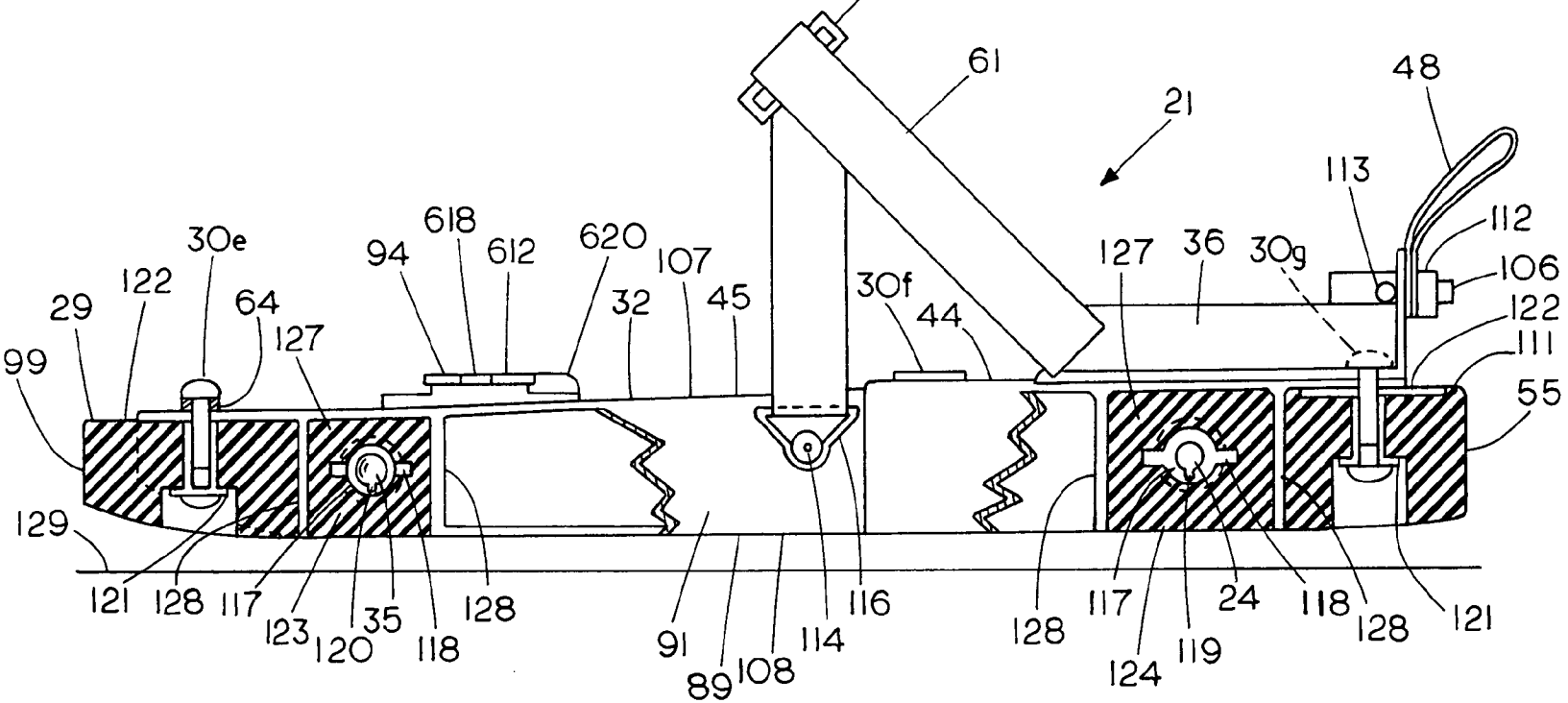
FIG. 41 is a medial side view of the alternate quad wheeled skate shown in FIG. 40, but having portions of the chassis broken away to reveal some of the internal structure of the skate, and in particular, the elastomeric front suspension and elastomeric rear suspension.

FIG. 41 is a medial side 91 view of the alternate quad wheeled skate 21 shown in FIG. 40, but having portions of the chassis 32 broken away to reveal some of the internal structure of the wheeled skate 21, and in particular, the elastomeric front suspension 123 and elastomeric rear suspension 124. As shown, the elastomeric front suspension 123 and also the elastomeric rear suspension 124 consist of an axle retainer 117 that can further include extensions 118, and the axle retainer 117 is substantially surrounded or encapsulated by an elastomer 127. The elastomeric front suspension 123 and elastomeric rear suspension 124 can be inserted from the inferior side 108 of the chassis 32 into mating void spaces between the medial side 91, lateral side 92, and two transverse vertical walls 128, and the axles 24 can then be inserted through the medial or lateral side of the chassis 32. Shown in FIG. 41 is a front brake pad 29 which can be positioned and secured at a desired elevation above an underlying support surface 129 using retaining bolt 30*e*, nut 64, and washer 121. Also shown is a spacer 122 for further adjusting the elevation of the front brake pad 29 above the support surface 129. If desired, a plurality of spacers 122 can be stacked upon one another and used for this purpose. Shown in FIG. 41 is a rear brake pad 111 which can be positioned and secured at a desired elevation above an underlying support surface 129 using retaining bolt 30*g* and washer 121. Also shown is a spacer 122 for further adjusting the elevation of the rear brake pad 111 above the support surface 129. If desired, a plurality of spacers 122 can be stacked upon one another and used for this purpose.

Figure 42:
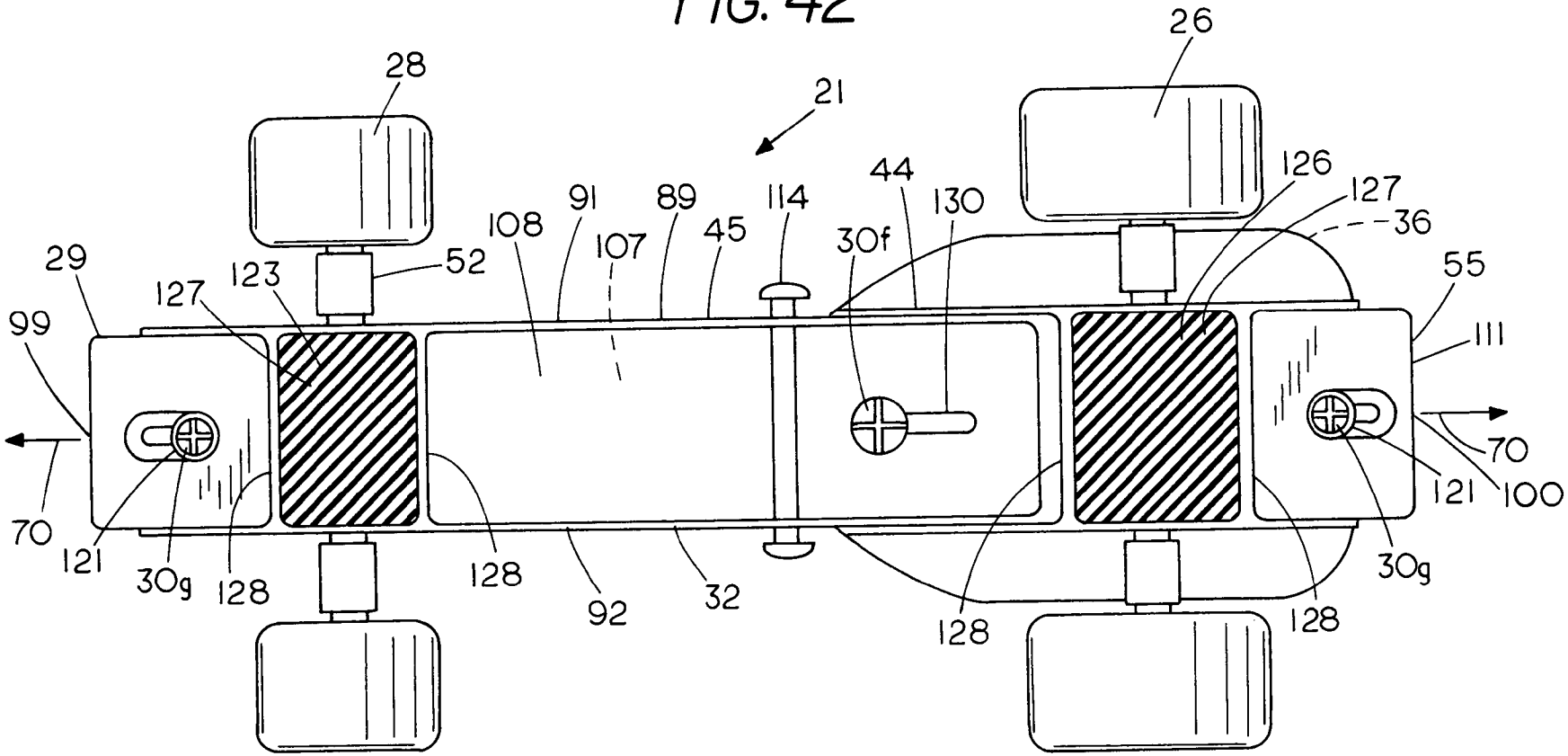
FIG. 42 is a bottom plan view of the alternate quad wheeled skate shown in FIG. 40.

FIG. 42 is a bottom plan view of the alternate quad wheeled skate 21 shown in FIG. 40. The front elastomeric suspension 123 and rear elastomeric suspension 124 are both shown secured in position between the medial side 91, lateral side 92, and two transverse vertical walls 128 of the chassis 32.

Figure 43:
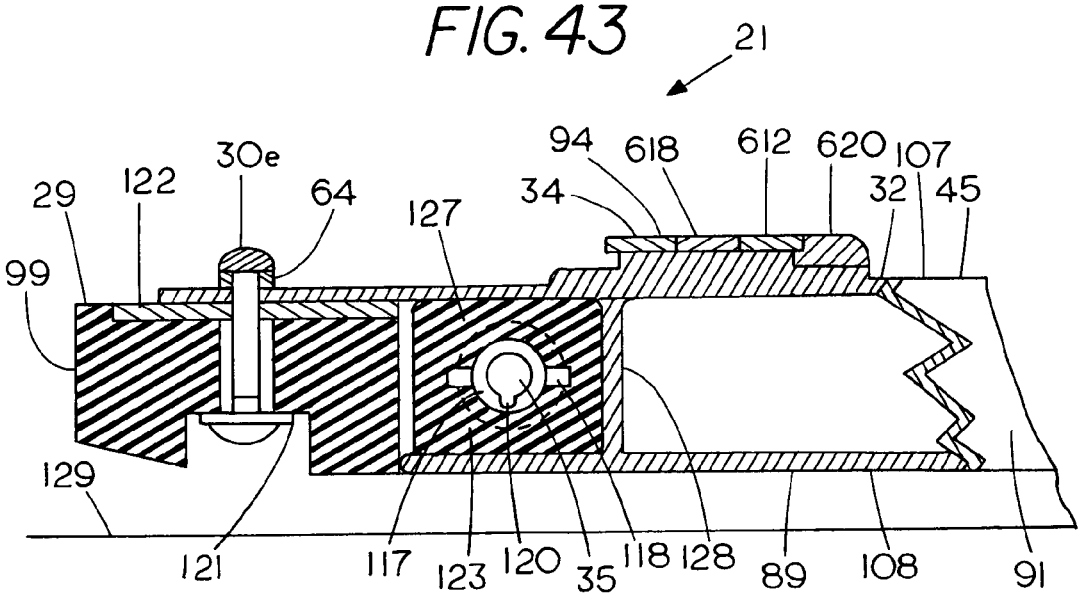
FIG. 43 is a partial medial side view of a quad wheeled skate generally similar to that shown in FIGS. 40 and 41, but having parts broken away to reveal a different internal structure than that shown in FIG. 41.

FIG. 43 is a partial medial side 91 view of a quad wheeled skate 21 generally similar to that shown in FIGS. 40 and 41, but having parts broken away to reveal a different internal structure than that shown in FIG. 41. In this embodiment, the alternate front elastomeric suspension 123 including the axle retainer 117 and elastomer 127 can be inserted from the anterior side 99 into a void space having a corresponding size and shape, and the front brake pad 20 can then be secured in position. It can be readily understood that a similar structure and method can be used to secure an alternate rear elastomeric suspension 124, that is, the alternate rear elastomeric suspension 124 can be inserted from the posterior side 100, and the rear brake pad 111 can then be secured in position.

Figure 44:
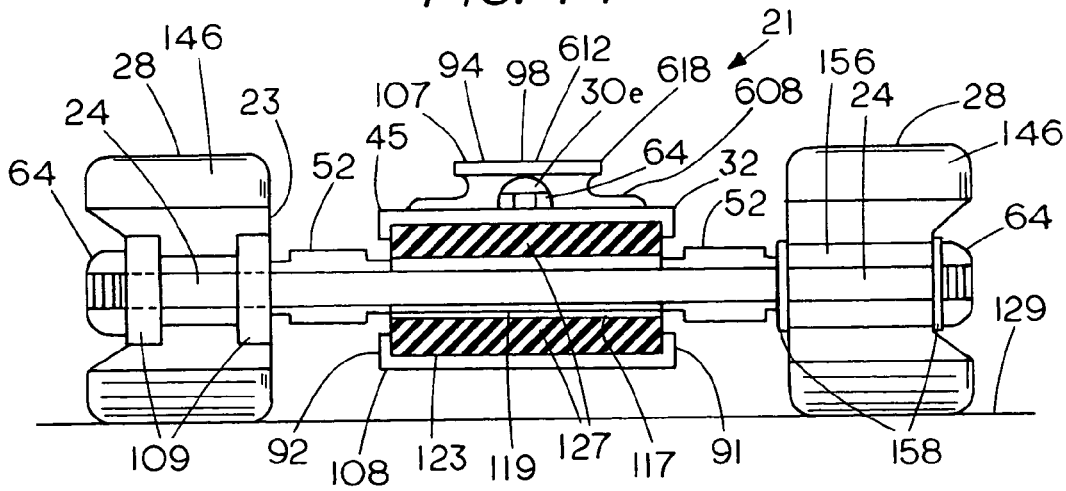
FIG. 44 is a transverse cross-sectional view of a quad wheeled skate having a structure generally similar to that shown in FIG. 43, taken along a line having a similar position as line 44—44 shown in FIG. 35.

FIG. 44 is a transverse cross-sectional view of a quad wheeled skate 21 having a structure generally similar to that shown in FIG. 43 taken along a line having a similar position as line 44—44 shown in FIG. 35. As shown, the axle retainer 117 is surrounded or encapsulated within an elastomer 127. The elastomer 127 can be made of a resilient thermoset rubber, thermoplastic rubber, or polyurethane material, and the like. Both the weight and cost of a wheeled skate 21 including an elastomeric front suspension 123 and rear suspension 124 can be reduced relative to conventional quad wheeled skates. The wheel 28 on the left side of FIG. 44 rotates on the fixed axle 24 and includes two sealed ball bearings. However, the alternate wheel 28 on the right side of FIG. 44 rotates on the fixed axle 24, but instead includes a substantially thermoplastic bearing 156 and also two speed washers 158. Manufacturers of suitable thermoplastic bearings include IGLIDE® bearings by IGUS of East Providence, R.I., and NYLINER® bearings by Thompson Industrial Molded Products, Inc. of Port Washington, N.Y. Supplies of resins for such thermoplastic bearings include LUBRICOMP® materials by LNP Engineering Plastics, Inc. of Exton, Pa., and DSM Engineering Plastics of Evansville, Ind. The use of such thermoplastic bearings can reduce bearing weight and cost, and facilitate the design of novel wheel configurations.

Figure 45:
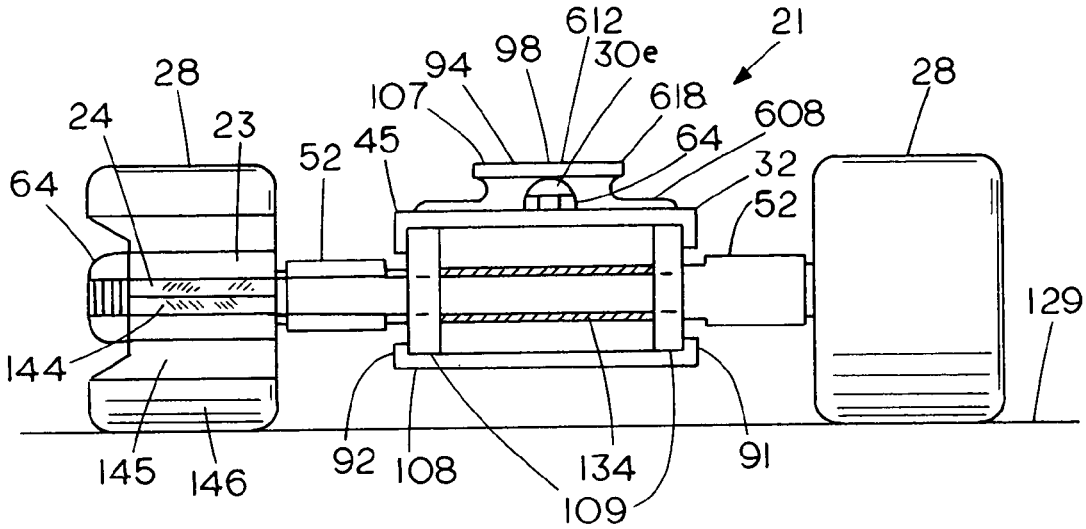
FIG. 45 is a transverse cross-sectional view of an alternate quad roller skate showing two sealed ball bearings mounted within the chassis, taken along a line having a similar position as line 44—44 shown in FIG. 35.

FIG. 45 is a transverse cross-sectional view, taken along a line having a similar position as line 44—44 shown in FIG. 35, of an alternate quad wheeled skate 21 having two sealed ball bearings 109 mounted within the chassis 32. In this way, only two instead of four sealed ball bearings 109 are required, thus both the weight and cost of a wheeled skate 21 can be reduced. In this embodiment, the ends of the axles 24 can include a square 144 or other non-circular shape that can be secured to the hub 23 of the wheels 28. Further, the wheels 28 can include a softer durometer material 145 adjacent to the hub 23 and a harder durometer material 146 for contact with the support surface 129. For example, a relatively soft material 145, such as a 65 Shore durometer material, can be used adjacent the hub 23, whereas a relatively hard material 146, such as a 85 Shore durometer material, can be used for contact with the support surface 129. In this way, the resulting wheels 28 can provide advantageous shock and vibration isolation while still providing advantageous speed and wear properties.

Figure 46:
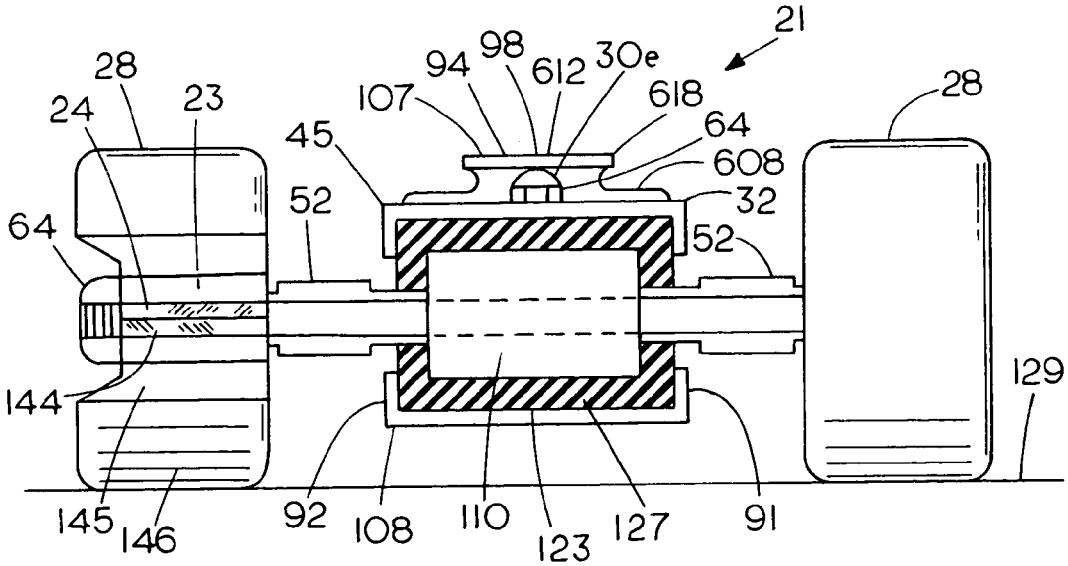
FIG. 46 is a transverse cross-sectional view of an alternate quad wheeled skate showing a sealed cylindrical bearing mounted within the chassis, taken along a line having a similar position as line 44—44 shown in FIG. 35.

FIG. 46 is a transverse cross-sectional view taken along a line having a similar position as line 44—44 shown in FIG. 35 of an alternate quad wheeled skate 21 showing a sealed cylindrical bearing 110 mounted within the chassis 32. The structure of the chassis 32 can be similar to that shown in FIG. 43. As shown, similar to the axle retainer 117 shown in FIG. 44, the cylindrical bearing 110 is surrounded or encapsulated within an elastomer 127 that can provide shock and vibration isolation. Further, this embodiment of a wheeled skate 21 can include conventional wheels 28, or as shown, can alternatively include wheels 28 having a softer material 145 near the hub 23 and a harder material 146 for contact with the support surface 129, as previously shown and discussed in connection with FIG. 45.

Figure 47:
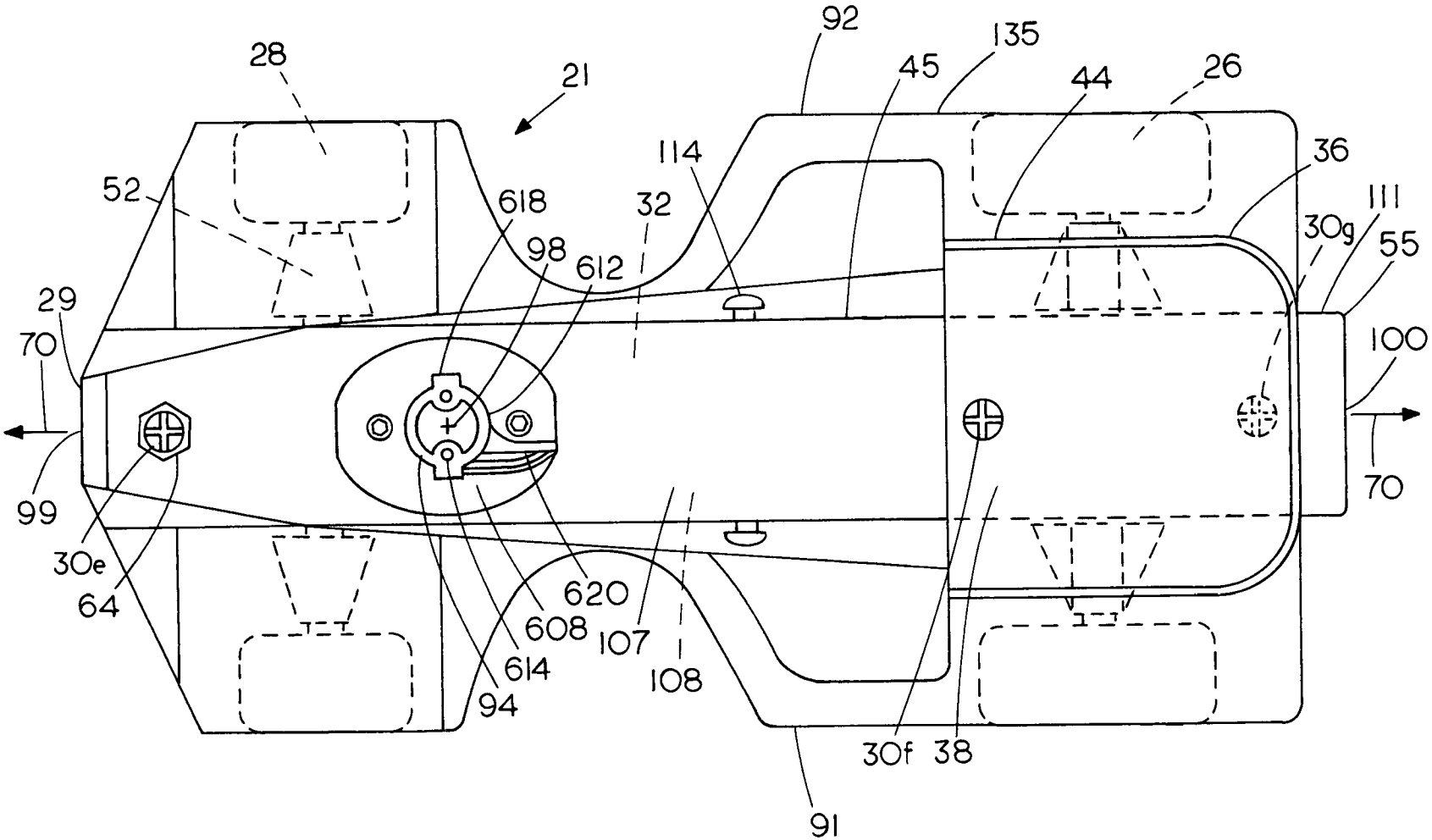
FIG. 47 is a top plan view of an alternate quad wheeled skate having a plastic body resembling a formula race car.

FIG. 47 is a top plan view of an alternate quad wheeled skate 21 having a plastic body 135 resembling a formula race car. The body 135 can improve the aerodynamic characteristics of the wheeled skate 21, decrease the splashing of water and mud upon a skater, reduce a skater's likelihood of tangling left and right skates, and improve the aesthetic appearance of the wheeled skate 21. As shown, a posterior chassis portion 44 including the rearfoot retainer flange 36 can be secured to the anterior chassis portion 45 in various positions for selectively adjusting the effective foot length size provided by the wheeled skate 21 in order to accommodate the foot size of an individual wearer.

Figure 48:
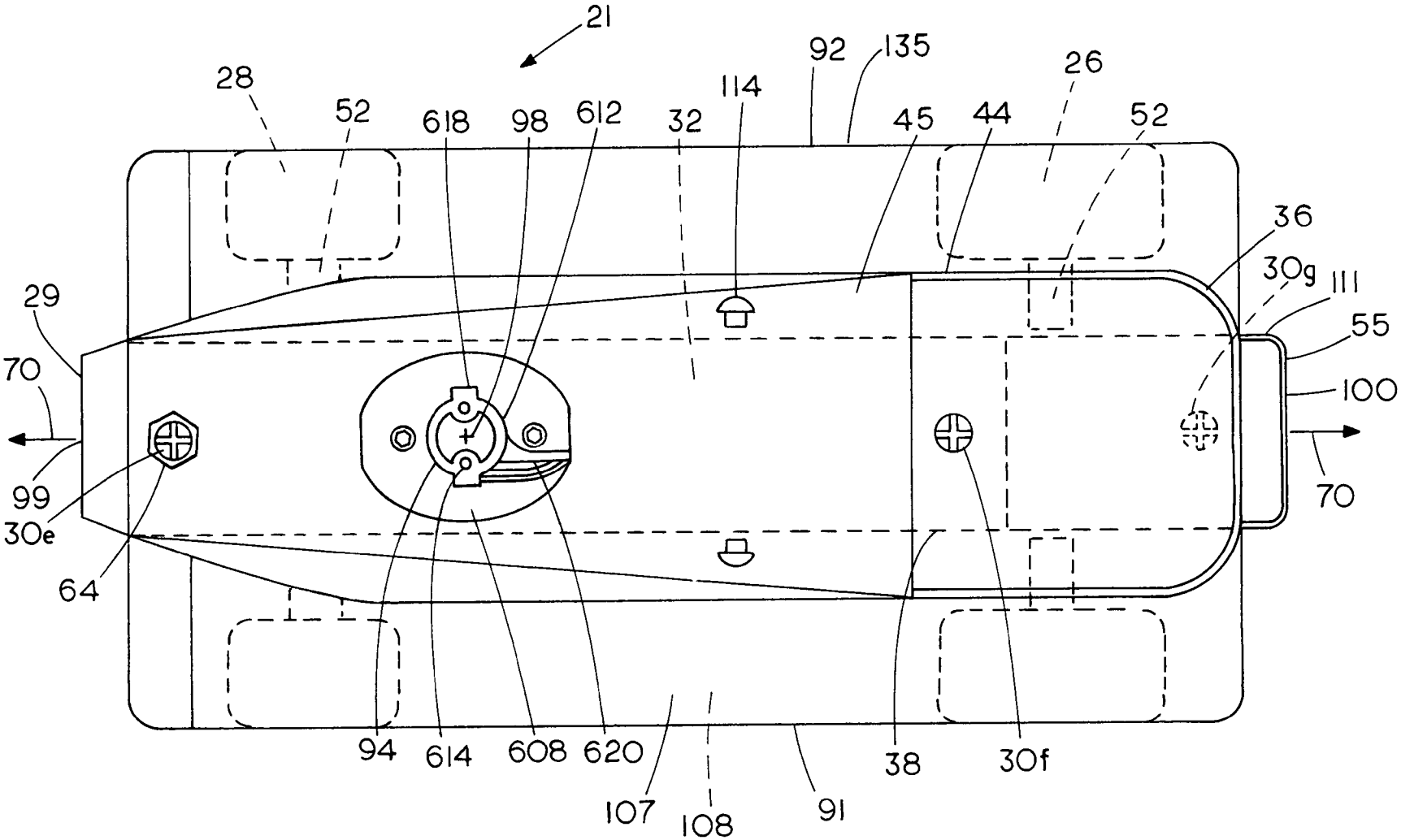
FIG. 48 is a top plan view of an alternate quad wheeled skate having a plastic body resembling a stock race car.

FIG. 48 is a top plan view of an alternate quad wheeled skate 21 having a plastic body 135 resembling a stock race car. The features and advantages of this embodiment are essentially the same as those described previously with respect to the embodiment shown in FIG. 47.

Figure 49:
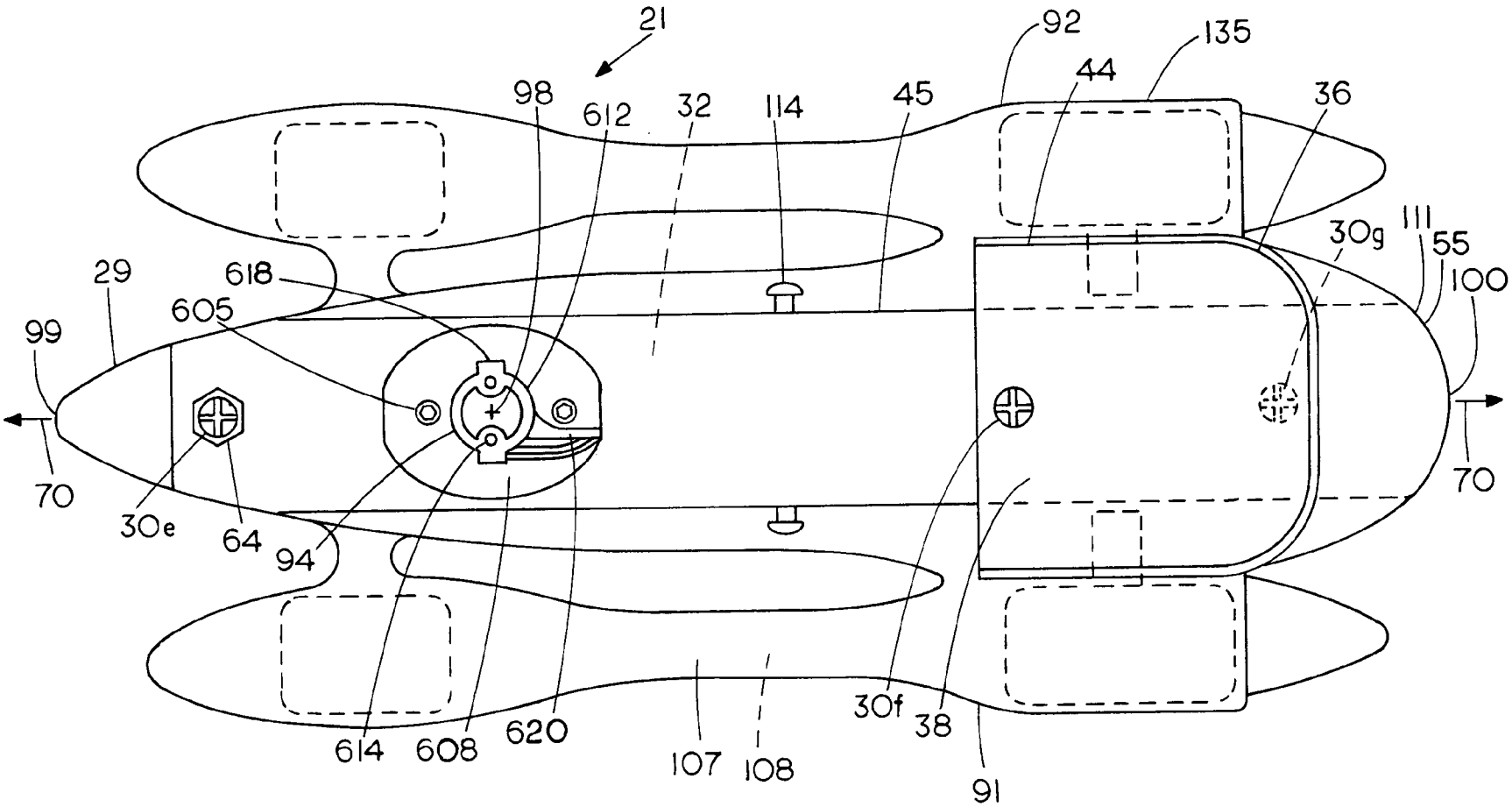
FIG. 49 is a top plan view of an alternate quad wheeled skate having a plastic body resembling a jet powered race car.

FIG. 49 is a top plan view of an alternate quad wheeled skate 21 having a plastic body 135 resembling a jet powered race car. Again, the features and advantages of this embodiment are essentially the same as those described previously with respect to the embodiment shown in FIG. 47.

Figure 50:
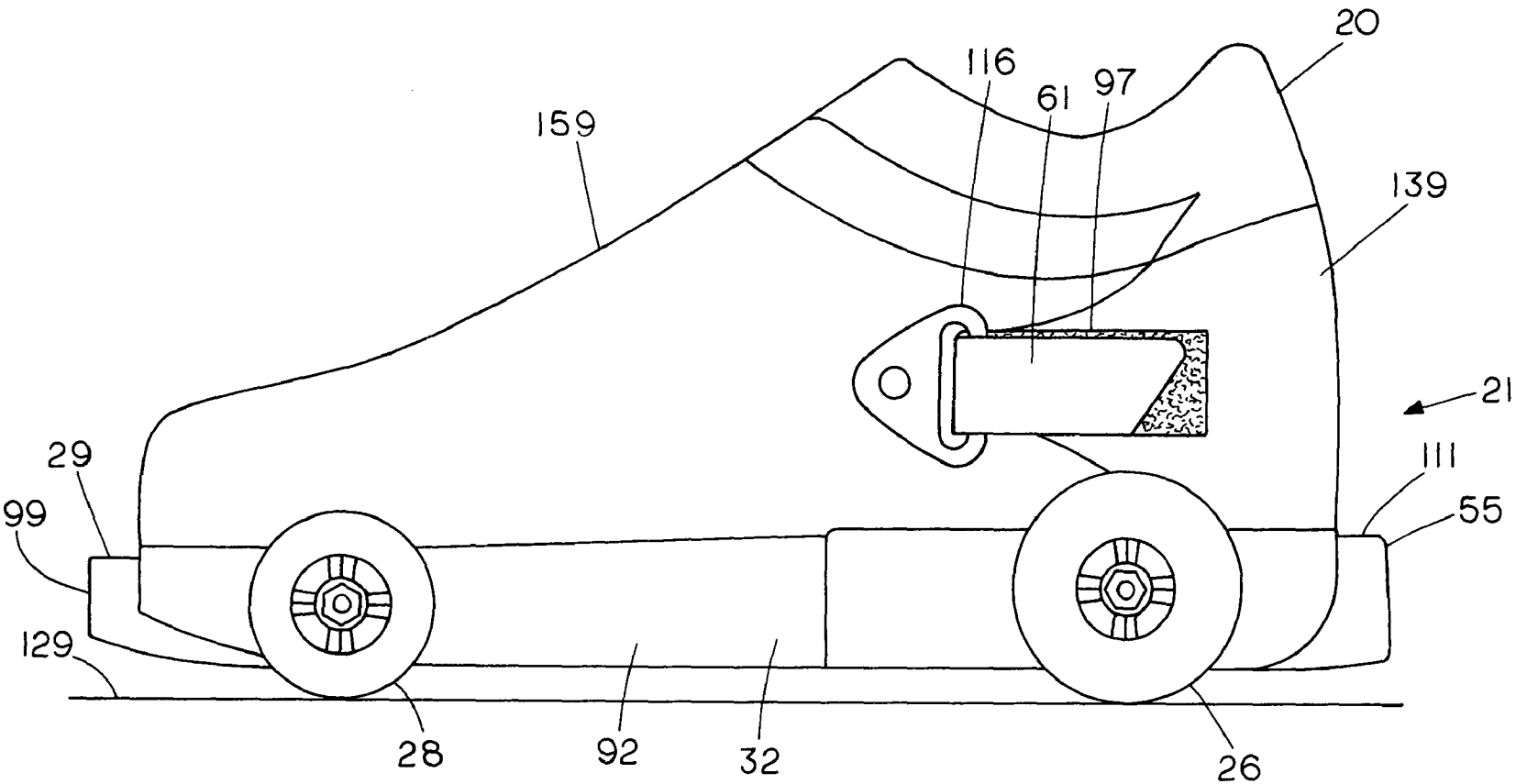
FIG. 50 is a lateral side view of an alternate quad wheeled skate having an integral skate upper including a forefoot portion and rearfoot portion including closure means for securing the foot of a wearer.

FIG. 50 is a lateral side 92 view of an alternate quad wheeled skate 21 having an integral skate upper 159 including a forefoot portion 138 and rearfoot portion 139 secured to the chassis 32. The forefoot portion 138 and rearfoot portion 139 can include closure means such as triangle ring 116 and strap 61 including VELCRO® hook and pile for securing the foot of a wearer.

Figure 51:
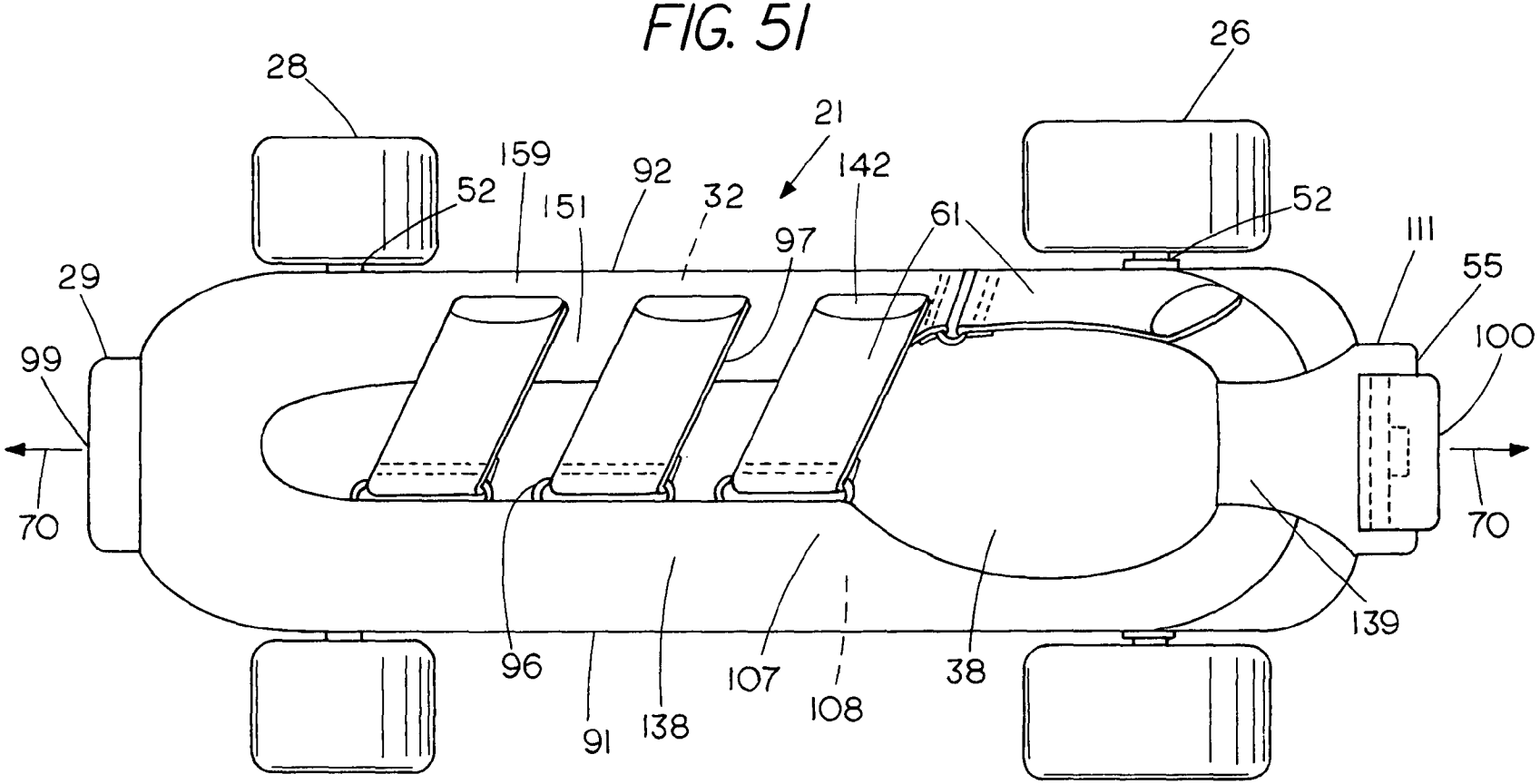
FIG. 51 is a top plan view of an alternate quad wheeled skate having an integral skate upper including a forefoot portion and rearfoot portion including closure means for securing the foot of a wearer.

FIG. 51 is a top plan view of an alternate quad roller skate 21 having an integral skate upper 159 including a forefoot portion 138 and rearfoot portion 139 secured to the chassis 32. The forefoot portion 138 and rearfoot portion 139 can include closure means such as a plurality of straps 61 including VELCRO® hook and pile for securing the foot of a wearer. The end of the straps 61 can include a reinforcement material 142 for enhancing grip and preventing wear. As shown, the rearfoot portion 139 can include an adjustable strap 61 that can encompass a wearer's heel.

Figure 52:
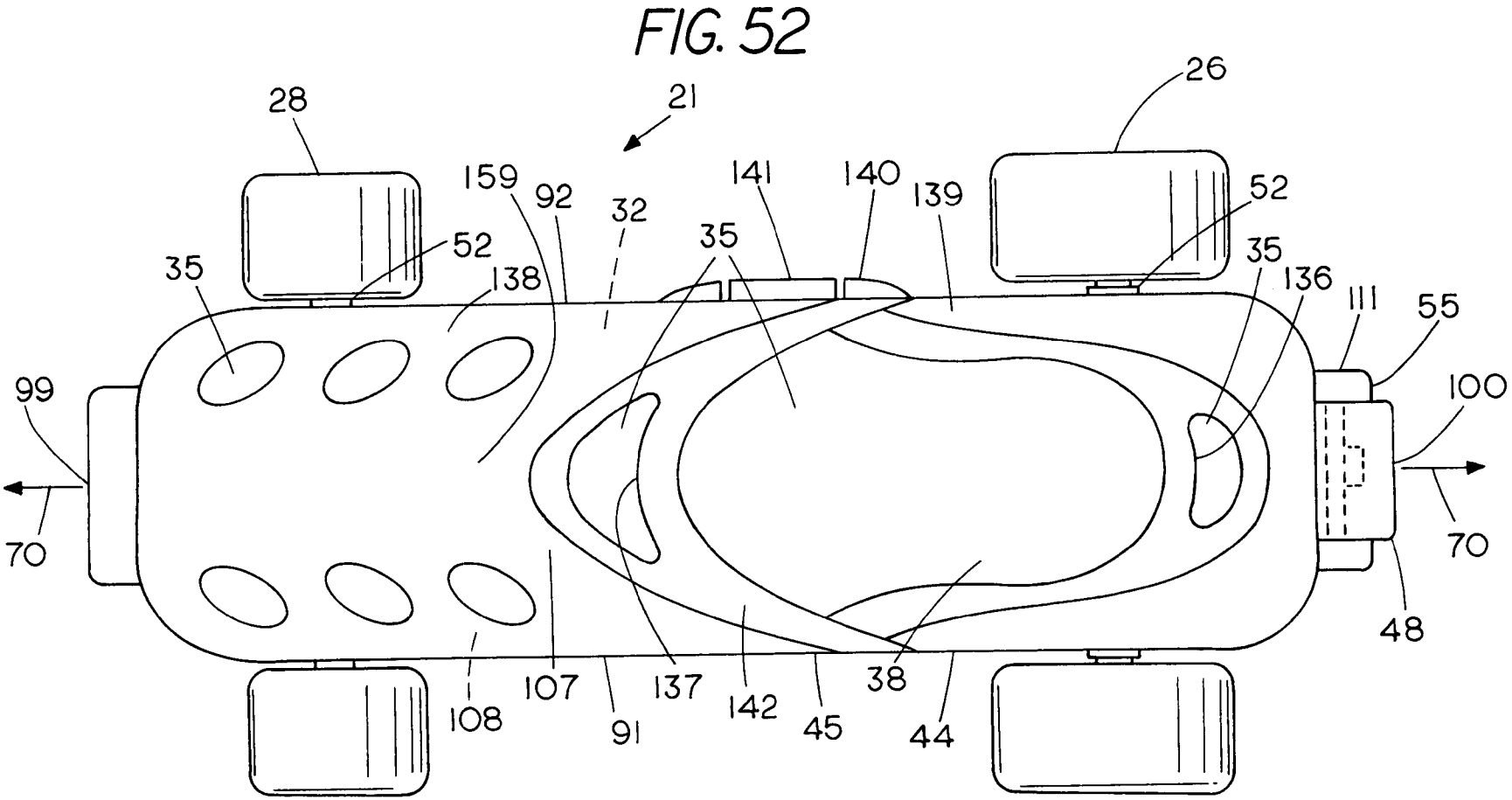
FIG. 52 is a top plan view of an alternate quad wheeled skate having an integral skate upper including a forefoot portion and rearfoot portion including closure means for securing the foot of a wearer.

FIG. 52 is a top plan view of an alternate quad wheeled skate 21 having an integral skate upper 159 including a forefoot portion 138 and rearfoot portion 139 secured to the chassis 32. The forefoot portion 138 and rearfoot portion 139 can be made of a textile laminated foam rubber material such as neoprene which is generally similar to that used in making water ski boots and bindings. The forefoot portion 138 and rearfoot portion 139 can also include a reinforcement material 142 surrounding the front pull 137 and back pull 136 and also about the edges of the large opening 35 for receiving a wearer's foot. A plurality of smaller openings 35 can also be provided in the forefoot portion 138 for facilitating ventilation. The anterior chassis portion 45 and posterior chassis portion 44 can be caused to move longitudinally to adjust the provided foot length size when the length adjustment actuator 141 is suitably manipulated. As shown, the actuator 141 can include a release button 106 which can be protected from accidental engagement by guards 140. The actuator 141 can be associated with an length adjustment and locking mechanism which is generally similar in structure and function to those used in commercial water ski bindings.

Figure 53:
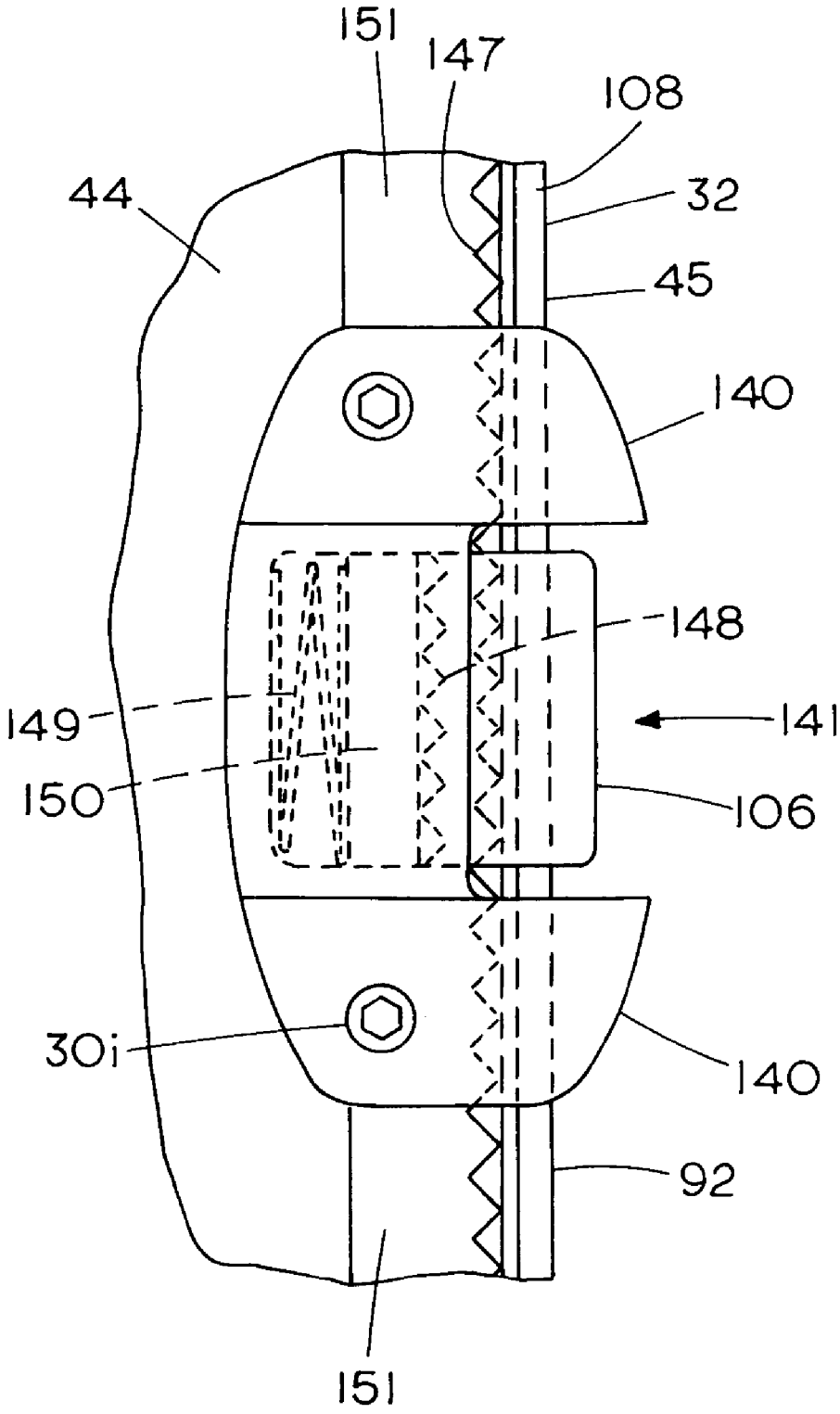
FIG. 53 is a partial bottom view of the alternate quad roller skate shown in FIG. 52 with parts broken away in order to show the length adjusting mechanism.

FIG. 53 is a partial bottom view of the alternate quad wheeled skate 21 shown in FIG. 52 with parts broken away in order to focus on the length adjustment actuator 141. As shown, the actuator 141 is secured to the posterior chassis portion 44 by two bolts 30*i*. The push button 106 is protected from accidental actuation on the anterior side and posterior side by guards 140. The push button 106 is integral with a plunger 150 that projects in part above the push button 106. The plunger 150 includes movable teeth 148 and is accommodated by a vertical recess 151 in the posterior portion of the chassis 44. The integral push button 106 and plunger 150 are preloaded by a spring 149, thus the push button 106 and plunger 150 must be depressed in order to disengage the movable teeth 148 on the plunger 50 from the fixed teeth 147 that are secured on the inside of the lateral side 92 and anterior portion of the chassis 45. The actuator 141 shown in FIG. 53 provides one example of a length adjustment device. It is anticipated that many other mechanical devices can be used in order to adjust the provided foot length size and overall length of a wheeled skate 21, as desired.

FIG. 54 is a perspective view of a bicycle pedal 600 including a pedal portion of bicycle cleat locking apparatus 155, and also a bicycle crank 160 show in phantom with dashed lines. As shown, the spindle 604 portion of the bicycle pedal 600 can be bolted to the bicycle crank 160. The bicycle pedal 600 includes at least one pedal portion of bicycle cleat locking apparatus 155 which can include a center of rotation 98, screws 605, a top surface 608, head 612, screws 614, head tabs 618, and cam stop 620 substantially as recited and shown in U.S. Pat. No. 5,546,829 granted to Bryne, previously incorporated by reference herein. A bicycle pedal 600 including a pedal portion of bicycle cleat locking apparatus 155 can be mechanically engaged and removably secured to an article of footwear 20 including a complimentary footwear portion of locking mechanism assembly 95 which also consists of a bicycle cleat portion of bicycle cleat locking apparatus 154 such as that shown in FIG. 34, thus enabling the article of footwear 20 to be removably secured to a wheel skate 21 including a skate portion of locking mechanism assembly 94, or alternatively, to the aforementioned bicycle pedal 600, as desired.

While the above detailed description of the invention contains many specificities, these should not be construed as limitations on the scope of the invention, but rather as exemplifications of several preferred embodiments thereof. Many other variations are possible. It can be readily understood that some of the devices and features shown in the drawings, and discussed or otherwise incorporated within the disclosure, can be used in partial or complete combination. Accordingly, the scope of the invention should be determined not by the embodiments discussed or illustrated, but by the appended claims and their legal equivalents.

I claim:

1. A wheeled skate and an article of footwear comprising a locking mechanism assembly for removably securing said article of footwear to said wheeled skate, said locking mechanism assembly comprising a footwear portion of said locking mechanism assembly secured to said article of footwear, and a skate portion of said locking mechanism assembly secured to said wheeled skate, wherein said footwear portion of said locking mechanism assembly comprises a bicycle cleat portion of a bicycle cleat locking apparatus, whereby said article of footwear can be removably secured in functional relation to a bicycle pedal including a compatible pedal portion of said bicycle cleat locking apparatus, and alternatively, to said wheeled skate comprising said skate portion of locking mechanism assembly.

2. The wheeled skate and article of footwear according to claim 1, wherein said footwear portion of locking mechanism assembly and said skate portion of locking mechanism assembly comprise compatible male and female components.

3. The wheeled skate and article of footwear according to claim 1, wherein said footwear portion of locking mechanism assembly, and said skate portion of locking mechanism assembly, and said pedal portion of said bicycle cleat locking apparatus are hermaphroditic.

4. The wheeled skate according to claim 1, comprising an in-line wheeled skate.

5. The wheeled skate according to claim 1, comprising a quad wheeled skate.

6. The wheeled skate and article of footwear according to claim 1, further including fastening means for removably securing the rearfoot of said article of footwear to said wheeled skate.

7. The wheeled skate according to claim 1, further comprising a rotatable brake pad including a peripheral portion which is orientated to engage a skating surface supporting said wheeled skate when said medial side of said wheeled skate is inclined inwardly.

8. The wheeled skate according to claim 7, comprising a renewable wear surface for engagement with said rotatable brake pad.

9. The wheeled skate according to claim 7, wherein said rotatable brake pad is spherical.

10. The wheeled skate according to claim 7, wherein said rotatable brake pad is oval.

11. The wheeled skate according to claim 7, wherein said rotatable brake pad is cylindrical.

12. The wheeled skate according to claim 7, further comprising a longitudinal axis, wherein said rotatable brake pad is configured for rotation substantially parallel with respect to the longitudinal axis of said wheeled skate.

13. The wheeled skate according to claim 7, further including a chassis, wherein at least a portion of said peripheral portion of said rotatable brake pad is engaged with a portion of said chassis of said wheeled skate.

14. The wheeled skate according to claim 7, wherein said rotatable brake pad is secured by a brake pad retainer, and said rotatable brake pad and said brake pad retainer are removable and renewable.

15. The wheeled skate according to claim 14, and a ground support surface, said wheeled skate further comprising a chassis having a platform and an inferior portion, said rotatable brake pad and said brake pad retainer extending between a position near said inferior portion of said chassis and said platform at an angle in the range between 25–45 degrees.

16. The wheeled skate according to claim 1, further comprising a removable front brake pad extending at least to the anterior side of said wheeled skate, and also a removable rear brake pad extending at least to the posterior side of said wheeled skate.

17. The wheeled skate according to claim 1, further comprising a rocker adjustment device.

18. The wheeled skate according to claim 1, further comprising an anterior chassis portion, a posterior chassis portion, and fastening means, whereby said longitudinal length of said wheeled skate is adjustable.

19. A wheeled skate having a plurality of wheels for rolling upon a skating surface comprising a chassis comprising a longitudinal axis, a middle, a medial side, and a rotatable brake pad mounted to a brake pad retainer, said rotatable brake pad being orientated to engage said skating surface supporting said wheeled skate when said medial side of said wheeled skate is inclined inwardly, wherein said rotatable brake pad is located at said middle of said chassis on said medial side, whereby said rotatable brake pad rotates substantially parallel with respect to said longitudinal axis of said wheeled skate and independently of said plurality of wheels, when said medial side of said wheeled skate is inclined inwardly.

20. The wheeled skate according to claim 19, wherein said rotatable brake pad comprises an oval brake pad.

21. The wheeled skate according to claim 19, comprising a renewable wear surface for engagement with said rotatable brake pad.

22. The wheeled skate according to claim 19, wherein at least a portion of the peripheral portion of said rotatable brake pad is engaged with a portion of said chassis of said wheeled skate.

23. The wheeled skate according to claim 19, wherein said rotatable brake pad is secured by a brake pad retainer, and said rotatable brake pad and said brake pad retainer are removable and renewable.

24. The wheeled skate according to claim 23, and a ground support surface, said wheeled skate further comprising a chassis having a platform and an inferior portion, said rotatable brake pad and said brake pad retainer extending between a position near said inferior portion of said chassis and said platform at an angle in the range between 25–45 degrees.

25. The wheeled skate according to claim 19, further comprising a removable front brake pad extending at least to the anterior side of said wheeled skate, and also a removable rear brake pad extending at least to the posterior side of said wheeled skate.

26. The wheeled skate according to claim 19, further comprising an anterior chassis portion, a posterior chassis portion, and fastening means, whereby said longitudinal length of said wheeled skate is adjustable.

27. A wheeled skate comprising a chassis having a medial side, and an article of footwear, said wheeled skate further comprising a rotatable brake pad including a peripheral portion which is orientated to engage a skating surface supporting said wheeled skate when said medial side of said wheeled skate is inclined inwardly, said rotatable brake pad located exterior to said medial side of said chassis, said wheeled skate and said article of footwear further comprising a locking mechanism assembly for removably securing said article of footwear to said wheeled skate, said locking mechanism assembly comprising a footwear portion of locking mechanism assembly secured to said article of footwear, and said chassis comprising a compatible skate portion of locking mechanism assembly, wherein said footwear portion of locking mechanism assembly comprises a bicycle cleat portion of a bicycle cleat locking apparatus, whereby said article of footwear can be removably secured in functional relation to a bicycle pedal including a compatible pedal portion of said bicycle cleat locking apparatus, and alternatively, to said chassis comprising said compatible skate portion of locking mechanism assembly.

28. A wheeled skate, and an article of footwear comprising an anterior side, a posterior side, a medial side, a lateral side, a superior side, an inferior side, a forefoot, and a rearfoot, said wheeled skate and said article of footwear comprising a locking mechanism assembly for removably securing said forefoot of said article of footwear to said wheeled skate, said locking mechanism assembly comprising a footwear portion of locking mechanism assembly secured to said inferior side of said forefoot of said article of footwear, said wheeled skate comprising a compatible skate portion of locking mechanism assembly, whereby said forefoot of said article of footwear can be removably secured to said wheeled skate, said wheeled skate further comprising means for removably securing said rearfoot of said article of footwear to said wheeled skate, said means comprising a rearfoot retainer flange which encompasses a portion of said medial, said lateral, and said posterior sides of said article of footwear when said forefoot of said article of footwear is removably secured to said wheeled skate and said rearfoot of said article of footwear is positioned within said rearfoot retainer flange, said rearfoot of said article of footwear being further removably secured by fastening means to said rearfoot retainer flange, wherein said footwear portion of locking mechanism assembly comprises a bicycle cleat portion of a bicycle cleat locking apparatus, whereby said article of footwear can be removably secured to a bicycle pedal including a compatible pedal portion of said bicycle cleat locking apparatus, and alternatively, to said chassis of said wheeled skate comprising said skate portion of locking mechanism assembly.

29. A wheeled skate, and an article of footwear comprising an antenor side, a posterior side, a medial side, a lateral side, a superior side, an inferior side, a forefoot, and a rearfoot, said wheeled skate and said article of footwear comprising a locking mechanism assembly for removably securing said forefoot of said article of footwear to said wheeled skate, said locking mechanism assembly comprising a footwear portion of locking mechanism assembly secured to said inferior side of said forefoot of said article of footwear, said wheeled skate comprising a compatible skate portion of locking mechanism assembly, whereby said forefoot of said article of footwear can be removably secured to said wheeled skate, said wheeled skate further comprising means for removably securing said rearfoot of said article of footwear to said wheeled skate, said means comprising a rearfoot retainer flange which encompasses a portion of said medial, said lateral, and said posterior sides of said article of footwear when said forefoot of said article of footwear is removably secured to said wheeled skate and said rearfoot of said article of footwear is positioned within said rearfoot retainer flange, wherein said footwear portion of locking mechanism assembly comprises a bicycle cleat portion of a bicycle cleat locking apparatus, whereby said article of footwear can be removably secured to a bicycle pedal including a compatible pedal portion of said bicycle cleat locking apparatus, and alternatively, to said chassis of said wheeled skate comprising said skate portion of locking mechanism assembly.

30. The wheeled skate and article of footwear according to claim 29, wherein said rearfoot of said article of footwear is removably secured by said fastening means to said rearfoot retainer flange.

* * * * *